US008147385B2

(12) United States Patent
Crawford et al.

(10) Patent No.: US 8,147,385 B2
(45) Date of Patent: Apr. 3, 2012

(54) UPPER BODY EXERCISE AND FLYWHEEL ENHANCED DUAL DECK TREADMILLS

(75) Inventors: Douglas A. Crawford, Lafayette, CO (US); Gary D. Piaget, Deerharbor, WA (US); Patrick A. Warner, Boulder, CO (US); Brent Christopher, Portland, OR (US)

(73) Assignee: Nautilus, Inc., Vancouver, WA (US)

( * ) Notice: Subject to any disclaimer, the term of this patent is extended or adjusted under 35 U.S.C. 154(b) by 0 days.

(21) Appl. No.: 12/902,884

(22) Filed: Oct. 12, 2010

(65) Prior Publication Data

US 2011/0034303 A1 Feb. 10, 2011

Related U.S. Application Data

(60) Continuation of application No. 12/404,534, filed on Mar. 16, 2009, now Pat. No. 7,811,209, which is a division of application No. 11/065,746, filed on Feb. 25, 2005, now Pat. No. 7,517,303, and a continuation-in-part of application No. 10/789,182, filed on Feb. 26, 2004, now Pat. No. 7,261,850, and a continuation-in-part of application No. 10/789,294, filed on Feb. 26, 2004, now Pat. No. 7,553,260, and a continuation-in-part of application No. 10/789,579, filed on Feb. 26, 2004, now Pat. No. 7,618,346.

(60) Provisional application No. 60/548,787, filed on Feb. 26, 2004, provisional application No. 60/548,265, filed on Feb. 26, 2004, provisional application No. 60/548,786, filed on Feb. 26, 2004, provisional application No. 60/548,811, filed on Feb. 26, 2004, provisional application No. 60/450,789, filed on Feb. 28, 2003, provisional application No. 60/450,890, filed on Feb. 28, 2003, provisional application No. 60/451,104, filed on Feb. 28, 2003.

(51) Int. Cl.
*A63B 22/02* (2006.01)
*A63B 22/04* (2006.01)

(52) U.S. Cl. ..... 482/52; 482/54

(58) Field of Classification Search ..... 482/51–54, 482/57, 148
See application file for complete search history.

(56) References Cited

U.S. PATENT DOCUMENTS 219,439 A 9/1879 Blend
(Continued)

FOREIGN PATENT DOCUMENTS

EP 1316332 6/2003
(Continued)

OTHER PUBLICATIONS

"Nautilus Home Health & Fitness Catalog", Nautilus, Inc., pp. 1-56 (2004).

*Primary Examiner* — Stephen Crow
(74) *Attorney, Agent, or Firm* — Dorsey & Whitney LLP

(57) ABSTRACT

An exercise device includes a first treadle assembly supporting a first moving surface and a second treadle assembly supporting a second moving surface. The exercise device further includes an upper body exercise assembly operably associated with the exercise device. The first treadle assembly is pivotally coupled with the frame structure, and the second treadle assembly is pivotally coupled with the frame structure. In another form, an exercise device includes a frame structure, a first treadle assembly having a first endless belt in rotatable engagement with a first roller, a second treadle assembly having a second endless belt in rotatable engagement with a second roller, and a flywheel operably coupled with the first endless belt and the second endless belt.

24 Claims, 51 Drawing Sheets

U.S. PATENT DOCUMENTS 326,247 A 9/1885 Root
964,898 A 7/1910 Budingen
2,969,060 A 1/1961 Swanda et al.
3,511,500 A 5/1970 Dunn
3,770,267 A 11/1973 McCarthy
3,792,860 A 2/1974 Selnes
4,061,460 A * 12/1977 George ..... 425/459
4,204,673 A 5/1980 Speer, Sr.
4,533,136 A * 8/1985 Smith et al. ..... 482/64
4,563,001 A 1/1986 Terauds
4,592,544 A * 6/1986 Smith et al. ..... 482/64
4,659,077 A 4/1987 Stropkay
4,673,177 A * 6/1987 Szymski ..... 482/64
4,684,121 A 8/1987 Nestegard
4,733,858 A 3/1988 Lan
4,743,011 A * 5/1988 Coffey ..... 482/73
4,786,050 A 11/1988 Geschwender
4,813,667 A 3/1989 Watterson
4,830,362 A 5/1989 Bull
4,900,013 A 2/1990 Rodgers, Jr.
4,923,193 A 5/1990 Pitzen et al.
4,938,474 A * 7/1990 Sweeney et al. ..... 482/52
4,940,233 A 7/1990 Bull et al.
4,989,858 A 2/1991 Young et al.
5,039,088 A 8/1991 Shifferaw
5,054,770 A 10/1991 Bull
5,058,882 A 10/1991 Dalebout et al.
5,090,690 A 2/1992 Huang
5,092,581 A * 3/1992 Koz ..... 482/72
5,110,117 A 5/1992 Fisher et al.
5,129,872 A 7/1992 Dalton et al.
5,139,255 A 8/1992 Sollami
5,145,481 A 9/1992 Friedebach
5,188,577 A 2/1993 Young et al.
5,190,505 A 3/1993 Dalebout et al.
5,192,257 A 3/1993 Panasewiczw
5,199,932 A 4/1993 Liao
5,207,622 A 5/1993 Wilkinson et al.
5,226,866 A 7/1993 Engel et al.
5,263,910 A 11/1993 Yang
5,267,923 A 12/1993 Piaget et al.
D344,557 S 2/1994 Ashby
5,282,776 A 2/1994 Dalebout
5,290,211 A 3/1994 Stearns
5,299,993 A 4/1994 Habing
5,318,488 A * 6/1994 Babcock ..... 482/51
5,318,490 A 6/1994 Henderson et al.
5,336,146 A 8/1994 Piaget et al.
5,338,271 A 8/1994 Wang
5,338,273 A 8/1994 Metcalf et al.
5,344,371 A 9/1994 Wang
5,372,560 A 12/1994 Chang
5,401,226 A 3/1995 Stearns
5,423,729 A 6/1995 Eschenbach
5,431,612 A 7/1995 Holden
5,441,467 A 8/1995 Stevens
5,460,586 A 10/1995 Wilkinson et al.
5,492,517 A 2/1996 Bostic et al.
5,518,470 A 5/1996 Piaget et al.
5,529,555 A 6/1996 Rodgers, Jr.
5,595,556 A 1/1997 Dalebout et al.
5,626,539 A 5/1997 Piaget et al.
5,658,227 A 8/1997 Stearns
5,662,557 A 9/1997 Watterson et al.
5,665,033 A 9/1997 Palmer
5,669,856 A 9/1997 Liu
5,676,624 A 10/1997 Watterson et al.
5,683,333 A 11/1997 Rodgers, Jr.
5,709,632 A 1/1998 Socwell
5,733,227 A 3/1998 Lee
5,735,773 A 4/1998 Vittone et al.
5,769,760 A 6/1998 Lin et al.
5,779,598 A 7/1998 Lee
5,779,599 A 7/1998 Chen
5,788,610 A 8/1998 Eschenbach
5,792,029 A 8/1998 Gordon
5,803,871 A 9/1998 Stearns et al.
5,803,872 A 9/1998 Chang
5,803,874 A 9/1998 Wilkinson
5,833,584 A 11/1998 Piaget et al.
5,848,954 A 12/1998 Stearns et al.
5,857,941 A 1/1999 Maresh et al.
5,879,271 A 3/1999 Stearns et al.
5,899,833 A 5/1999 Ryan et al.
5,947,872 A 9/1999 Ryan et al.
5,951,449 A 9/1999 Oppriecht
5,967,944 A 10/1999 Vittone et al.
6,024,676 A 2/2000 Eschenbach
6,030,320 A * 2/2000 Stearns et al. ..... 482/57
6,152,859 A 11/2000 Stearns
6,340,340 B1 1/2002 Stearns et al.
6,461,279 B1 10/2002 Kuo
6,482,132 B2 11/2002 Eschenbach
6,629,909 B1 10/2003 Stearns et al.
6,648,800 B2 11/2003 Stearns et al.
6,648,802 B2 * 11/2003 Ware ..... 482/57
6,689,020 B2 2/2004 Stearns et al.
6,783,481 B2 8/2004 Stearns et al.
6,811,517 B1 11/2004 Eschenbach
6,811,519 B2 11/2004 Kuo
6,835,166 B1 12/2004 Stearns et al.
6,837,829 B2 1/2005 Eschenbach
6,849,034 B2 2/2005 Eschenbach
6,893,383 B1 5/2005 Chang et al.
6,923,745 B2 8/2005 Stearns
6,974,404 B1 12/2005 Watterson et al.
7,022,049 B2 4/2006 Ryan et al.
D527,060 S 8/2006 Flick et al.
7,097,593 B2 8/2006 Chang
D534,973 S 1/2007 Flick et al.
7,169,088 B2 1/2007 Rodgers, Jr.
7,169,089 B2 1/2007 Rodgers, Jr.
7,172,531 B2 2/2007 Roders, Jr.
7,179,201 B2 2/2007 Rodgers, Jr.
7,201,704 B2 4/2007 Stearns
7,201,705 B2 4/2007 Rodgers, Jr.
7,214,168 B2 5/2007 Rodgers et al.
7,244,217 B2 7/2007 Rodgers, Jr.
7,306,546 B2 12/2007 Lo
7,494,454 B2 * 2/2009 Sheets ..... 482/140
7,517,303 B2 4/2009 Crawford et al.
7,553,260 B2 6/2009 Piaget et al.
7,618,346 B2 11/2009 Crawford et al.
7,621,850 B2 11/2009 Piaget et al.
7,731,637 B2 * 6/2010 D'Eredita ..... 482/72
7,811,209 B2 * 10/2010 Crawford et al. ..... 482/54
7,862,484 B1 * 1/2011 Coffey ..... 482/72
2001/0016542 A1 8/2001 Yoshimura
2003/0096677 A1 5/2003 Chu
2004/0192514 A1 9/2004 Piaget et al.
2004/0214693 A1 10/2004 Piaget et al.
2004/0224825 A1 11/2004 Giannelli et al.
2005/0209060 A1 9/2005 Lull
2005/0233864 A1 10/2005 Smith et al.
2009/0264260 A1 10/2009 Piaget et al.
2010/0075812 A1 3/2010 Piaget et al.
2010/0248906 A1 * 9/2010 D'Eredita ..... 482/72

FOREIGN PATENT DOCUMENTS

WO WO 2004/108224 A1 12/2004
WO WO 2004/108225 A1 12/2004

* cited by examiner

UPPER BODY EXERCISE AND FLYWHEEL ENHANCED DUAL DECK TREADMILLS

CROSS-REFERENCE TO RELATED APPLICATIONS

The present application is a continuation application of U.S. application Ser. No. 12/404,534 , now U.S. Pat. No. 7,811,209 , entitled "Upper Body Exercise and Flywheel Enhanced Dual Deck Treadmills" filed on Mar. 16, 2009 , which is a divisional application of U.S. patent application Ser. No. 11/065,746 entitled "Upper Body Exercise and Flywheel Enhanced Dual Deck Treadmills" filed on Feb. 25, 2005 , now U.S. Pat. No. 7,517,303 , which claims the benefit under 35 U.S.C. §119(e) to U.S. Provisional Patent Application No. 60/548,787 entitled "Hydraulic Resistance, Arm Exercise and Non-Motorized Dual Deck Treadmills" filed on Feb. 26, 2004 , U.S. Provisional Patent Application No. 60/548,265 entitled "Exercise Device with Treadles (Commercial)" filed on Feb. 26, 2004 , U.S. Provisional Patent Application No. 60/548,786 entitled "Control System and Method for an Exercise Apparatus" filed on Feb. 26, 2004 , and U.S. Provisional Patent Application No. 60/548,811 entitled "Dual Treadmill Exercise Device having a Single Rear Roller" filed on Feb. 26, 2004 , all of which are hereby incorporated by reference herein.

U.S. patent application Ser. No. 11/065,746 , now U.S. Pat. No. 7,517,303 , is a continuation-in-part of and claims priority to: U.S. patent application Ser. No. 10/789,182 entitled "Dual Deck Exercise Device" filed on Feb. 26, 2004 , now U.S. Pat. No. 7,621,850 , which claims the benefit under 35 U.S.C. §119(e) to U.S. Provisional Patent Application No. 60/450,789 entitled "Dual Deck Exercise Device" filed on Feb. 28, 2003 , U.S. Provisional Application No. 60/450,890 entitled "System and Method For Controlling An Exercise Apparatus" filed on Feb. 28, 2003 , and U.S. Provisional Application No. 60/451,104 entitled "Exercise Device With Treadles" filed on Feb. 28, 2003; U.S. patent application Ser. No. 10/789,294 entitled "Exercise Device with Treadles" filed on Feb. 26, 2004 , now U.S. Pat. No. 7,553,260 , which claims the benefit under 35 U.S.C. §119(e) to U.S. Provisional Patent Application No. 60/450,789 entitled "Dual Deck Exercise Device" filed on Feb. 28, 2003 , and U.S. Provisional Application No. 60/451,104 entitled "Exercise Device with Treadles" filed on Feb. 28, 2003 , and U.S. Provisional Application No. 60/450,890 entitled "System and Method For Controlling An Exercise Apparatus" filed on Feb. 28, 2003; and U.S. patent application Ser. No. 10/789,579 entitled "System and Method for Controlling an Exercise Apparatus" filed on Feb. 26, 2004 , now U.S. Pat. No. 7,618,346 , which claims the benefit under 35 U.S.C. §119(e) to U.S. Provisional Patent Application No. 60/450,789 entitled "Dual Deck Exercise Device" filed on Feb. 28, 2003 , U.S. Provisional Application No. 60/451,104 entitled "Exercise Device with Treadles" filed on Feb. 28, 2003 , and U.S. Provisional Application No. 60/450,890 entitled "System and Method For Controlling an Exercise Apparatus" filed on Feb. 28, 2003 , which are all hereby incorporated by reference herein.

INCORPORATION BY REFERENCE

The present application incorporates by reference in its entirety, as if fully described herein, the subject matter disclosed in the following U.S. applications:

U.S. Provisional Patent Application No. 60/451,104 entitled "Exercise Device with Treadles" filed on Feb. 28, 2003;

U.S. Provisional Patent Application No. 60/450,789 entitled "Dual Deck Exercise Device" filed on Feb. 28, 2003;

U.S. Provisional Patent Application No. 60/450,890 entitled "System and Method for Controlling an Exercise Apparatus" filed on Feb. 28, 2003; and U.S. Design Application No. 29/176,966 entitled "Exercise Device with Treadles" filed on Feb. 28, 2003 , now U.S. Pat. No. D534,973.

The present application is related to and incorporated by reference in its entirety, as if fully described herein, the subject matter disclosed in the following U.S. applications, filed on the same day as this application:

U.S. patent application Ser. No. 11/065,891 entitled "Exercise Device With Treadles" and filed on Feb. 25, 2005 , now U.S. Pat. No. 7,645,214;

U.S. patent application Ser. No. 11/067,538 entitled "Control System and Method for an Exercise Apparatus" and filed on Feb. 25, 2005;

U.S. patent application Ser. No. 11/065,770 entitled "Dual Treadmill Exercise Device Having a Single Rear Roller" and filed on Feb. 25, 2005 , now U.S. Pat. No. 7,704,191.

FIELD OF THE INVENTION

The present invention generally involves the field of exercise devices, and more particularly involves an exercise device including interconnected treadles with moving surfaces provided thereon, and arm exercise and non-motorized embodiments thereof.

BACKGROUND

The health benefits of regular exercise are well known. Many different types of exercise equipment have been developed over time, with various success, to facilitate exercise. Examples of successful classes of exercise equipment include the treadmill and the stair climbing machine. A conventional treadmill typically includes a continuous belt providing a moving surface that a user may walk, jog, or run on. A conventional stair climbing machine typically includes a pair of links adapted to pivot up and down providing a pair of surfaces or pedals that a user may stand on and press up and down to simulate walking up a flight of stairs.

Various embodiments and aspects of the present invention involve an exercise machine that provides side-by-side moving surfaces that are pivotally supported at one end and adapted to pivot up and down at an opposite end. With a device conforming to the present invention, two pivotal moving surfaces are provided in a manner that provides some or all of the exercise benefits of using a treadmill with some or all of the exercise benefits of using a stair climbing machine. An exercise machine conforming to aspects of the present invention provides additional health benefits that are not recognized by a treadmill or a stair climbing machine alone.

SUMMARY OF THE INVENTION

In one aspect of the present invention, an exercise device includes a frame structure; a first treadle assembly supporting a first moving surface, a second treadle assembly supporting a second moving surface, and an upper body exercise assembly operably associated with the exercise device. The first treadle assembly is pivotally coupled with the frame structure, and the second treadle assembly is pivotally coupled with the frame structure.

In another form, an exercise device includes a frame structure, a first treadle assembly having a first endless belt in rotatable engagement with a first roller, a second treadle assembly having a second endless belt in rotatable engagement with a second roller, and a flywheel operably coupled with the first endless belt and the second endless belt.

The features, utilities, and advantages of various embodiments of the invention will be apparent from the following more particular description of embodiments of the invention as illustrated in the accompanying drawings and defined in the appended claims.

BRIEF DESCRIPTION OF THE DRAWINGS

The detailed description will refer to the following drawings, wherein like numerals refer to like elements, and wherein.

DETAILED DESCRIPTION

Figure 1:
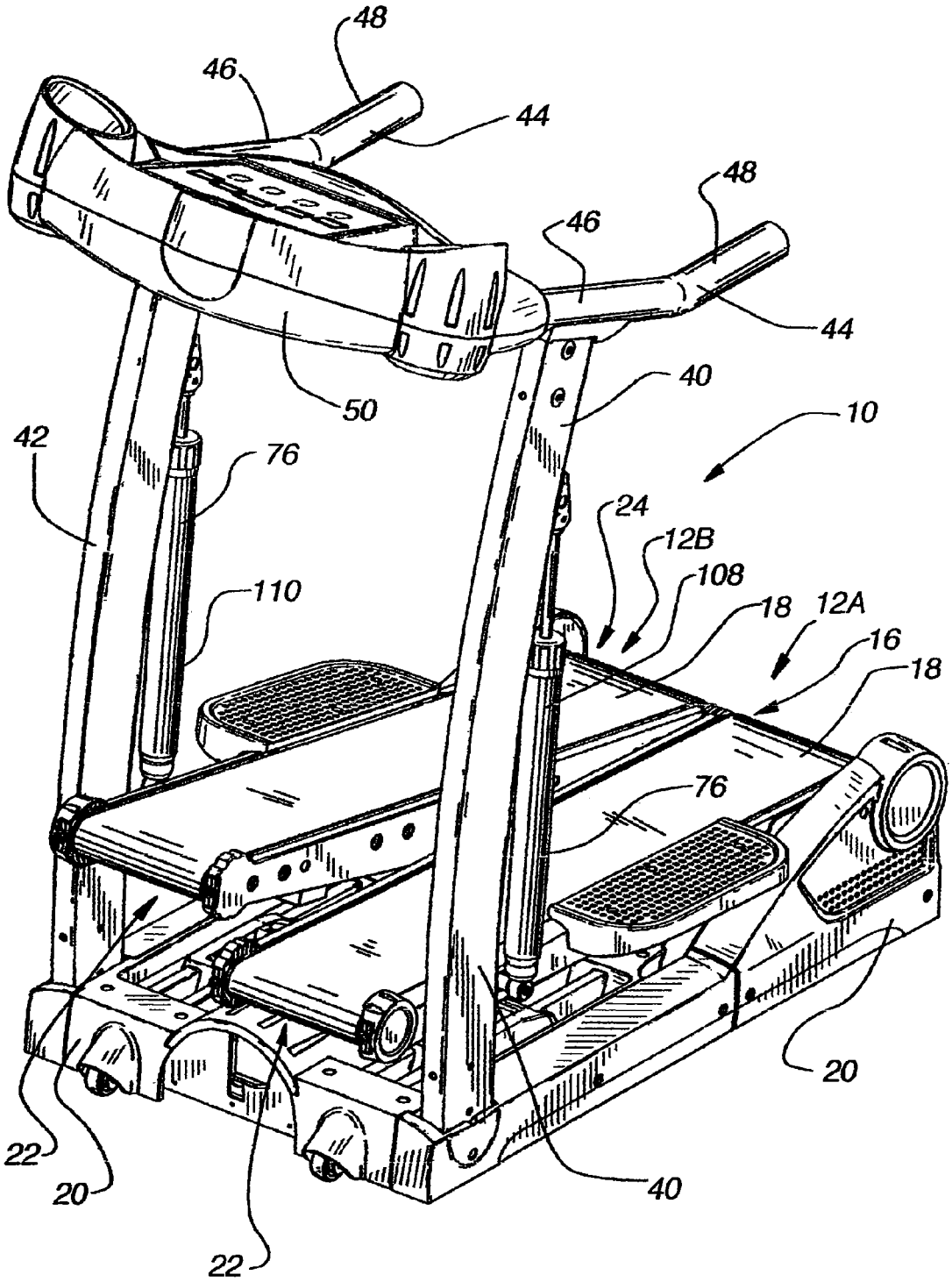
FIG. 1 is an isometric view of one embodiment of an exercise device, in accordance with aspects of the present invention.

An exercise device 10 conforming to the present invention may be configured to provide a user with a walking-type exercise, a stepping-type exercise or a climbing-like exercise that is a combination of both walking and stepping. The exercise device generally includes two treadmill-like assemblies 12 (referred to herein as a "treadle" or a "treadle assembly") pivotally connected with a frame 14 so that the treadles may pivot up and down about an axis 16. The axis may be a physical axis (axle) or may be a virtual axis defined by assemblies of components that pivotally support each treadle. In one implementation, each treadle includes a tread belt 18 that provides a moving surface like a treadmill. The tread belt is supported, in one example, by a front roller and a rear roller. The rear roller may be common to both treadles or each treadle may include a distinct rear roller. Further, the rear roller(s) may be supported on the frame or treadle, and may share an axis of rotation with the treadles or may have a unique axis of rotation forward, rearward, above an/or below the pivot axis of the treadles.

In use, a user will walk, jog, or run on the treadles and the treadles will reciprocate about the treadle pivot axis. The treadles are interconnected so that upward movement of one treadle is accompanied by downward movement of the other treadle. The combination of the moving surface of the tread belts and the coordinated and interconnected reciprocation of the treadles provides an exercise that is similar to climbing on a loose surface, such as walking, jogging, or running up a sand dune where each upward and forward foot movement is accompanied by the foot slipping backward and downward. Extraordinary cardiovascular and other health benefits are achieved by such a climbing-like exercise. Moreover, as will be recognized from the following discussion, the extraordinary health benefits are achieved in a low impact manner.

The following discussion of FIGS. 1-23 provides a general structural framework for various other embodiments discussed with reference to FIGS. 24-47. Further detail concerning other structural frameworks for the various embodiments discussed herein are provided in the various related applications incorporated by reference herein. Aspects of the present invention involve various structures that may be employed to provide an upper body exercise component to the embodiments discussed with reference to FIGS. 1-23 as well as the various embodiments incorporated by reference herein. Aspects of the present invention also involve various structures that may be employed to replace or accompany the motor or motors used to drive the tread belts. Finally, aspects of the present invention involve various combinations of the upper body exercise structures, non-motorized structures, and resistance structures, as well as the numerous combinations of possible embodiments described in the related applications incorporated by reference herein.

Figure 2:
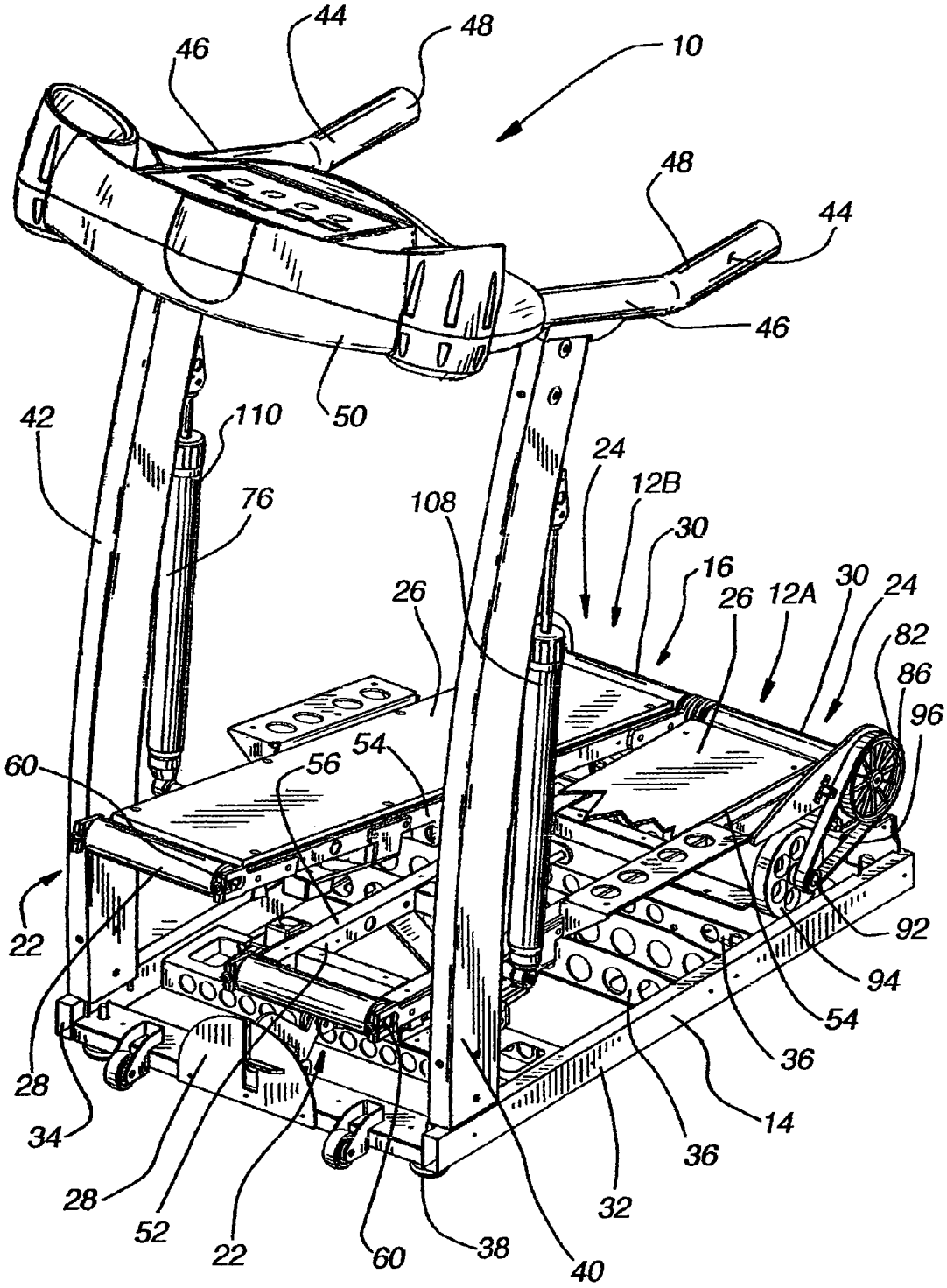
FIG. 2 is an isometric view of the exercise device shown in FIG. 1 with decorative and protective side panels removed to better illustrate various components of the exercise device.

FIG. 1 is an isometric view of one example of an exercise device conforming to aspects of the present invention. The embodiment of the exercise device illustrated in FIG. 1 includes protective and decorative panels 20, which in some instances obscure the view of some components of the exercise device. FIG. 2 is an isometric view the exercise device illustrated in FIG. 1 with the protective and decorative panels removed to better illustrate all of the components of the device. Views of the exercise device shown in FIGS. 3-8, and others, in most instances, do not include the protective and decorative panels.

Referring to FIGS. 1, 2 and others, the exercise device includes a first treadle assembly 12A and a second treadle assembly 12B, each having a front portion 22 and a rear portion 24. The rear portions of the treadle assemblies 12 are pivotally supported at the rear of the exercise device 10. The front portions 22 of the treadle assemblies are supported above the frame 14, and are configured to reciprocate in a generally up and down manner during use. It is also possible to pivotally support the treadles at the front of the exercise device, and support the rear of the treadle assemblies above the frame. The treadle assemblies also each support an endless belt or "tread belt" that rotates over a deck 26 and about front 28 and rear 30 rollers to provide either a forward or rearward moving surface.

A user may perform exercise on the device facing toward the front of the treadle assemblies (referred to herein as "forward facing use") or may perform exercise on the device facing toward the rear of the treadle assemblies (referred to herein as "rearward facing use"). The term "front," "rear," and "right" are used herein with the perspective of a user standing on the device in the forward facing manner the device will be typically used. During any method of use, the user may walk, jog, run, and/or step on the exercise device in a manner where each of the user's feet contact one of the treadle assemblies. For example, in forward facing use, the user's left foot will typically only contact the left treadle assembly 12A and the user's right foot will typically only contact the right treadle assembly 12B. Alternatively, in rearward facing use, the user's left foot will typically only contact the right treadle assembly 12B and the user's right foot will typically only contact the left treadle assembly 12A.

An exercise device conforming to aspects of the invention may be configured to only provide a striding motion or to only provide a stepping motion. For a striding motion, the treadle assemblies are configured to not reciprocate and the endless belts 18 configured to rotate. The term "striding motion" is meant to refer to any typical human striding motion such as walking, jogging and running. For a stepping motion, the treadle assemblies are configured to reciprocate and the endless belts are configured to not rotate about the rollers. The term "stepping motion" is meant to refer to any typical stepping motion, such as when a human walks up stairs, uses a conventional stepper exercise device, walks up a hill, etc.

As mentioned above, the rear 24 of each treadle assembly is pivotally supported at the rear of the exercise device. The front of each treadle assembly is supported above the front portion of the exercise device so that the treadle assemblies may pivot upward and downward. When the user steps on a tread belt 18, the associated treadle assembly 12A, 12B (including the belts) will pivot downwardly. As will be described in greater detail below, the treadle assemblies 12 are interconnected such that downward or upward movement of one treadle assembly will cause a respective upward or downward movement of the other treadle assembly. Thus, when the user steps on one belt 18, the associated treadle assembly will pivot downwardly while the other treadle assembly will pivot upwardly. With the treadle assemblies configured to move up and down and the tread belts configured to provide a moving striding surface, the user may achieve an exercise movement that encompasses a combination of walking and stepping.

FIG. 2 is a partial cutaway isometric view of the embodiment of the exercise device 10 shown in FIG. 1. With regard to the left and right treadle assemblies, the tread belt is removed to show the underlying belt platform or "deck" 26 and the front roller 28 and the rear roller 30. In addition, the belt platform of the left treadle is partially cut away to show the underlying treadle frame components. Referring to FIG. 2 and others, the exercise device includes the underlying main frame 14. The frame provides the general structural support for the moving components and other components of the exercise device. The frame includes a left side member 32, a right side member 34 and a plurality of cross members 36 interconnecting the left side and right side members to provide a unitary base structure. The frame may be set directly on the floor or a may be supported on adjustable legs, cushions, bumpers, or combinations thereof. In the implementation of FIG. 2, adjustable legs 38 are provided at the bottom front left and front right corners of the frame.

Figure 5:
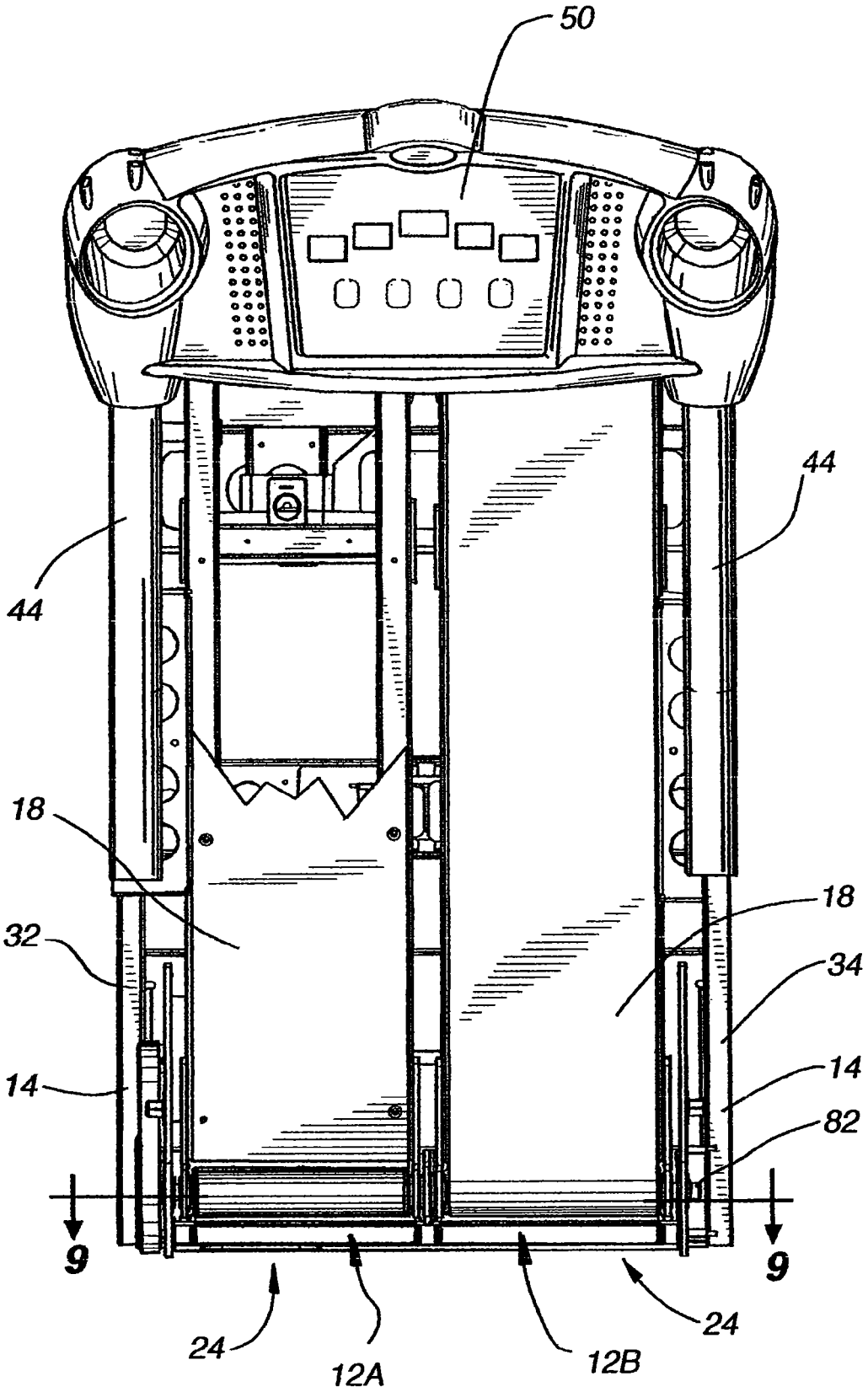
FIG. 5 is top view of the exercise device shown in FIG. 2.
Figure 7:
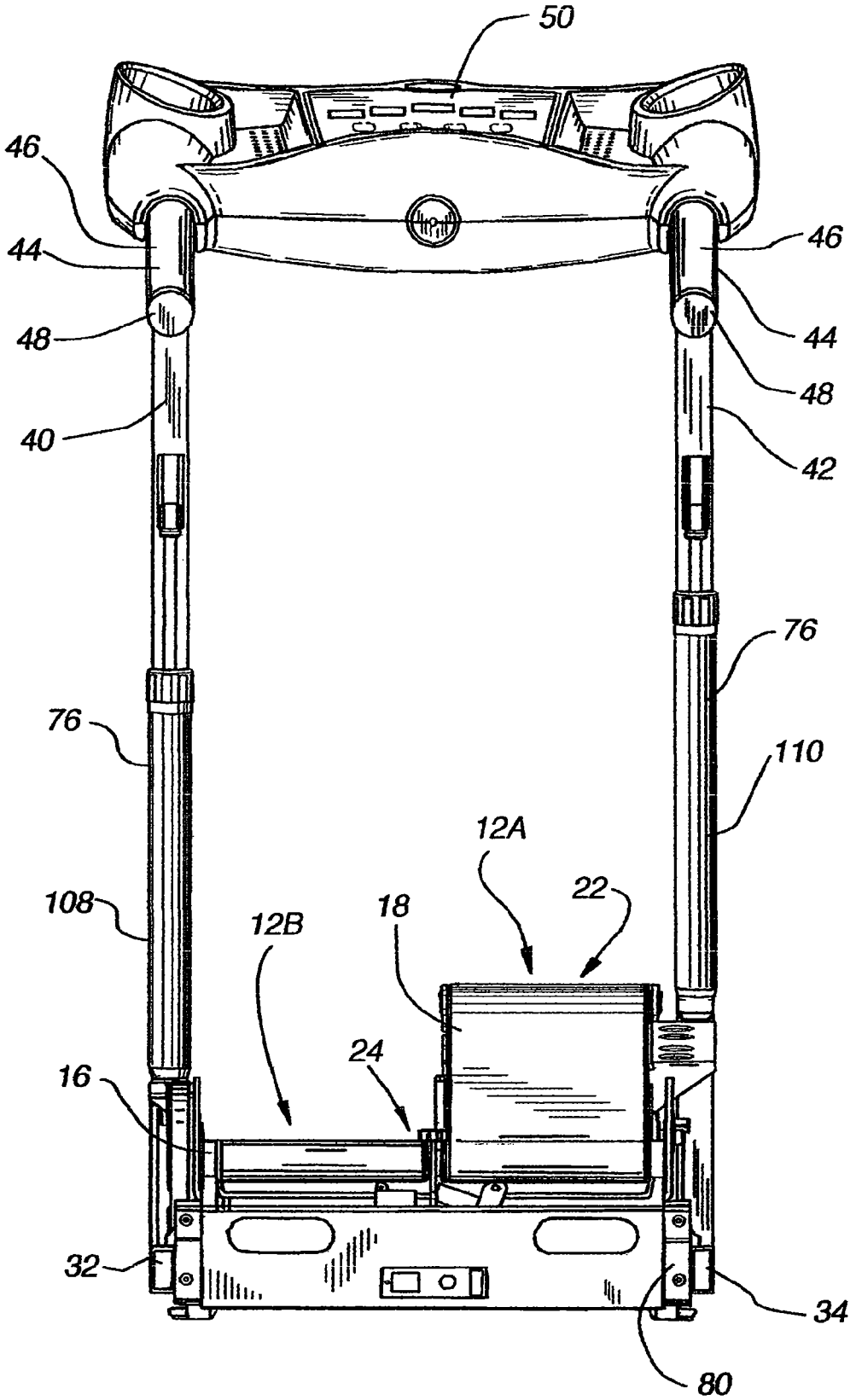
FIG. 7 is a rear view of the exercise device shown in FIG. 2.
Figure 8:
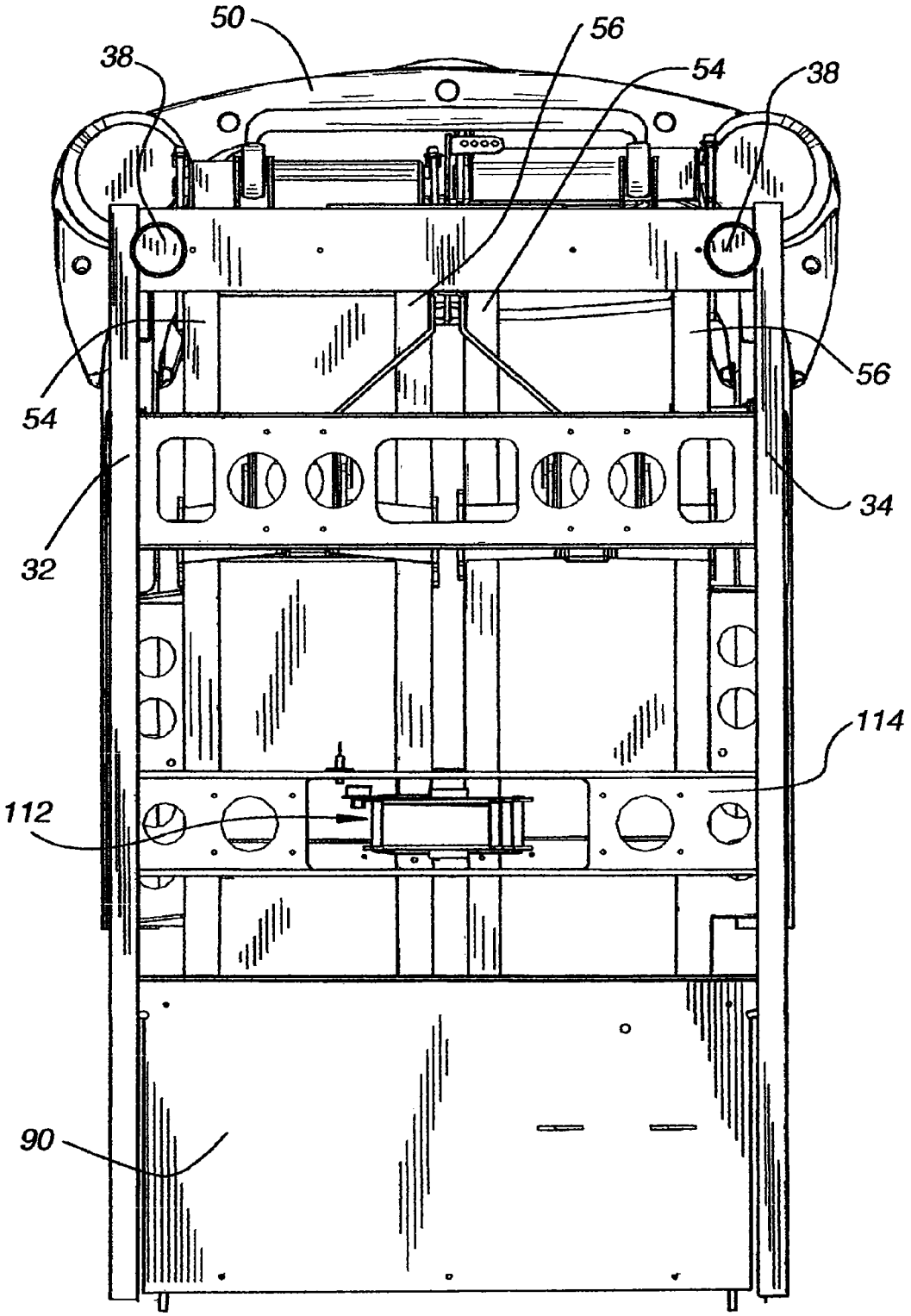
FIG. 8 is a bottom view of the exercise device shown in FIG. 2.

A left upright 40 is connected with the forward end region of the left side member 32. A right upright 42 is connected with the forward end region of the right side member 34. The uprights extend generally upwardly from the frame, with a slight rearward sweep. Handles 44 extend transversely to the top of each upright in a generally T-shaped orientation with the upright. The top of the T is the handle and the downwardly extending portion of the T is the upright. The handles are arranged generally in the same plane as the respective underlying side members 32, 34. The handles define a first section 46 connected with the uprights, and a second rearwardly section 48 extending angularly oriented with respect to the first section. The handle is adapted for the user to grasp during use of the exercise device. A console 50 is supported between the first sections of the handles. The console includes one or more cup holders, an exercise display, and one or more depressions adapted to hold keys, a cell phone, or other personal items. The console is best shown in FIGS. 5 and 7.

Figure 3A:
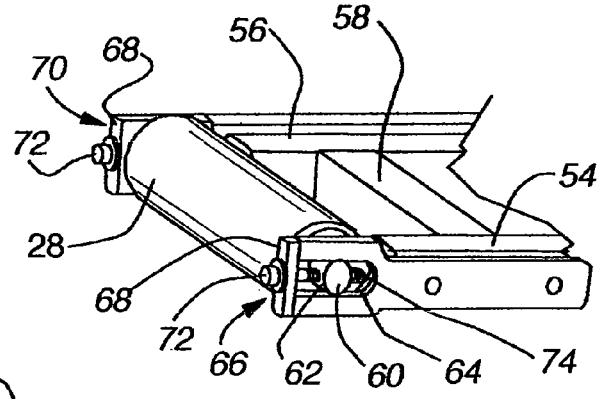
FIG. 3A is a partial isometric view of the front area of a treadle assembly.
Figure 3:
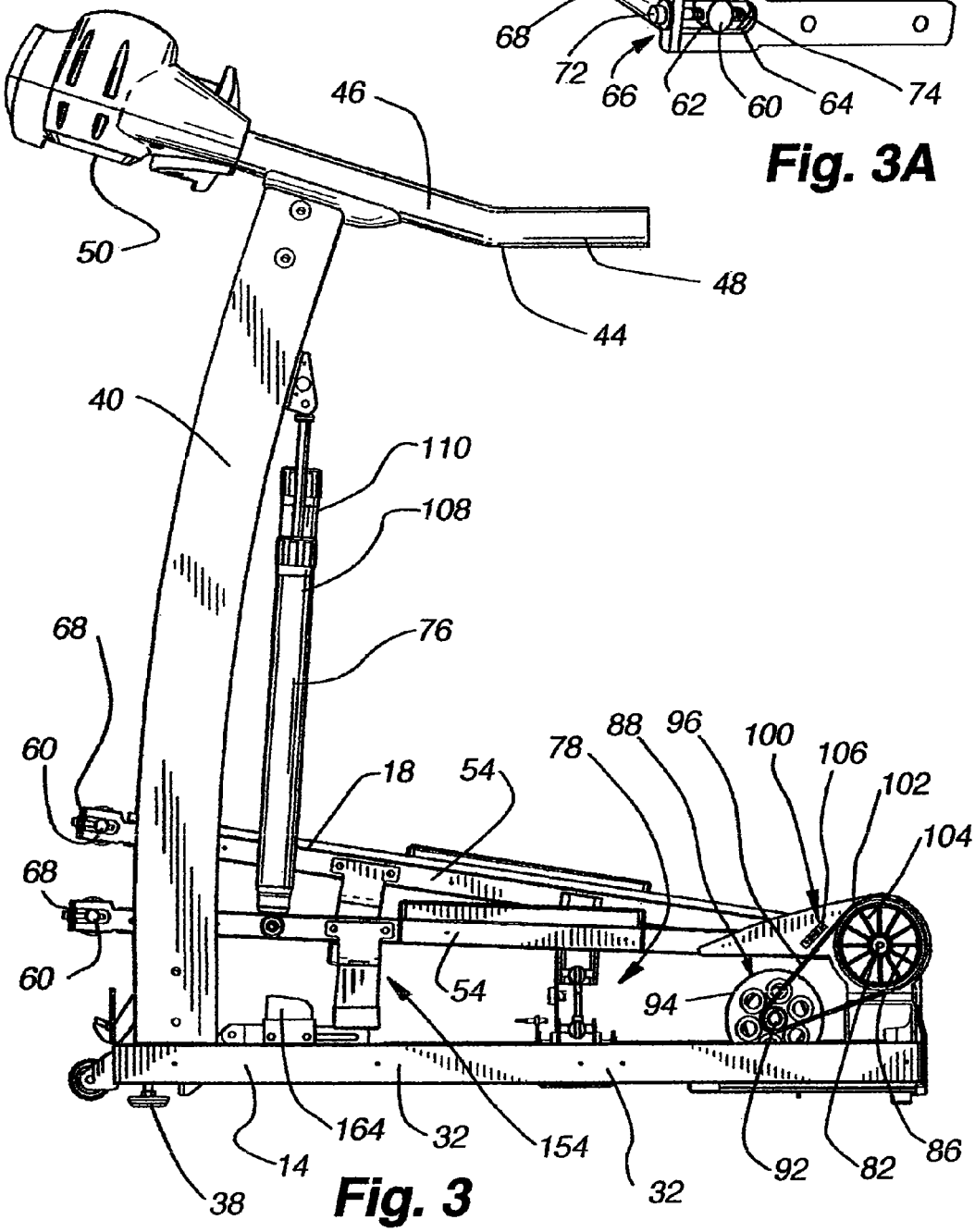
FIG. 3 is a left side view of the exercise device shown in FIG. 2.
Figure 4:
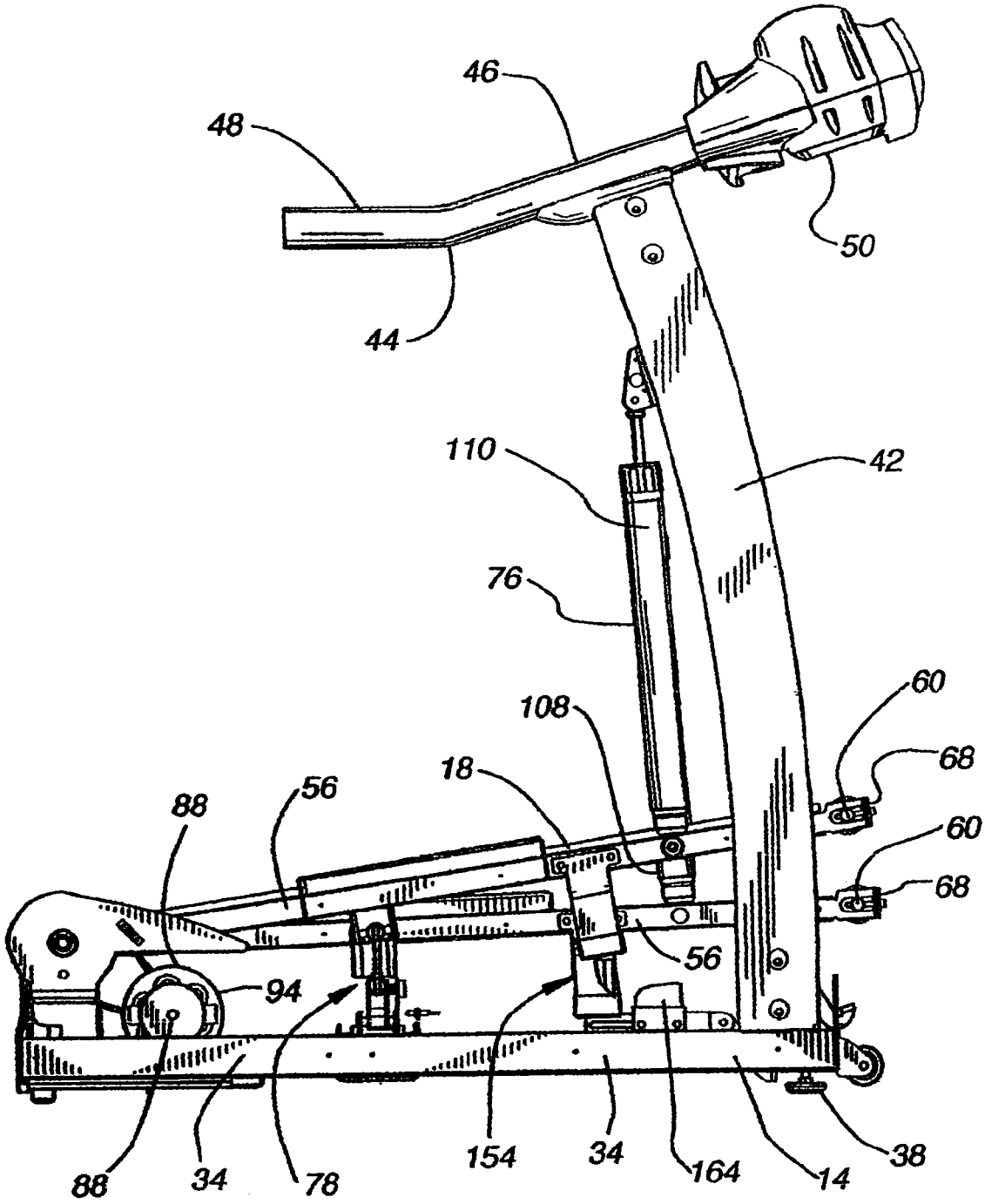
FIG. 4 is a right side view of the exercise device shown in FIG. 2.
Figure 6:
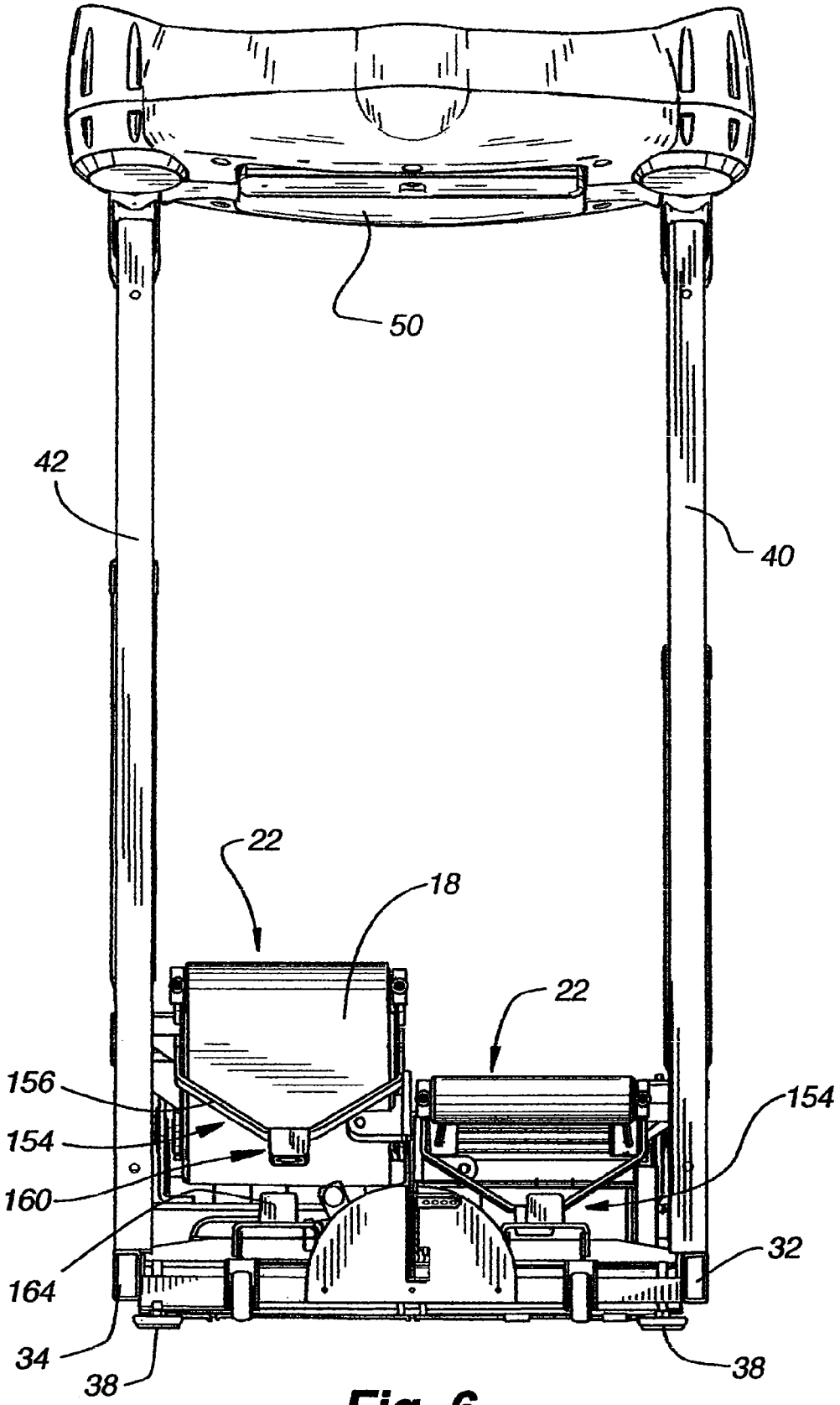
FIG. 6 is a front view of the exercise device shown in FIG. 2.
Figure 9:
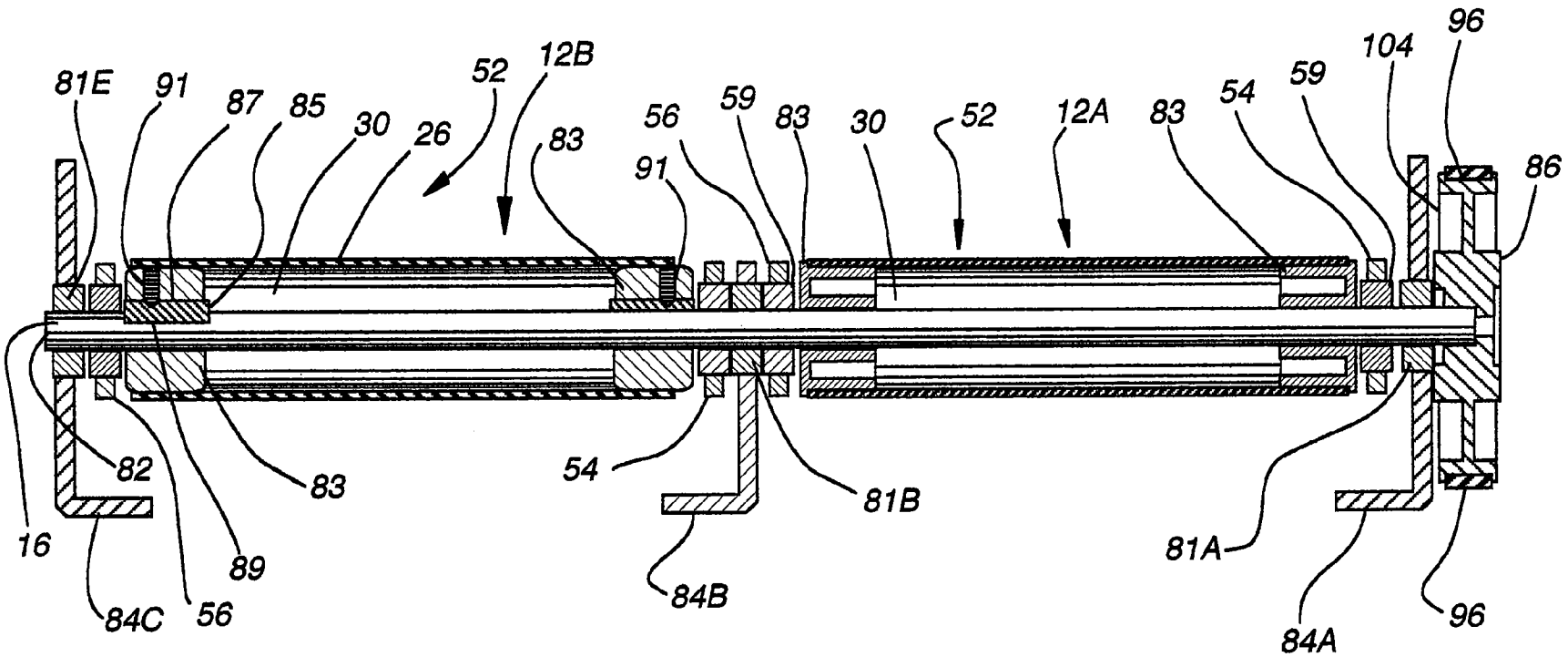
FIG. 9 is a section view taken along line 9-9 of FIG. 5.

FIG. 3 is a left side view and FIG. 4 is right side view of the exercise device 10 shown in FIG. 2. FIG. 5 is a top view and FIG. 6 is a front view of the embodiment of the exercise device shown in FIG. 2. FIG. 9 is a section view taken along line 9-9 of FIG. 5. Referring to FIGS. 2-6 and 9, and others, each treadle assembly includes a treadle frame 52 having a left member 54, a right member 56, and a plurality of treadle cross members 58 extending between the left and right members. As best shown in FIG. 9, the outside longitudinal members 54, 56 of each treadle are pivotally coupled to the rear axis (axle) 16 by radial ball bearings 59.

The front rollers 28 are rotatably supported at the front of each treadle frame and the rear rollers 30 are pivotally supported at the rear of each treadle frame. To adjust the tread belt tension and tracking, the front or rear rollers may be adjustably connected with the treadle frame. In one particular implementation as best shown in FIGS. 3, 3A, and 4, each front roller is adjustably connected with the front of each respective treadle frame. The front roller includes an axle 60 extending outwardly from both ends of the roller. The outwardly extending ends of the axle each define a threaded aperture, 62 and are supported in a channel 64 defined in the forward end of the left 54 and right 56 treadle frame side members. The channel defines a forwardly opening end 66. A plate 68 defining a threaded aperture is secured to the front end of the left and right members so that the centerline of the aperture 70 is in alignment with the forward opening end 66 of the channel 64. A bolt is threaded into the threaded aperture and in engagement with the corresponding threaded aperture in the end of the roller axle 60 supported in the channel. Alternatively, a spring is located between the closed rear portion of the channel and the pivot axle to bias the pivot axle forwardly. By adjusting one or both of the bolts at the ends of the axle, the corresponding end of the axle may be moved forwardly or rearwardly in the channel to adjust the position of the front roller. Adjustment of the front roller can loosen or tighten the tread belt or change the tread belt travel.

The belt decks 26 are located on the top of each treadle frame 52. The deck may be bolted to the treadle frame, may be secured to the frame in combination with a deck cushioning or deck suspension system, or may be loosely mounted on the treadle frame. Each belt deck is located between the respective front 28 and rear 30 rollers of each treadle assembly 12A, 12B. The belt decks are dimensioned to provide a landing platform for most or all of the upper run of the tread belts 18.

The rear of each treadle assembly is pivotally supported at the rear of the frame, and the front of each treadle assembly is supported above the frame by one or more dampening elements 76, an interconnection member 78, or a combination thereof, so that each treadle assembly 12 may pivot up and down with respect to the lower frame. FIG. 7 is a rear view of the embodiment of the exercise device shown in FIG. 2. FIG. 9 is a section view of the rear roller assembly taken along line 9-9 of FIG. 5. Referring to FIGS. 5, 7, 9 and others, each treadle assembly is pivotally supported above a rear cross member 80 of the main frame 14. In one particular implementation, a drive shaft 82 is rotatably supported above the rear cross member by a left 84A, middle 84B, and right 84C drive bracket. Corresponding radial bearings 81A, 81B and 81C rotatably support the axle in the brackets. The drive shaft rotatably supports each rear roller. Thus, the left and right rear rollers are rotatably supported about a common drive axis 82, which is also the common rear pivot axis 16 of the treadles 12, in one example.

Each roller 30 is supported on the axle 82 by a pair of collars 83. The collars are secured to the axle by a key 85 that fits in a channel 87, 89 in the collar and in the axle. The collar is further secured to the axle by a set screw 91 supported in the collar. The set screw is tightened against the key.

A pulley 86 is secured to a portion of the drive shaft 82. As shown in FIGS. 2, 3, 9 and others, in one particular implementation, the drive pulley 86 is secured to the left end region of the drive shaft. However, the drive pulley may be secured to the right end region, or somewhere along the length of the drive shaft between the left and right end regions. A motor 88 is secured to a bottom plate 90 (best shown in the bottom view of FIG. 8) that extends between the right 56 and left 54 side members. A motor shaft 92 extends outwardly from the left side of the motor. The motor is mounted so that the motor shaft is generally parallel to the drive shaft 82. A flywheel 94 is secured to the outwardly extending end region of the motor shaft. A drive belt 96 is connected between the drive shaft pulley and a motor pulley 98 connected with the motor shaft. Accordingly, the motor is arranged to cause rotation of the drive shaft and both rear rollers 30.

A belt speed sensor 100 is operably associated with the tread belt 18 to monitor the speed of the tread belt. In one particular implementation the belt speed sensor is implemented with a reed switch 102 including a magnet 104 and a pick-up 106. The reed switch is operably associated with the drive pulley to produce a belt speed signal. The magnet is imbedded in or connected with the drive pulley 86, and the pick-up is connected with the main frame 14 in an orientation to produce an output pulse each time the magnet rotates past the pick-up.

Both the left and right rear rollers 30 are secured to the drive shaft 82. Thus, rotation of the drive shaft causes the left and right rear rollers and also the associated endless belts 18 to rotate at, or nearly at, the same pace. It is also possible to provide independent drive shafts for each roller that would be powered by separate motors, with a common motor control. In such an instance, motor speed would be coordinated by the controller to cause the tread belts to rotate at or nearly at the same pace. The motor or motors may be configured or commanded through user control to drive the endless belts in a forward direction (i.e., from the left side perspective, counterclockwise about the front and rear rollers) or configured to drive the endless belts in a rearward direction (i.e., from the left side perspective, clockwise about the front and rear rollers).

During use, the tread belt 18 slides over the deck 26 with a particular kinetic friction dependant on various factors including the material of the belt and deck and the downward force on the belt. In some instances, the belt may slightly bind on the deck when the user steps on the belt and increases the kinetic friction between the belt and deck. Besides the force imparted by the motor 88 to rotate the belts, the flywheel 94 secured to the motor shaft has an angular momentum force component that helps to overcome the increased kinetic friction and help provide uniform tread belt movement. In one particular implementation, the deck is a ⅜" thick medium density fiber based (or "MDF") with an electron beam low friction cured paint coating. Further, the belt is a polyester weave base with a PVC top. The belt may further incorporate a low friction material, such as low friction silicone.

Certain embodiments of the present invention may include a resistance element 76 operably connected with the treadles. As used herein the term "resistance element" is meant to include any type of device, structure, member, assembly, and configuration that resists the vertical movement, such as the pivotal movement of the treadles. The resistance provided by the resistance element may be constant, variable, and/or adjustable. Moreover, the resistance may be a function of load, of time, of heat, or of other factors. Such a resistance element may provide other functions, such as dampening the downward, upward, or both movement of the treadles. The resistance element may also impart a return force on the treadles such that if the treadle is in a lower position, the resistance element will impart a return force to move the treadle upward, or if the treadle is in an upper position, the resistance element will impart a return force to move the treadle downward. The term "shock" or "dampening element" is sometimes used herein to refer to a resistance element, or to a spring (return force) element, or a dampening element that may or may not include a spring (return) force.

In one particular configuration of the exercise device, a resistance element 76 extends between each treadle assembly 12 and the frame 14 to support the front of the treadle assemblies and to resist the downward movement of each treadle. The resistance element or elements may be arranged at various locations between treadle frame and the main frame. In the embodiments shown in FIGS. 1-7, and others, the resistance elements include a first 108 and a second 110 shock. The shock both resists and dampens the movement of the treadles. More particularly, the first or left shock 108 extends between the left or outer frame member 54 of the left treadle assembly and the left upright frame member 40. The second shock 110 extends between the right or outer frame member 56 of the right treadle assembly and the right upright frame member 42. In an alternative embodiment, the shocks extend between the outer frame members of each treadle assembly and a portion of the frame below the treadle assembly. In another alternative, the shocks may be connected to the front of the treadles between the inner and outer treadle frame members.

In one particular implementation, the shock (108, 110) is a fluid-type or air-type dampening device and is not combined internally or externally with a return spring. As such, when a user's foot lands on the front of a treadle, the shock dampens and resists the downward force of the footfall to provide cushioning for the user's foot, leg and various leg joints such as the ankle and knee. In some configurations, the resistance device may also be adjusted to decrease or increase the downward stroke length of a treadle. The shock may be provided with a user adjustable dampening collar, which when rotated causes the dampening force of the shock to either increase or decrease to fit any particular user's needs. One particular shock that may be used in an exercise device conforming to the present invention is shown and described in U.S. Pat. No. 5,762,587 titled "Exercise Machine With Adjustable-Resistance, Hydraulic Cylinder," the disclosure of which is hereby incorporated by reference in its entirety.

Generally, the shock includes a cylinder filled with hydraulic fluid. A piston rod extends outwardly from the cylinder. Within the cylinder, a piston is connected with the piston rod. The piston defines at least one orifice through which hydraulic fluid may flow, and also includes a check valve. The piston subdivides the cylinder into two fluid filled chambers. During actuation of the shock, the piston either moves up or down in the cylinder. In downward movement or extension of the shock, the fluid flows through the orifice at a rate governed partially by the number of orifices and the size of the orifices. In upward movement or compression of the shock, the fluid flows through the check valve. The collar is operably connected with a plate associated with the orifice or orifices. Rotation of the collar, will expose or cover orifices for fluid flow and thus reduce or increase the dampening force of the shock. Alternatively, the dampening resistance collar is connected with a tapered plunger directed into an orifice between the hydraulic chambers of the shock. The depth of the plunger will govern, in part, the resistance of the shock. Preferably, the return spring shown in FIG. 4 of the '587 patent is removed.

Another particular shock that may be used in an exercise device conforming to the present invention is shown and described in U.S. Pat. No. 5,622,527 titled "Independent action stepper" and issued on Apr. 22, 1997 , the disclosure of which is hereby incorporated by reference in its entirety. The shock may be used with the spring 252 shown in FIG. 10 of the '527 patent. The spring provides a return force that moves or returns the treadles upward after they are pressed downward. Preferably, however, the spring 252 is removed. As such, in one implementation of the present invention, the shock only provides a resistance and does not provide a return force. In an embodiment that does not employ a spring, the shock may be arranged to provide a resistance in the range of 47 KgF to 103 KgF. Alternative resistance elements are discussed in more detail below.

Figure 10:
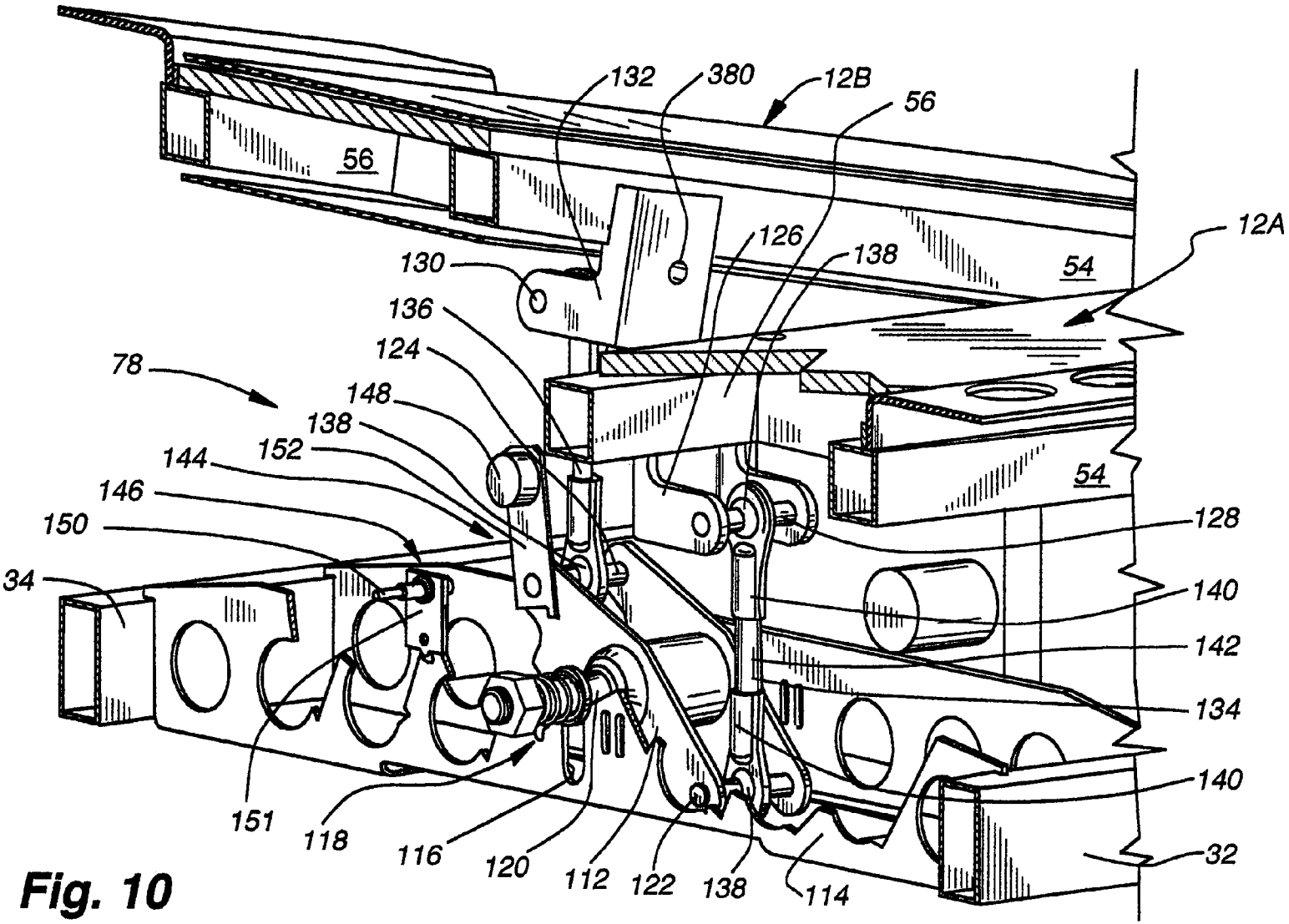
FIG. 10 is a partial cut away isometric view of the exercise device shown in FIG. 2, the view illustrating the rocker arm orientated in a position corresponding with the left treadle in about the lowest position and the right treadle in about the highest position.
Figure 11:
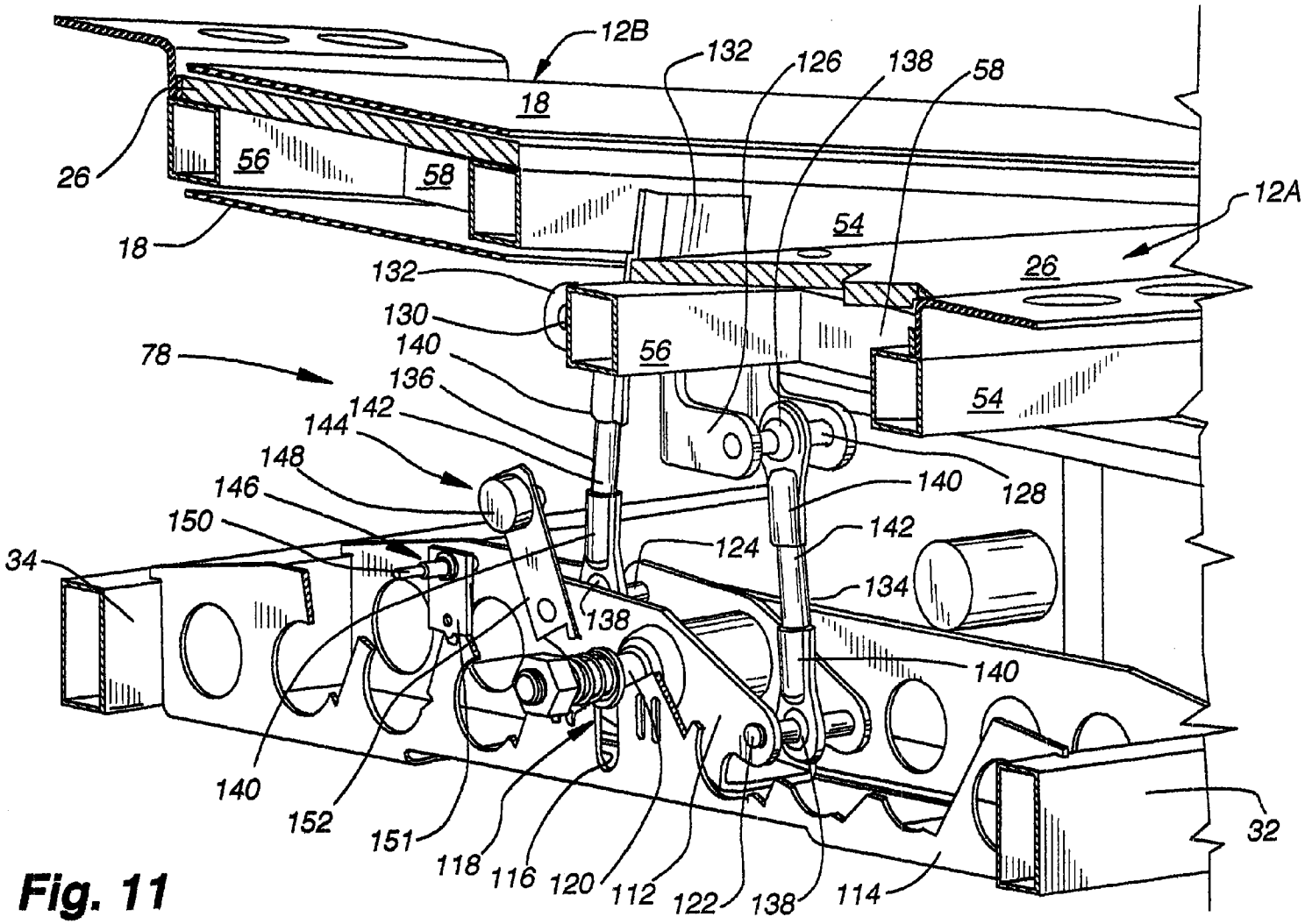
FIG. 11 is a partial cut away isometric view of the exercise device shown in FIG. 2, the view illustrating the rocker arm orientated in a position corresponding with the left treadle in a position higher than in FIG. 10 and the right treadle in a position lower than in FIG. 10.
Figure 12:
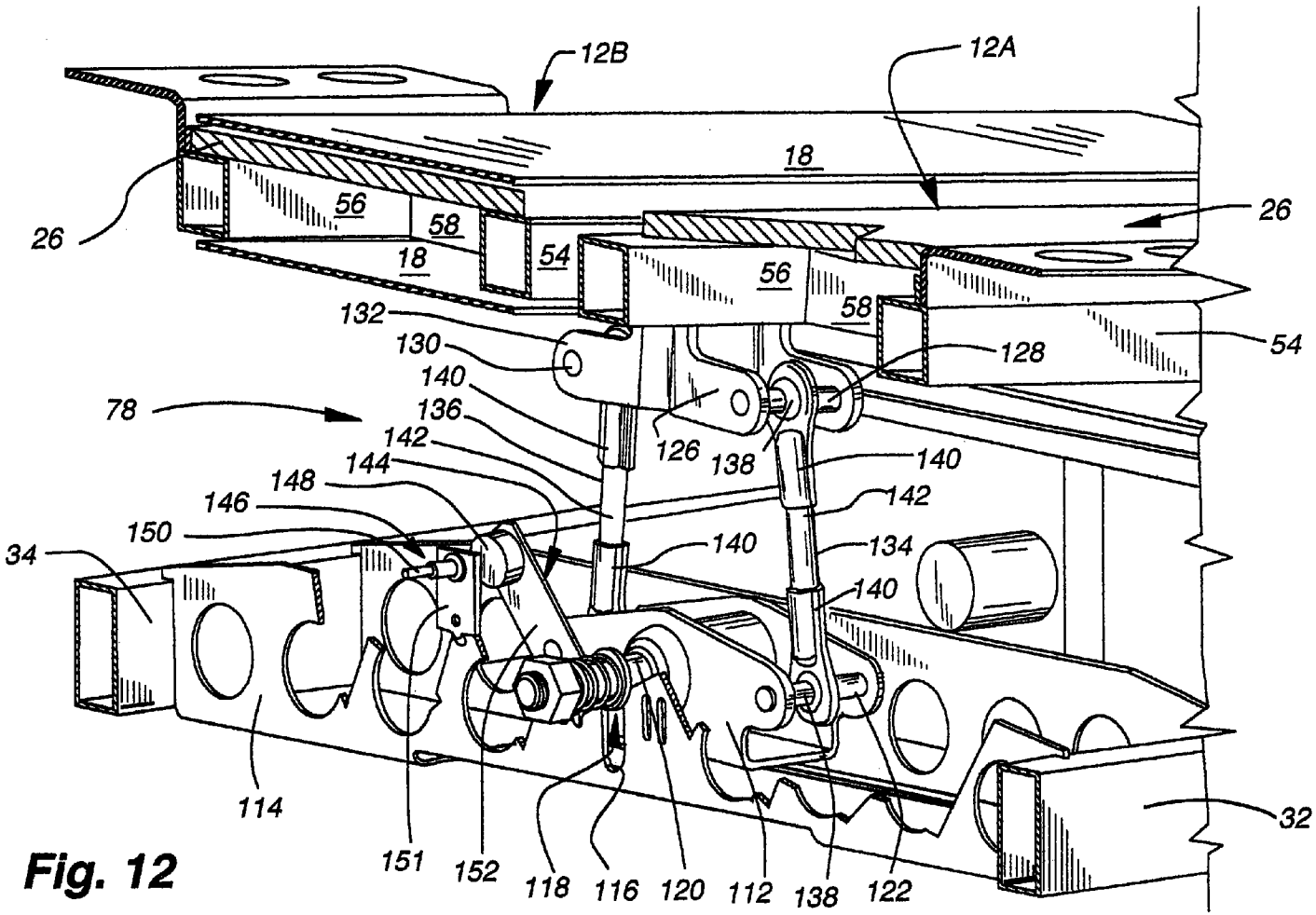
FIG. 12 is a partial cut away isometric view of the exercise device shown in FIG. 2, the view illustrating the rocker arm orientated in a position corresponding with the left treadle about parallel with the right treadle.
Figure 13:
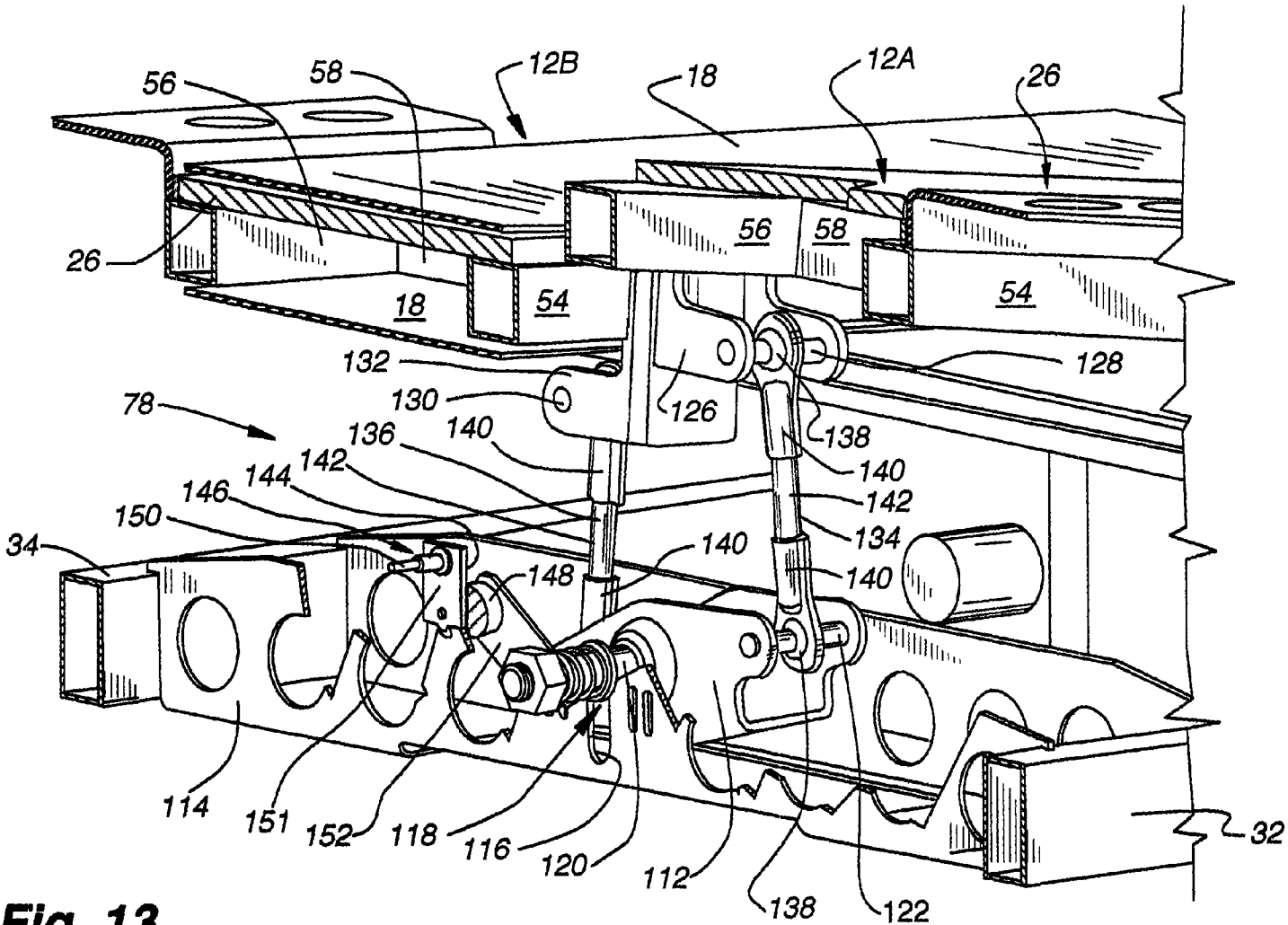
FIG. 13 is a partial cut away isometric view of the exercise device shown in FIG. 2, the view illustrating the rocker arm orientated in a position corresponding with the left treadle in a position higher than in FIG. 12 and the right treadle in a position lower than in FIG. 12.
Figure 14:
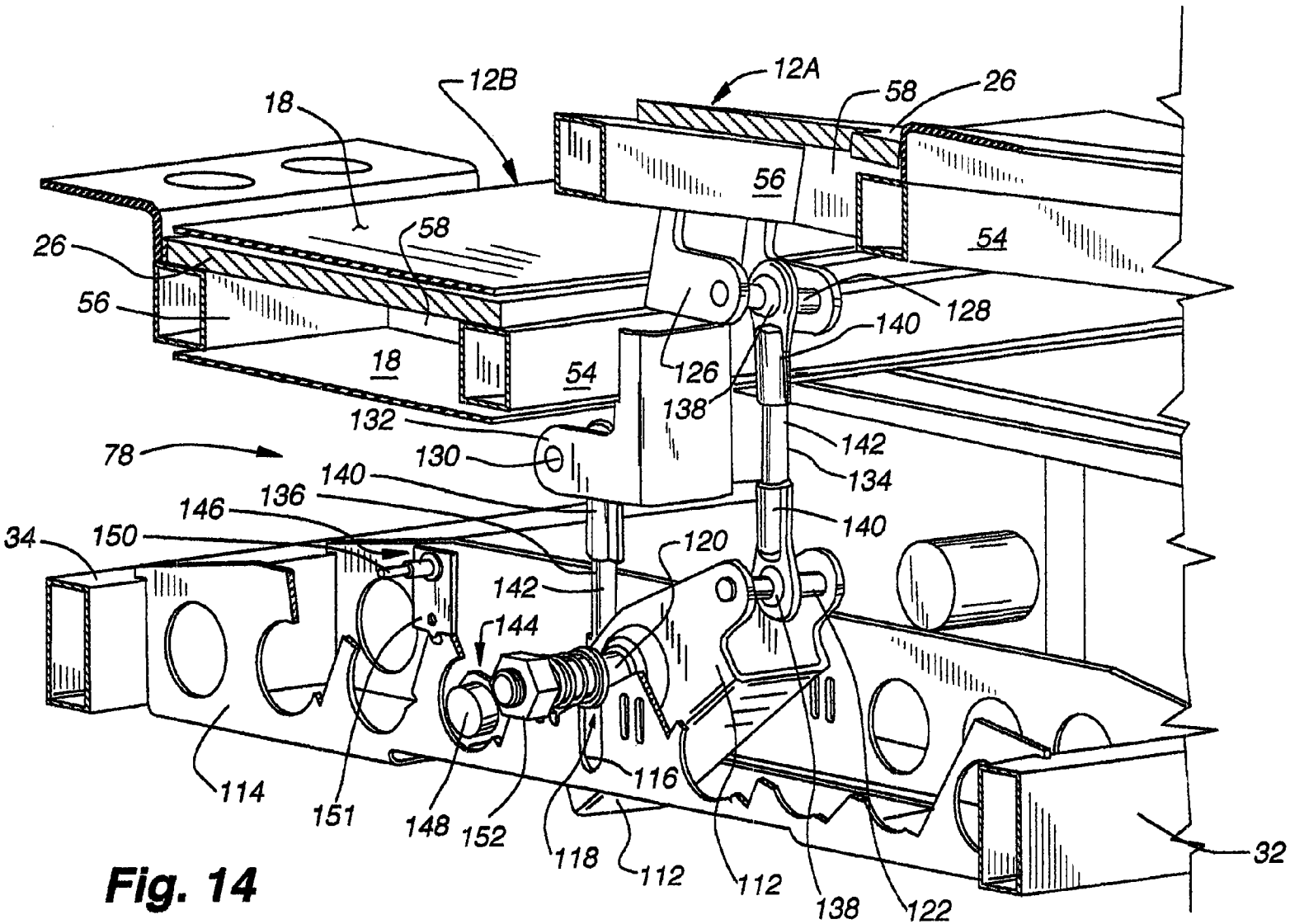
FIG. 14 is a partial cut away isometric view of the exercise device shown in FIG. 2, the view illustrating the rocker arm orientated in a position corresponding with the left treadle in a position higher than in FIG. 13 and the right treadle in a position lower than in FIG. 13.
Figure 15:
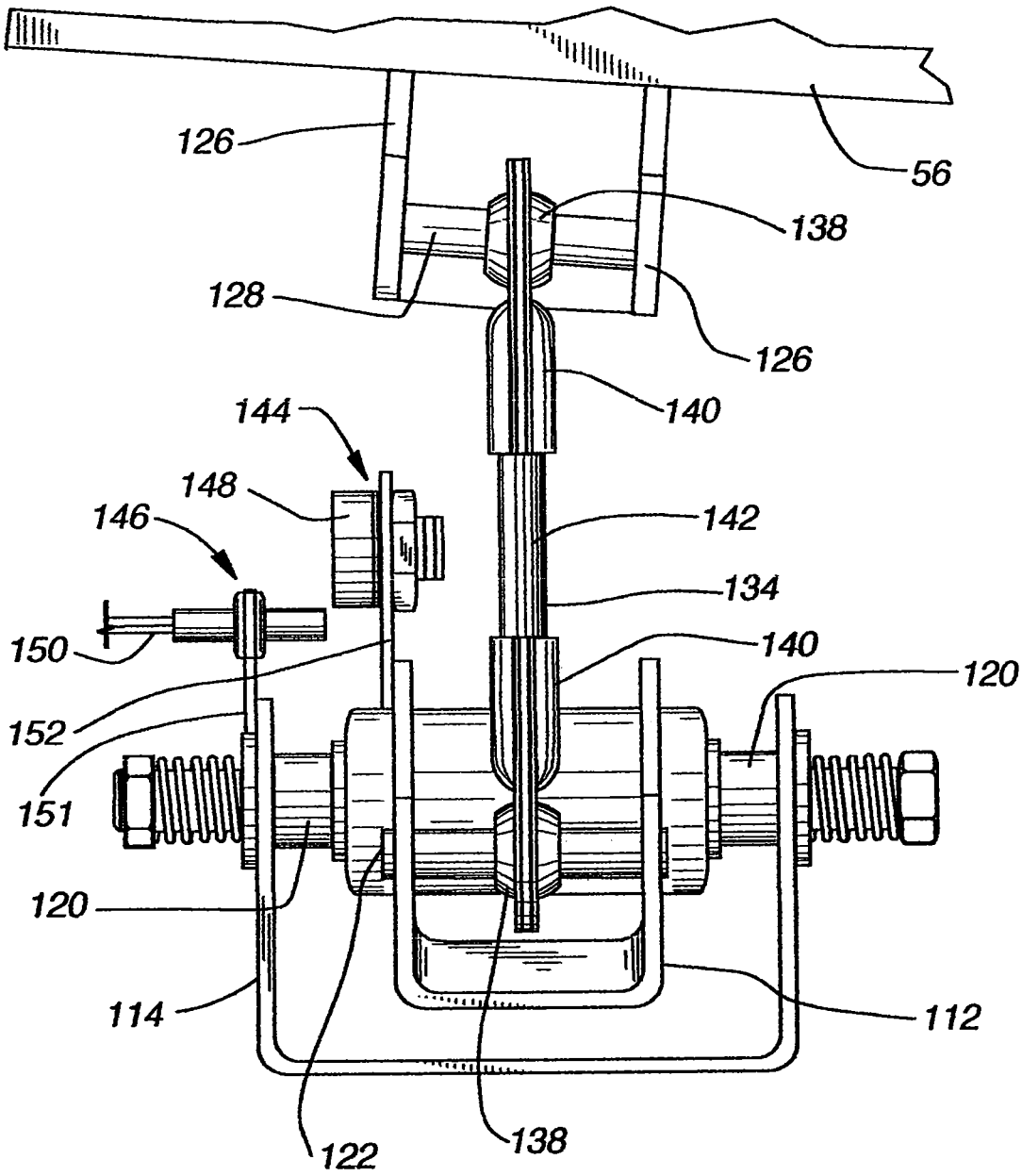
FIG. 15 is a left side view of one embodiment of a rocker arm type interconnection structure, in accordance with aspects of the present invention.

FIGS. 10-14 are partial isometric views of the exercise device particularly illustrating the treadle interconnection structure 78. Each of FIGS. 10-14 show the interconnection structure in a different position. FIG. 15 is a side view of the treadle interconnection structure in the same position as is shown in FIG. 12. FIGS. 16(A,B)-20(A,B) are isometric views of the exercise device corresponding with the views shown in FIGS. 10-14. In the particular implementation of the interconnection structure illustrated in FIGS. 10-15 and others, the interconnection structure includes a rocker or "teeter" arm assembly 112 pivotally supported on a rocker cross member 114 extending between the left 32 and right 34 side members of the frame. The rocker arm assembly is operably connected with each treadle assembly 12. As best shown in FIG. 15, the rocker cross member defines a U-shaped cross section. Each upstanding portion of the U defines a key way 116. The top of the key way defines a pivot aperture 118. The rocker arm includes a rocker or interconnect pivot axle 120 that is supported in and extends between each pivot aperture to pivotally support the rocker arm. As discussed in more detail below, the key way provides a way for the interconnect structure to be moved between a "shipping" position and a "use" position.

The left and right outer portions of the rocker arm include a first or left lower pivot pin 122 and a second or right lower pivot pin 124, respectively. A generally L-shaped bracket 126 supporting a first upper pivot pin 128 extends downwardly from the inner or right side member 56 of the left treadle 12A so that the upper pivot pin is supported generally parallel, below, and outwardly of the inner side member. A second generally L-shaped bracket 132 supporting a second upper pivot pin 130 extends downwardly from the inner or left side tube 54 of the right treadle assembly 12B so that the upper pivot pin is supported generally parallel, below, and outwardly of the inner side member.

A first rod 134 is connected between the left upper 128 and lower 122 pivot pins. A second rod 136 is connected between the right upper 130 and lower 124 pivot pins. The rods couple the treadles to the rocker arm. In one particular implementation, each rod (134, 136) defines a turnbuckle with an adjustable length. The turnbuckles are connected in a ball joint 138 configuration with the upper and lower pivot pins. A turnbuckle defines an upper and a lower threaded sleeve 140. Each threaded sleeve defines a circular cavity with opposing ends to support a pivot ball. The pivot pins are supported in the pivot balls. A rod defines opposing threaded ends 142, each supported in a corresponding threaded sleeve.

As will be discussed in more detail below, the treadle assemblies 12 may be locked-out so as to not pivot about the rear axis 16. When locked out, the belts 18 of the treadle assemblies collectively provide an effectively single non-pivoting treadmill-like striding surface. By adjusting the length of one or both of the turnbuckles 134, 136 through rotation of the rod 142 during assembly of the exercise device or afterwards, the level of the two treadles may be precisely aligned so that the two treadles belts, in combination, provide parallel striding surfaces in the lock-out position.

The interconnection structure 78 (e.g., the rocker arm assembly) interconnects the left treadle with the right treadle in such a manner that when one treadle, (e.g., the left treadle) is pivoted about the rear pivot axis 16 downwardly then upwardly, the other treadle (e.g., the right treadle) is pivoted upwardly then downwardly, respectively, about the rear pivot axis in coordination. Thus, the two treadles are interconnected in a manner to provide a stepping motion where the downward movement of one treadle is accompanied by the upward movement of the other treadle and vice versa. During such a stepping motion, whether alone or in combination with a striding motion, the rocker arm 112 pivots or teeters about the rocker axis 120.

Referring now to FIGS. 10-14 and 16(A,B)-20(A,B), the climbing-like exercise provided by the motion of the exercise device 10 is described in more detail. A representative user (hereinafter the "user") is shown in forward facing use in FIGS. 16B-20B. The user is walking forward and the device is configured for climbing-type use, i.e., so the treadles reciprocate. The foot motion shown is representative of only one user. In some instances, the treadles 12 may not move between the upper-most and lower-most position, but rather points in between. In some instances, the user may have a shorter or longer stride than that shown. In some instances, a user may walk backward, or may face backward, or may face backward and walk backward.

Figure 16A:
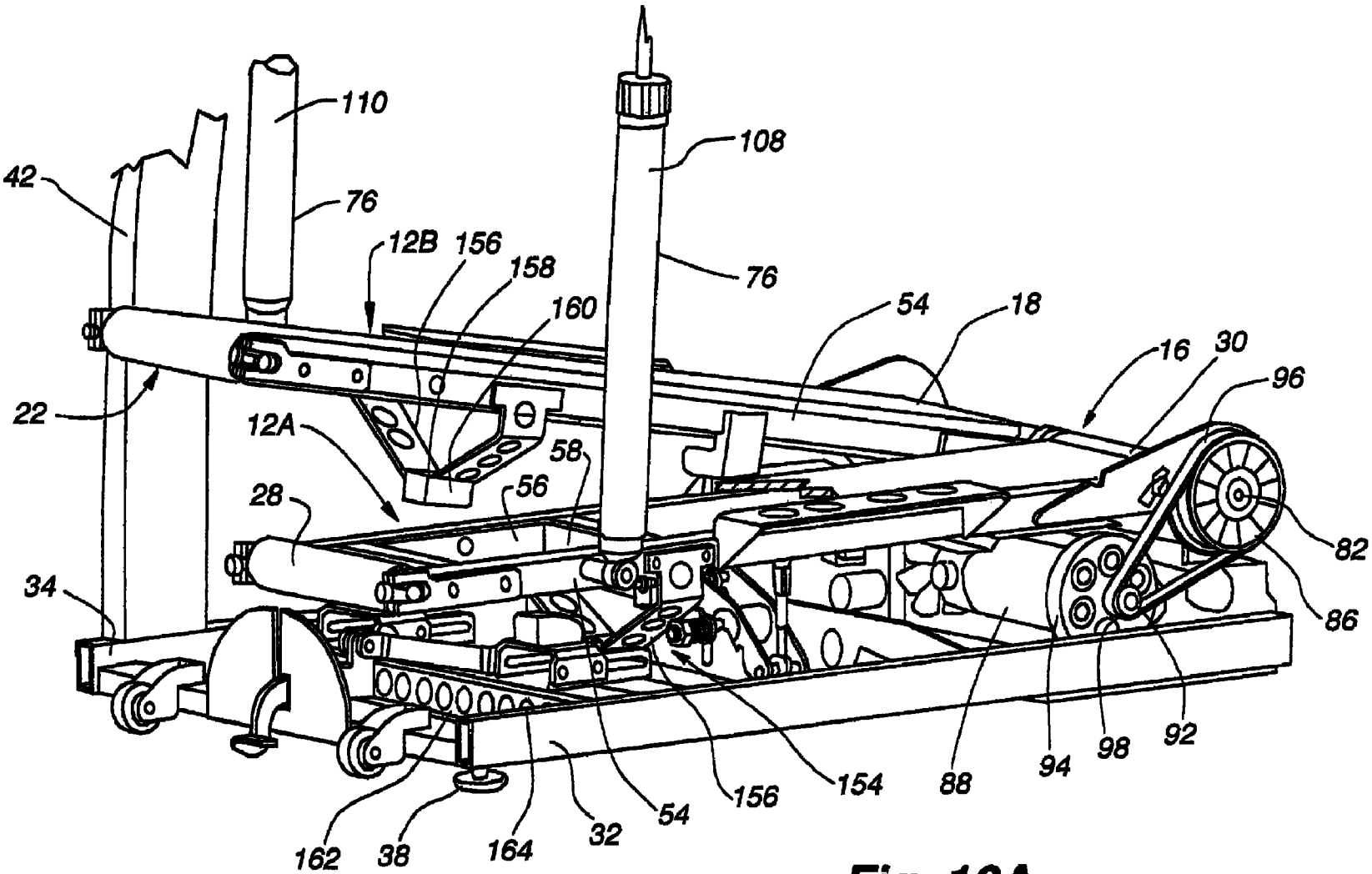
FIG. 16A is an isometric view of the exercise device shown in FIG. 2, the exercise device with the left treadle in about the lowest position and the right treadle in about the highest position.
Figure 16B:
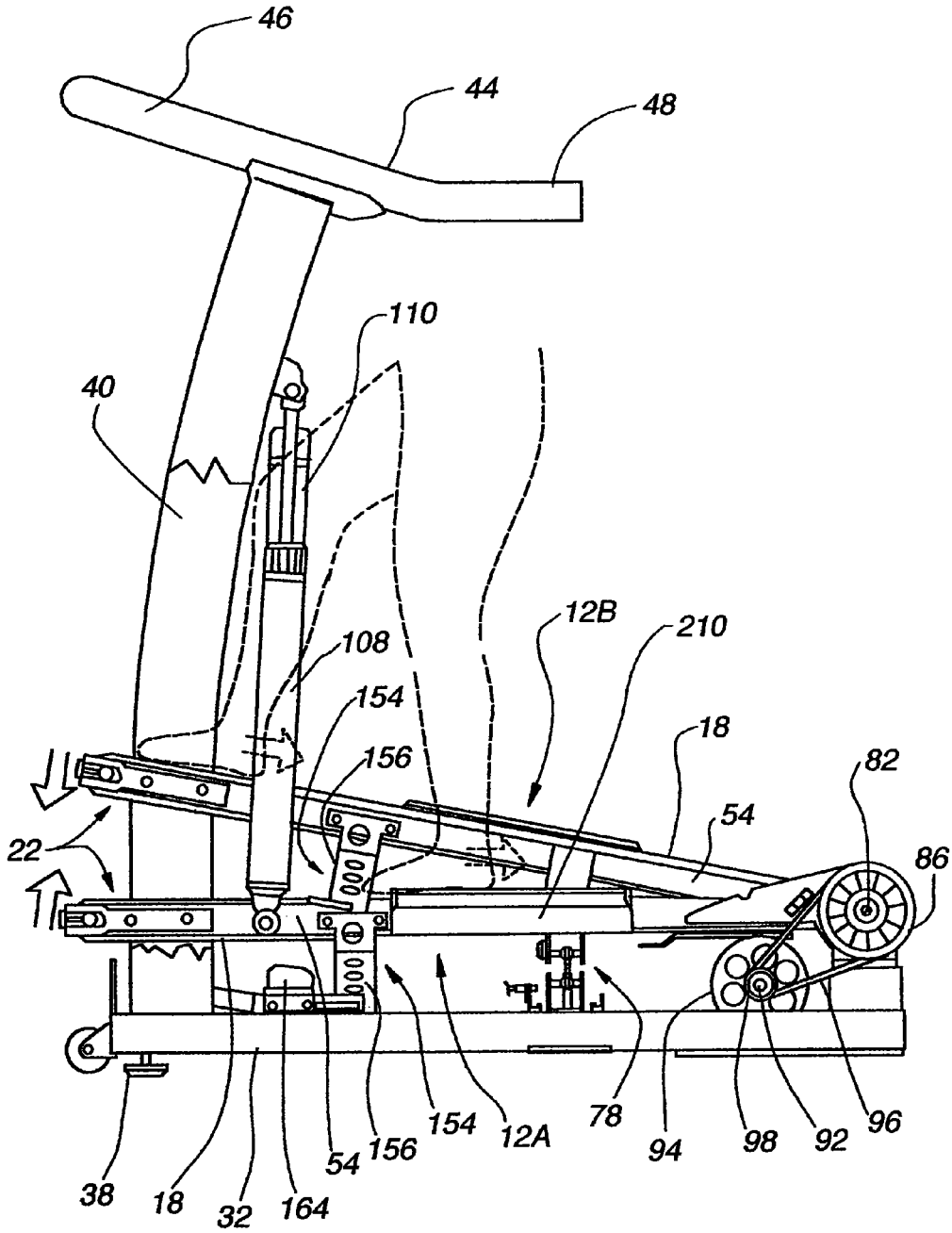
FIG. 16B is a left side view of the exercise device in the orientation shown in FIG. 16A and with a representative user.

In FIGS. 10 and 16A, the left treadle 12A is in a lower position and the right treadle 12B is in an upper position. Referring to FIGS. 10 and 14, the left side of the rocker arm 112 is pivoted downwardly and the right side of the rocker arm is pivoted upwardly. In FIG. 16B, the user is shown with his right foot forward and on the front portion of the right tread belt. In the orientation of the user shown in FIG. 16B, during forward facing climbing-type use, the user's left leg will be extended downwardly and rearwardly with the majority of the user's weight on the left treadle. The user's right leg will be bent at the knee and extended forwardly so that the user's right foot is beginning to press down on the right treadle. From the orientation shown in FIG. 16B, the user will transition his weight to a balance between the right leg and the left leg, and begin to press downwardly with his right leg to force the right treadle downwardly. Due to the movement of the belts, both feet will move rearwardly from the position shown in FIG. 16B.

Figure 17A:
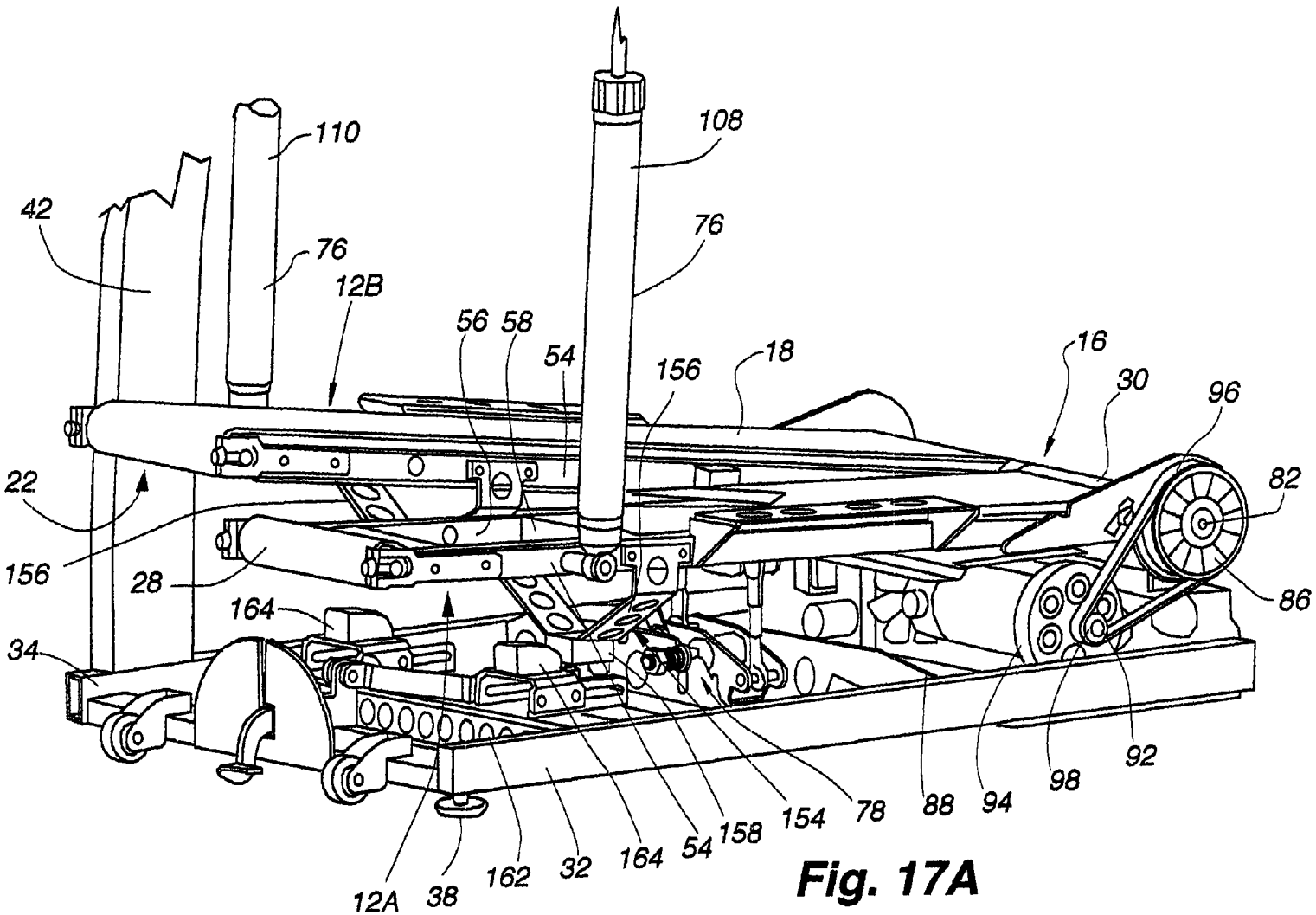
FIG. 17A is an isometric view of the exercise device shown in FIG. 2, the exercise device with the left treadle higher than shown in FIG. 16A, and the right treadle lower than shown in FIG. 16A.
Figure 17B:
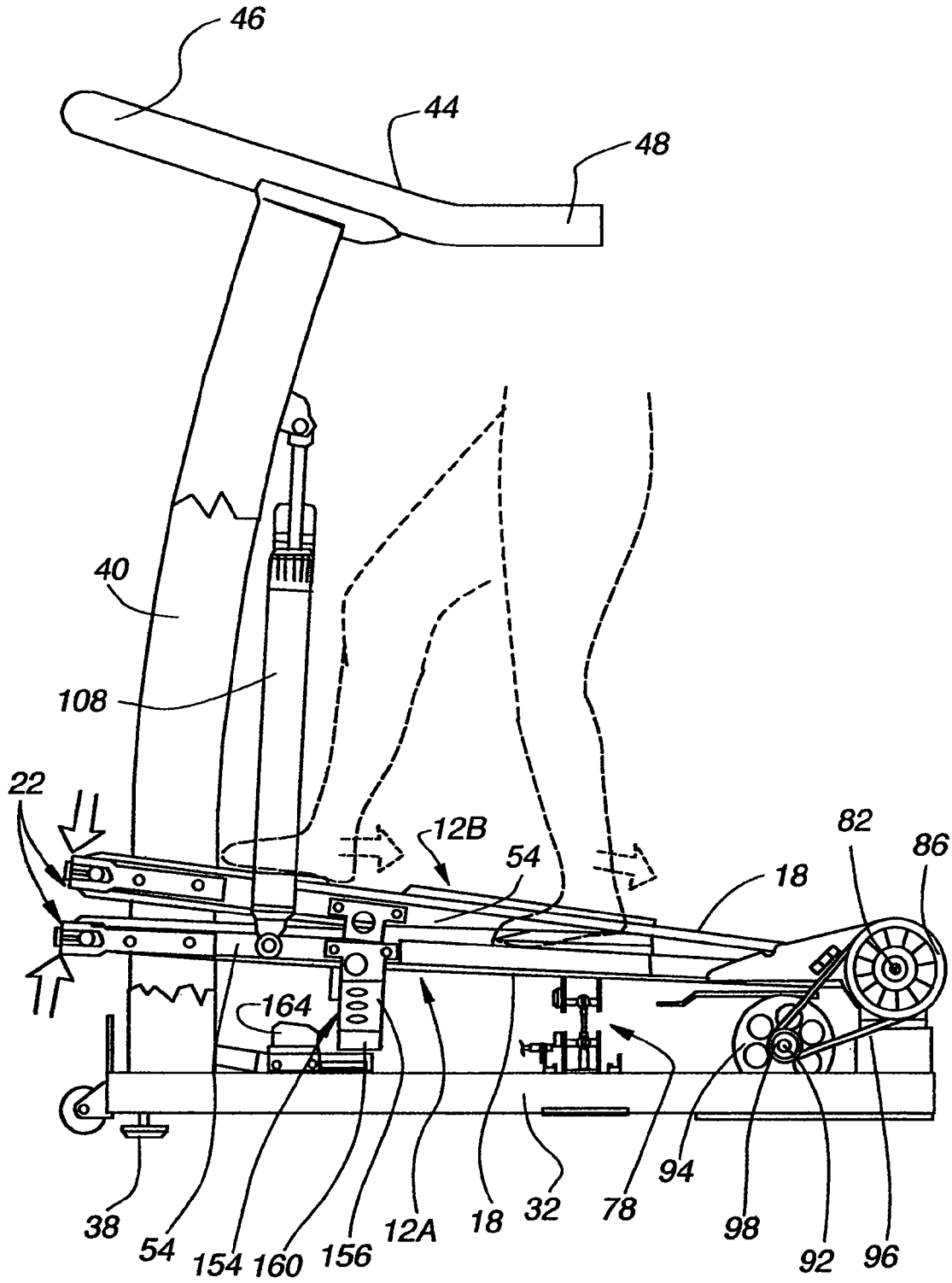
FIG. 17B is a left side view of the exercise device in the orientation shown in FIG. 17A and with a representative user.

FIGS. 11, 17A, and 17B show the orientation of the device 10 and the user in a position after that shown in FIGS. 10, 16A, and 16B. The right treadle 12B is being pressed downwardly, which, via the rocker interconnection structure 78, causes the left treadle 12A to begin to rise. The user's right foot has moved rearwardly and downwardly from the position shown in FIG. 16B. The user's left foot has moved rearwardly and upwardly from the position shown in FIG. 16B.

Figure 18A:
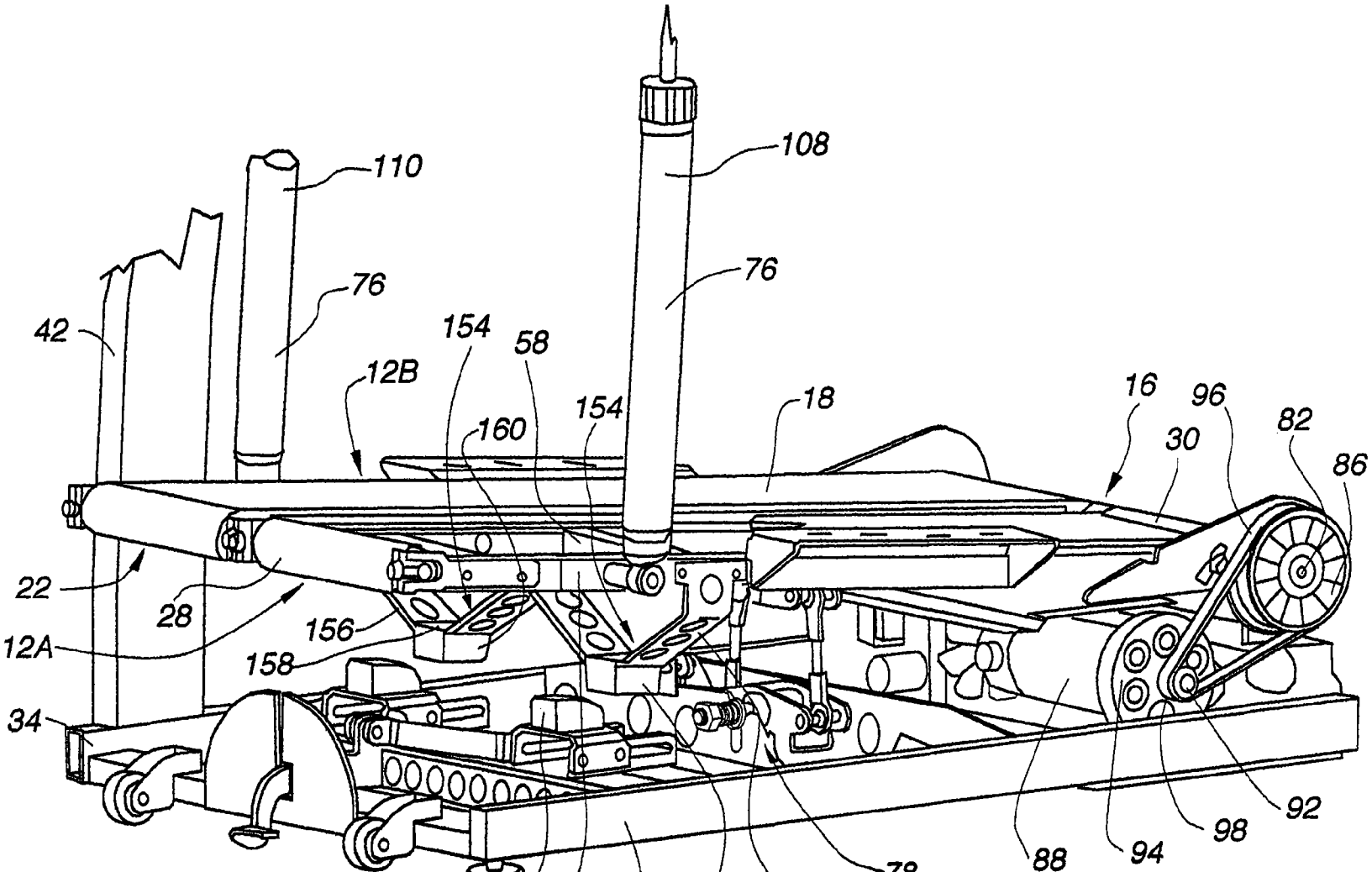
FIG. 18A is an isometric view of the exercise device shown in FIG. 2, the exercise device with the left and right treadle about parallel and collectively at about a 10% grade.
Figure 18B:
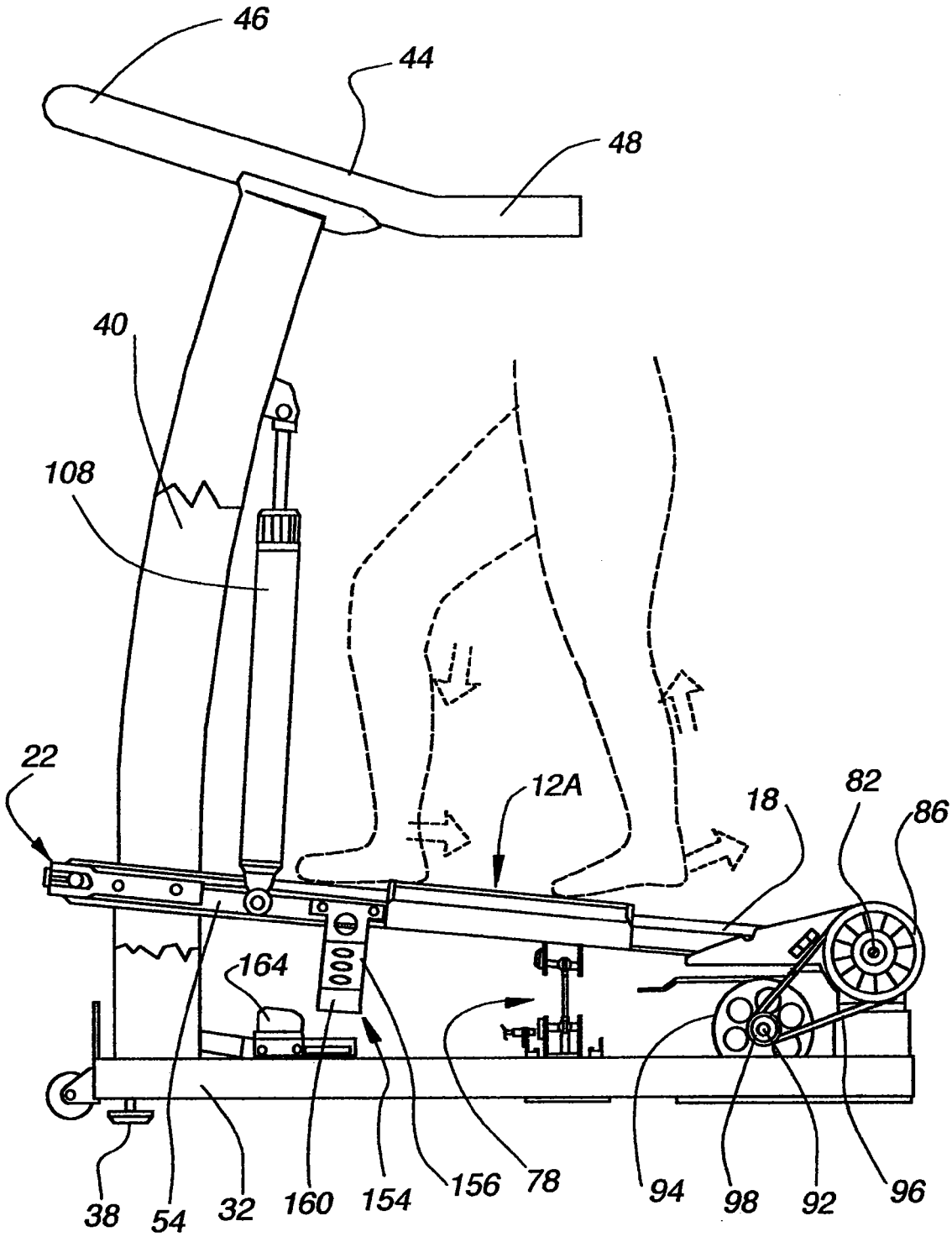
FIG. 18B is a left side view of the exercise device in the orientation shown in FIG. 18A and with a representative user.

FIGS. 12, 18A, and 18B show the right treadle 12B about midway through its upward stroke, and the left treadle 12A about midway through its downward stroke. As such, the treadle assemblies are nearly at the same level above the frame 14 and the endless belts 18 are also at the same level. As shown in FIG. 18B, the user's right foot and leg have moved rearwardly and downwardly from the position shown in FIG. 17B. The user's left foot has moved rearwardly and upwardly from the position shown in FIG. 16B. At this point, the user has begun to lift the left foot from the left tread belt in taking a forward stride; thus, the left heel is lifted and the user has rolled onto the ball of the left foot. Typically, more weight will now be on the right treadle than the left treadle.

Figure 19A:
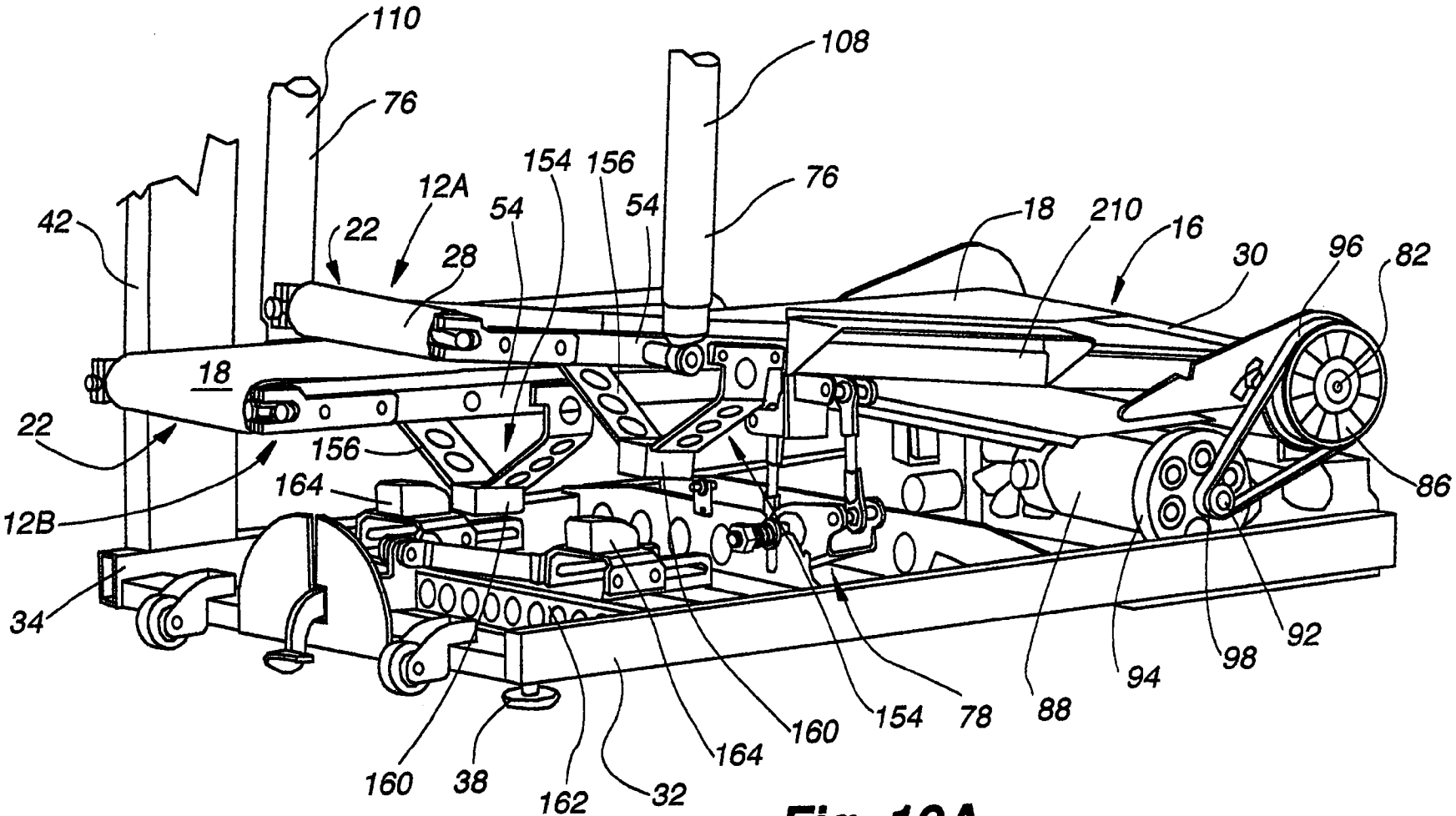
FIG. 19A is an isometric view of the exercise device shown in FIG. 2, the exercise device with the left treadle higher than shown in FIG. 18A, and the right treadle lower than as shown in FIG. 18A.
Figure 19B:
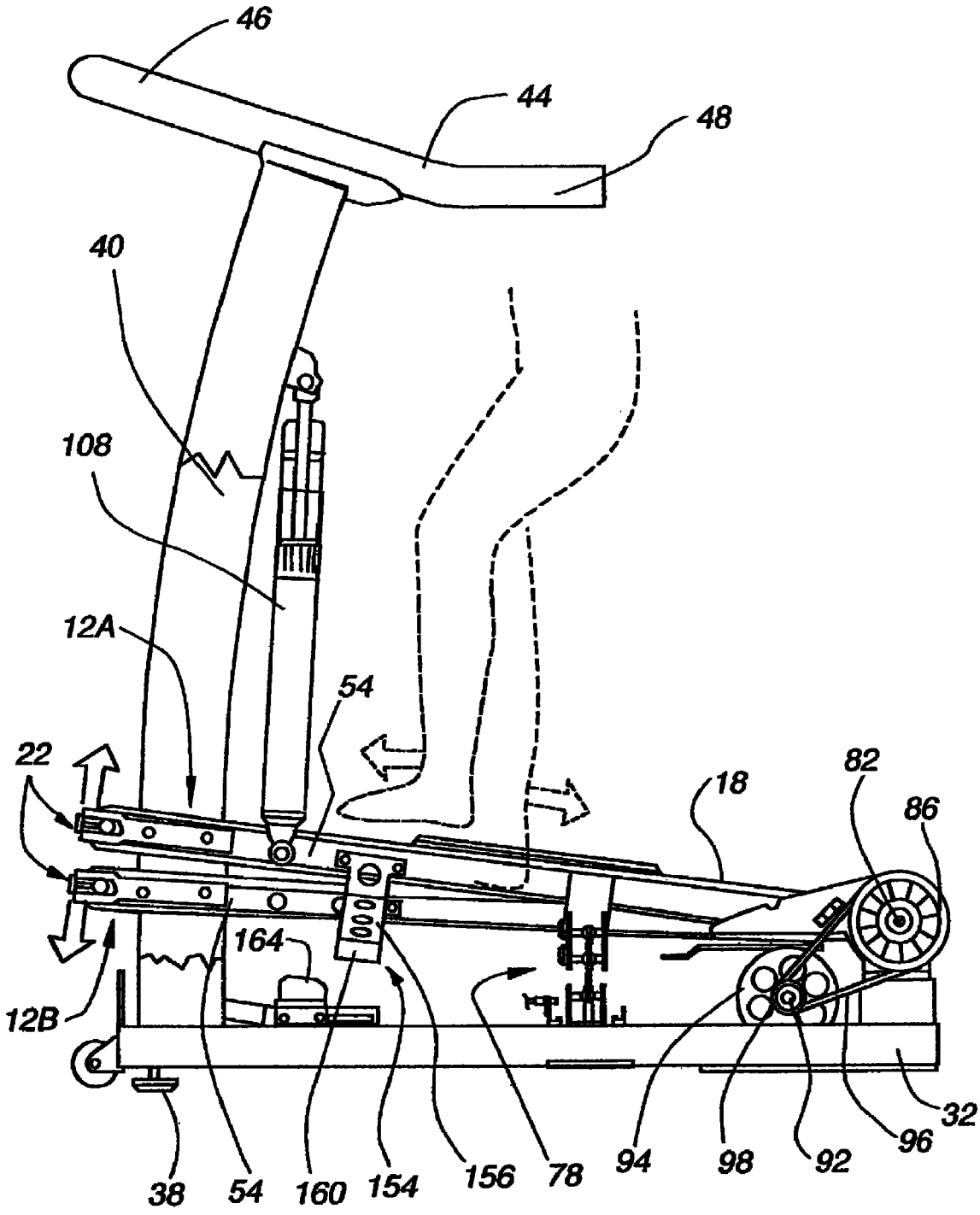
FIG. 19B is a left side view of the exercise device in the orientation shown in FIG. 19A and with a representative user.

After the orientation shown in FIGS. 12, 18A, and 18B, the right treadle 12B continues it downward movement and the left treadle 12A continues its upward movement to the orientation of the device as shown in FIGS. 13, 19A, and 19B. In FIGS. 13, 19A, and 19B, the left treadle is higher than the right treadle, and the rocker arm 112 is pivoted about the rocker pivot axis 120 such that its right side is lower than its left side. In this position, the user's right leg continues to move rearward and downward. The user has lifted the right leg off the left treadle and is moving it forward. At about the upper position of the left treadle, the user will step down with his left foot on the front portion of the treadle belt. All of the user's weight is on the right treadle until the user places his left foot on the left treadle. The user continues to provide a downward force on the right treadle forcing the left treadle up.

Figure 20A:
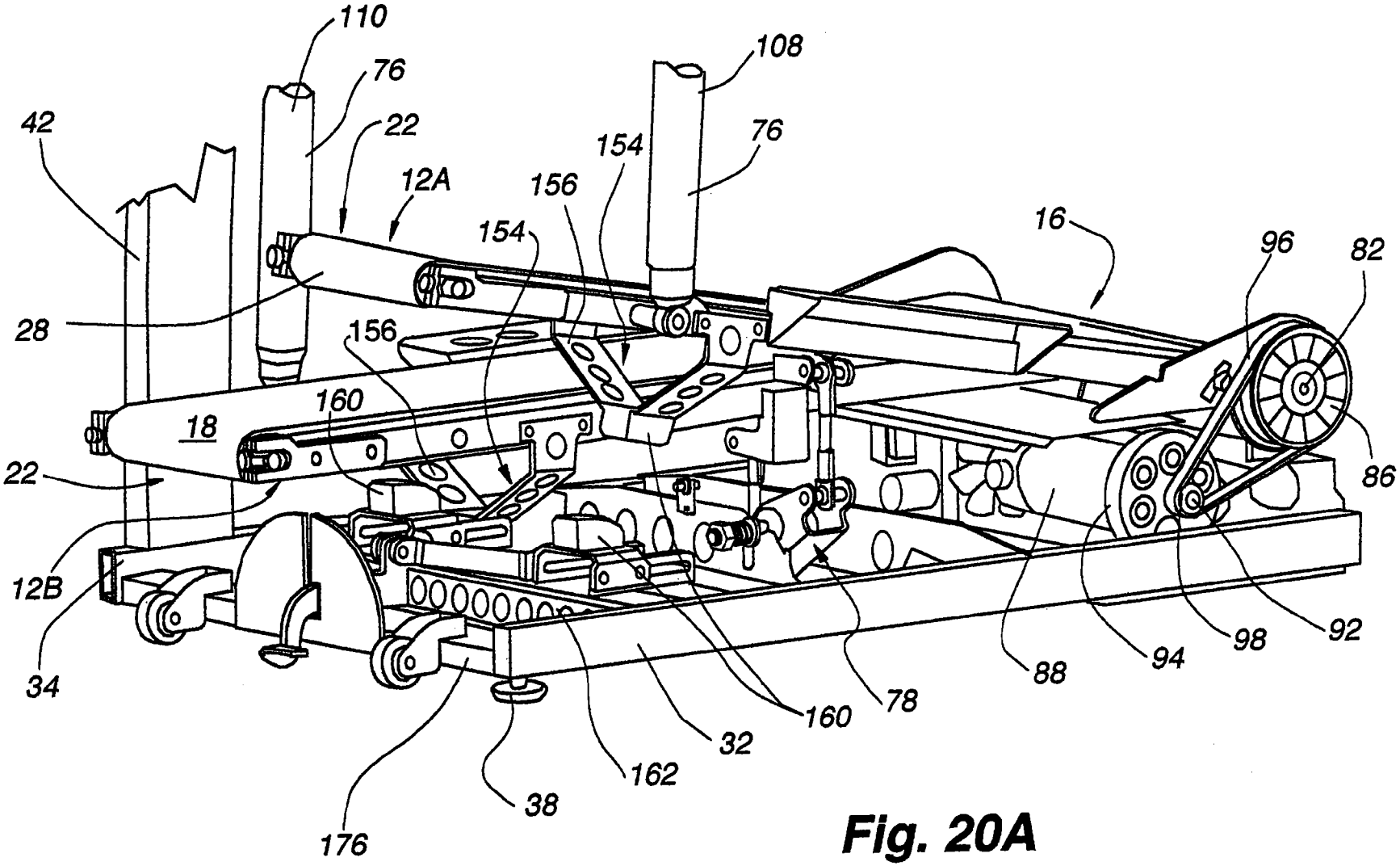
FIG. 20A is an isometric view of the exercise device shown in FIG. 2, the exercise device with the left treadle in about its highest position and the right treadle in about its lowest position.
Figure 20B:
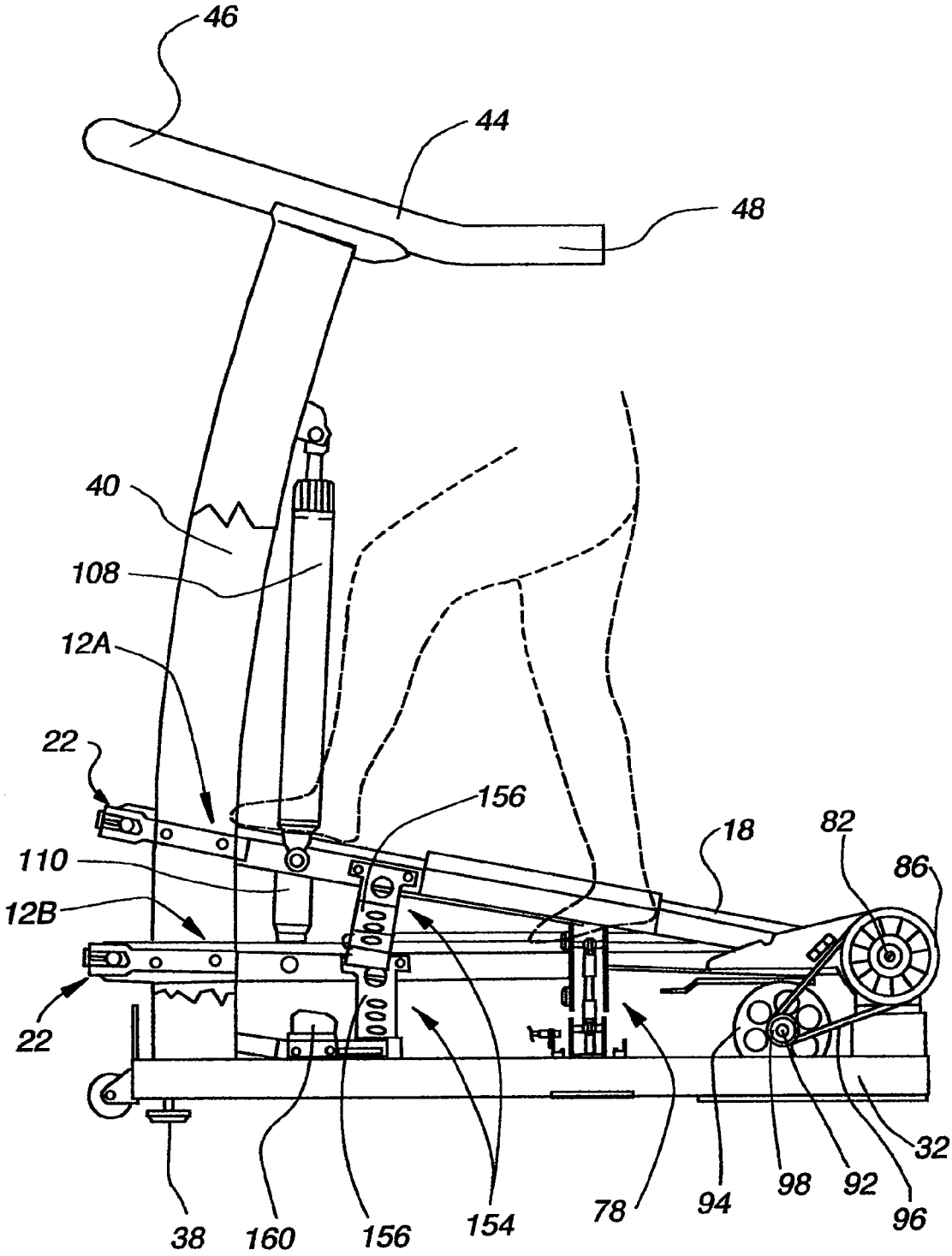
FIG. 20B is a left side view of the exercise device in the orientation shown in FIG. 20A and with a representative user.

FIGS. 14, 20A, and 20B illustrate the right treadle 12B in about its lowest position, and show the left treadle 12A in about its highest position. At this point, the user has stepped down on the front 22 of the left treadle and has begun pressing downward with the left leg. The user is also beginning to lift the right leg. The downward force on the left treadle will be transferred through the interconnection structure 78 to the right treadle to cause the right treadle to begin to rise.

FIGS. 16(A,B)-20(A,B) represent half a cycle of the reciprocating motion of the treadles, i.e., the movement of the left treadle from a lower position to an upper position and the movement of the right treadle from an upper position to a lower position. A complete climbing-type exercise cycle is represented by the movement of one treadle from some position and back to the same position in a manner that includes a full upward stroke of the treadle (from the lower position to the upper position) and a full downward stroke of the treadle (from the upper position to the lower position). For example, a step cycle referenced from the lower position of the left treadle (the upper position of the right treadle) will include the movement of the left treadle upward from the lower position to the upper position and then downward back to its lower position. In another example, a step cycle referenced from the mid-point position of the left treadle (see FIG. 18) will include the upward movement of the treadle to the upper position, the downward movement from the upper position, past the mid-point position and to the lower position, and the upward movement back to the mid-point position. The order of upward and downward treadle movements does not matter. Thus, the upward movement may be followed by the downward movement or the downward movement may be followed by the upward movement.

Referring to FIG. 10 and others, in one particular configuration, the exercise device includes a step sensor 144, which provides an output pulse corresponding with each downward stroke of each treadle. The step sensor is implemented with a second reed switch 146 including a magnet 148 and a pick-up 150. The magnet is connected to the end of a bracket 152 that extends upwardly from the rocker arm 112. The bracket orients the magnet so that it swings back and forth past the pick-up, which is mounted on a bracket 157 connected with the rocker cross member 114. The reed switch 146 triggers an output pulse each time the magnet 148 passes the pick-up 150. Thus, the reed switch transmits an output pulse when the right treadle 12B is moving downward, which corresponds with the magnet passing downwardly past the pick-up, and the reed switch also transmits an output pulse when the left treadle 12A is moving upward, which corresponds with the movement to the magnet upwardly past the pick-up. The output pulses are used to monitor the oscillation and stroke count of the treadles as they move up and down during use. With additional sensors arranged generally vertically, it is also possible to determine the depth or vertical stroke dimension. The output pulses, alone or in combination with the belt speed signal, may be used to provide an exercise frequency display and may be used in various exercise related calculations, such as in determining the user's calorie burn rate.

As best shown in FIGS. 3, 6, and 16A-20, in one particular implementation, each treadle includes a bottom-out assembly 154. The bottom-out assembly includes a generally V-shaped bracket 156 interconnected between the inside and outside members of the treadle frame. The vertex region of the V-shaped bracket is oriented downwardly and generally defines a flat mounting surface 158. A block 160 is fixed to the lower downwardly facing portion of the mounting surface. When the exercise device is assembled it is preferable to arrange the treadles by way of the turnbuckles (134, 136) so that the block 160 is maintained slightly above the underlying lock-out cross member 162 when the treadle is in its lowest position. A bumper 164 may be fixed to the cross member 162 to cushion the treadle should it bottom out. In one example, the block is fabricated with a hard, non-flexible, plastic. The block may also be fabricated with a solid or flexible resilient polymer material. In a flexible resilient form, the block will provide some cushioning to enhance the cushioning provided by the bumper, or provide cushions when a bumper is not used, should the block bottom-out on the lock-out cross member during use.

As mentioned above, the exercise device 10 may be configured in a "lock-out" position where the treadle assemblies do not pivot upward and downward. In one particular lock-out orientation, the treadle assemblies are pivotally fixed so that the tread belts are parallel and at about a 10% grade with respect to the rear of the exercise device. Thus, in a forward facing use, the user may simulate striding uphill, and in a rearward facing use the user may simulate striding downhill.

Figure 21:
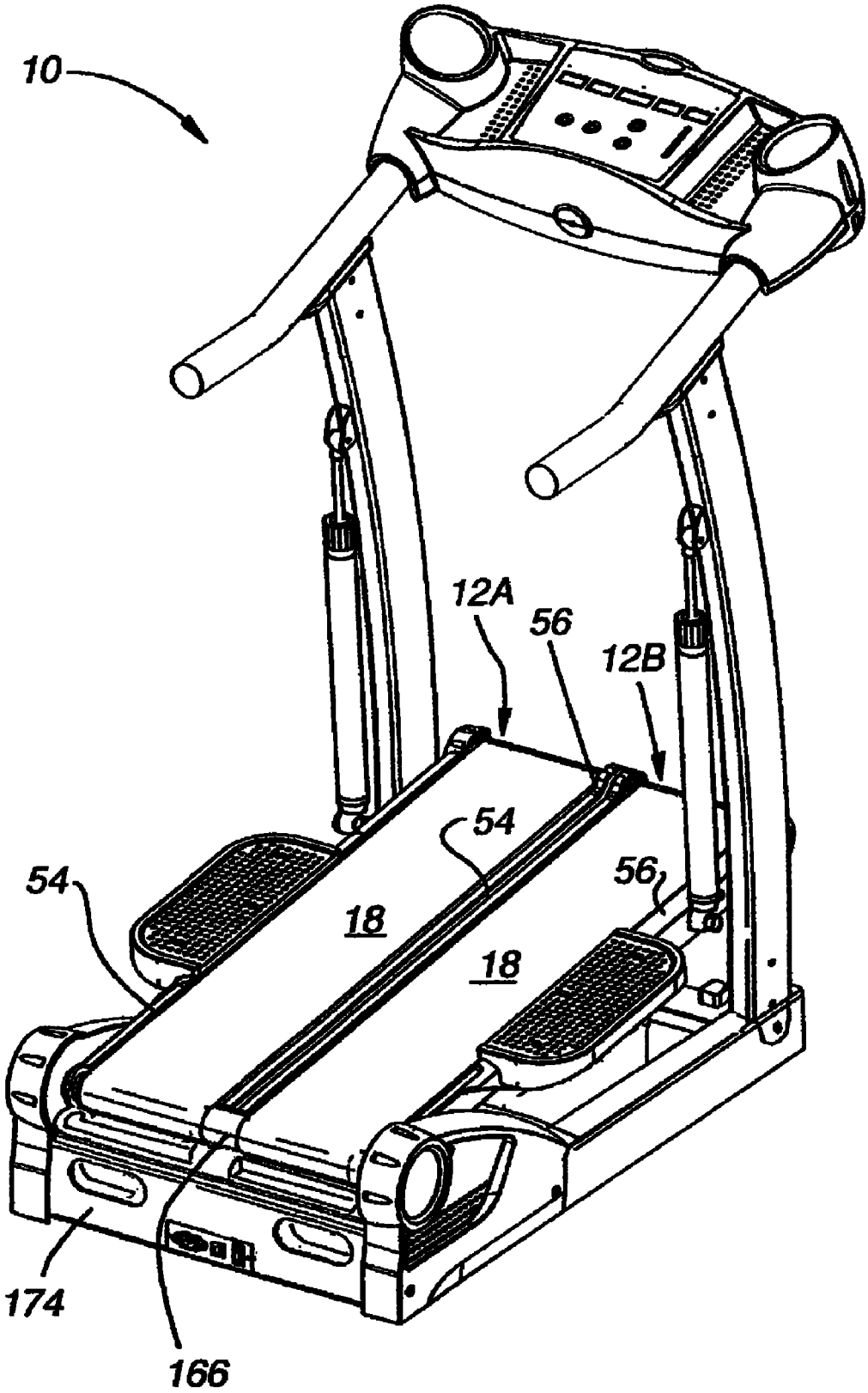
FIG. 21 is an isometric view of an alternative exercise device employing a single rear roller supported in virtual pivot arrangement.
Figure 22:
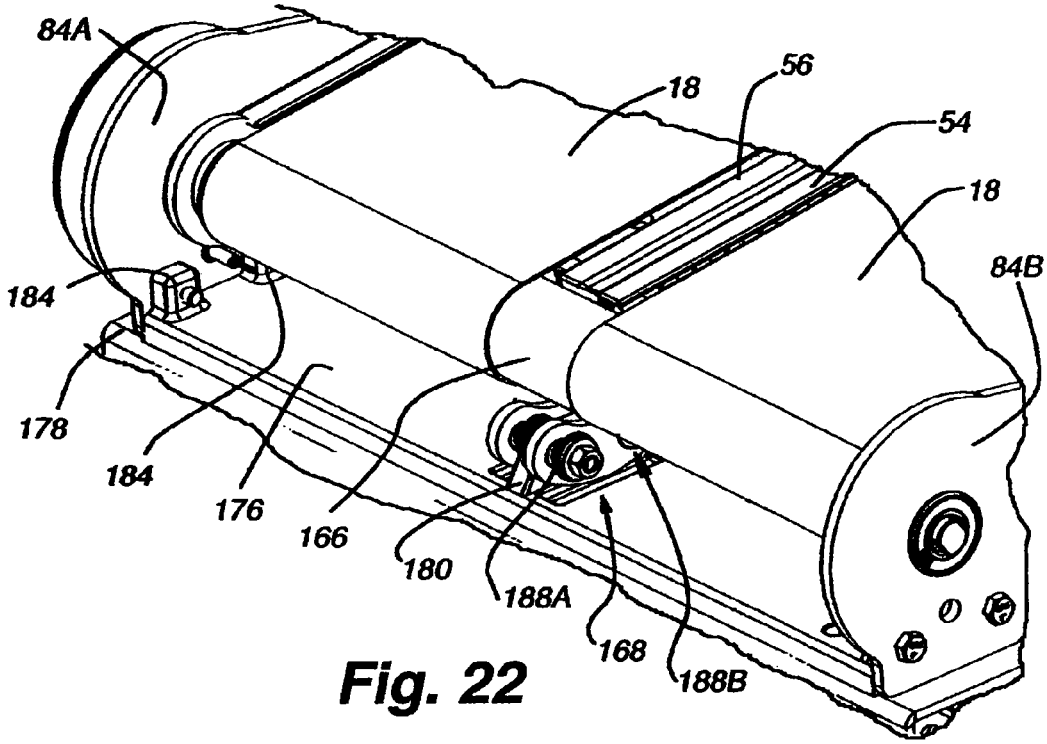
FIG. 22 is an isometric view of the single rear roller supported in virtual pivot arrangement.
Figure 23:
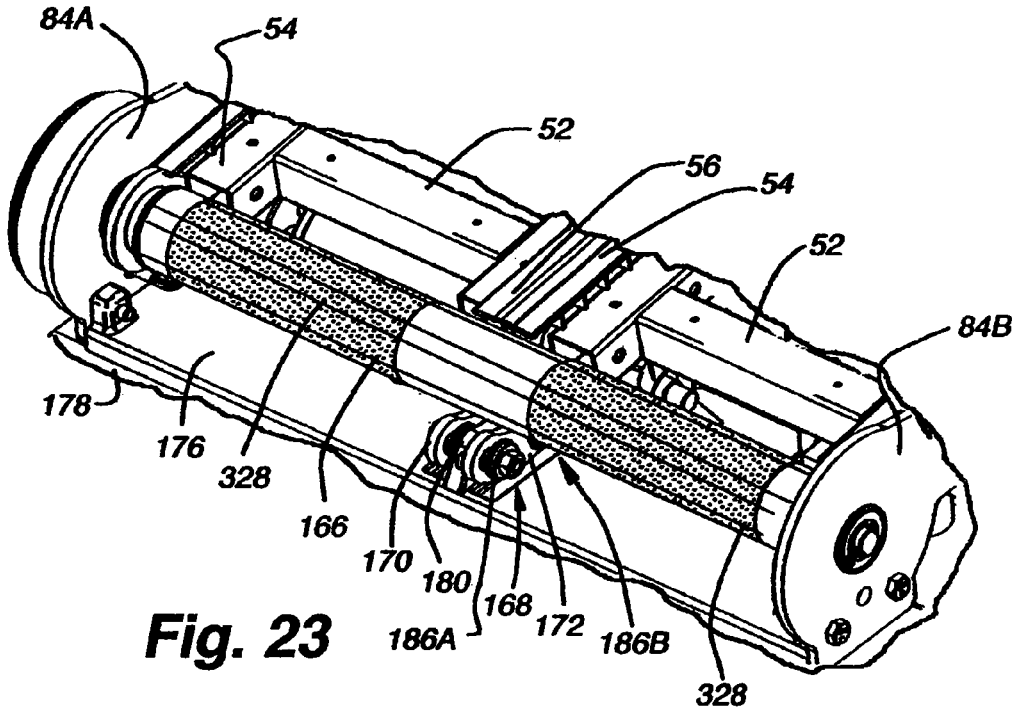
FIG. 23 is an isometric view of the single rear roller supported in virtual pivot arrangement, with belts removed to show additional features.

FIGS. 21-23 illustrate an alternative implementation of an exercise device 10. In the alternative implementation, each treadle (12A, 12B) includes a tread belt 18 that provides a moving surface like a treadmill. Each tread belt is supported by a front roller and a rear roller. However, unlike the embodiment of FIGS. 1-20, the rear roller 166 is common to both treadles. The rear roller may be supported on the frame or treadle, and may share an axis of rotation with the treadles or may have a unique axis of rotation forward, rearward, above an/or below the pivot axis of the treadles.

As discussed in more detail below, in one implementation, opposing end portions of the rear roller are rotatably supported at the rear end of the frame. The outer members 54, 56 of the left 12A and right 12B treadles, respectively, are rotatably supported by the outer end portions of the rear roller. However, inner members 56,54 of the left 12A and right 12B treadles, respectively, are not coupled with the rear roller, but instead, are coupled with the frame through an inner support structure that defines a virtual pivot 168. More particularly, the inner support structure includes brackets 170, 172 extending rearward from the inner sides 56, 54 of the treadles, which are movingly coupled with at least one stud connected with the rear end of the frame. The inner support structure thus allows each treadle to be positioned more closely to one another along the inner sides than a comparable exercise device having two separate rear rollers. The inner support structure also allows the inner sides of each treadle to move about a central pivot of the rear end of each treadle as if it was supported at the central pivot even though the inner support structure is not located directly at the location of the pivot motion.

More particularly, each treadle assembly 12 is pivotally supported above a rear support structure 174 of the main frame 14. More particularly, the rear support structure includes a rear drive casting 176 supported by a rear frame support 178. As discussed in more detail below, drive brackets extending upward from the rear drive casting rotatably support opposing end portions of the rear roller 166. An inner support structure 168 pivotally supporting the insides of the treadle frames includes a mounting block 180 extending upwardly from the rear drive casting between opposing end portions thereof. As described in more detail below, the mounting block supports the inside longitudinal members 54, 56 of the treadle frames 52.

Figure 24:
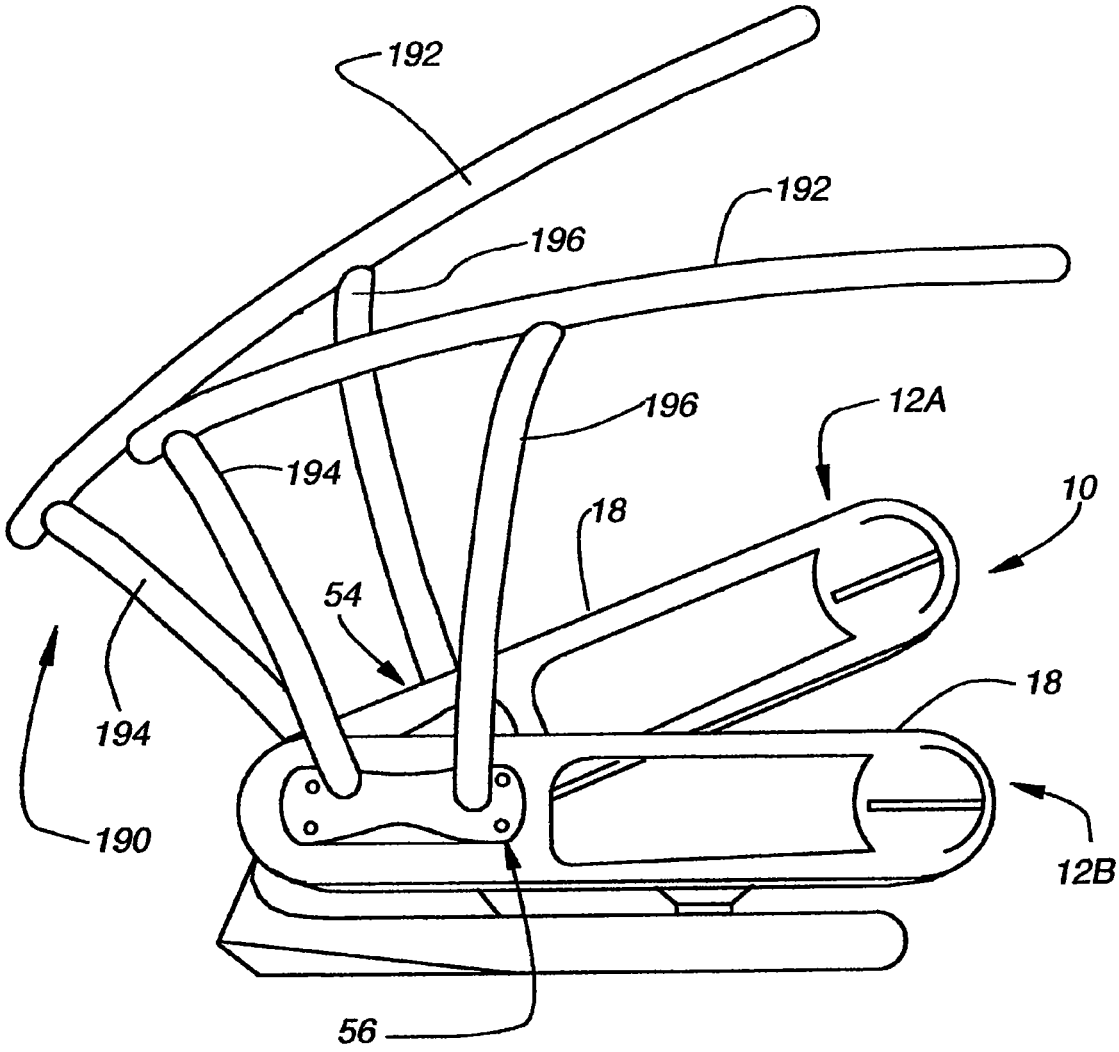
FIG. 24 is a side view of a first embodiment of an exercise device employing an upper body exercise assembly.

As shown in FIGS. 23 and 24, axle ends 182A, 182B of the rear roller 166 are rotatably supported above the rear drive casting 176 by the left drive bracket 84A and the right drive bracket 84B. Corresponding radial bearings 81A and 81B rotatably support the axle ends in the brackets. As best shown in FIGS. 22 and 23, the right and left drive brackets are bolted to a pair of flanges 184 extending upward from opposing end portions of the rear drive casting.

As previously mentioned, the inner support structure 168 acts to support the inside longitudinal members 56, 54 of the treadles 12A, 12B, respectively. More particularly, the inner support structure includes inner brackets 170, 172 extending from the treadle frame members 56, 54 slidingly coupled with studs 186A, 186B extending from opposite sides of the mounting block 180. Inner brackets connected with the treadle frames are slidingly coupled with the studs on the mounting block and act to support the inside longitudinal members of the treadle frames. The inner brackets include a curved portion extending downwardly and rearwardly from the rear ends of the inside longitudinal members 54, 56. The curved portions of the inner brackets each define at least one slot 188A, 188B therein which are slidingly supported by the studs 186A, 186B extending from the mounting block. As each treadle pivots around the rear pivot axis 16, the studs on the mounting block glide through the slots and thereby support inside longitudinal member of the treadle frame. The interaction of the curved portions of the inner brackets and the studs defines the virtual pivot having a pivot center in common with the rear pivot axis.

FIGS. 24-37 illustrate various exercise devices including an upper body exercise (arms, chest, back, shoulders, etc.) feature or features, in addition to the lower body exercise provided by the exercise devices shown in FIGS. 1-23. FIGS. 24-37 discussed in detail below are based upon the exercise devices discussed with reference to FIGS. 1-23 above. Many features of the exercise device, not directly relevant to the upper body features, are not included in the drawings. It should be recognized, however, that any implementation of an exercise device with upper body features would include some arrangement of some, many, or all of the features not shown in FIGS. 24-37, but shown in FIGS. 1-23.

As used herein, the term "upper body exercise" structure, assembly, or the like, is meant to refer to any assembly of components that a user grasps with his or her hands, or otherwise engages with a portion of his or her upper body, to exercise any portion of his or her upper body, including arm, chest, back, trunk, abdomen, etc. As used herein, the term "resistance member" is meant to refer to any type of resistance member, assembly, resistance element defined herein, or structure that imparts a force that a user acts on or against when actuating or acting on an upper body exercise structure. Examples of resistance members include, but are not limited to, the treadles, a resistance element or structure acting directly or indirectly on the treadles, shocks, flexible resilient members, such as Power Rod technology, weight stack assemblies, SpiralFlex type packs or an assembly thereof, flexible and resilient cabling, and the like.

Figure 25:
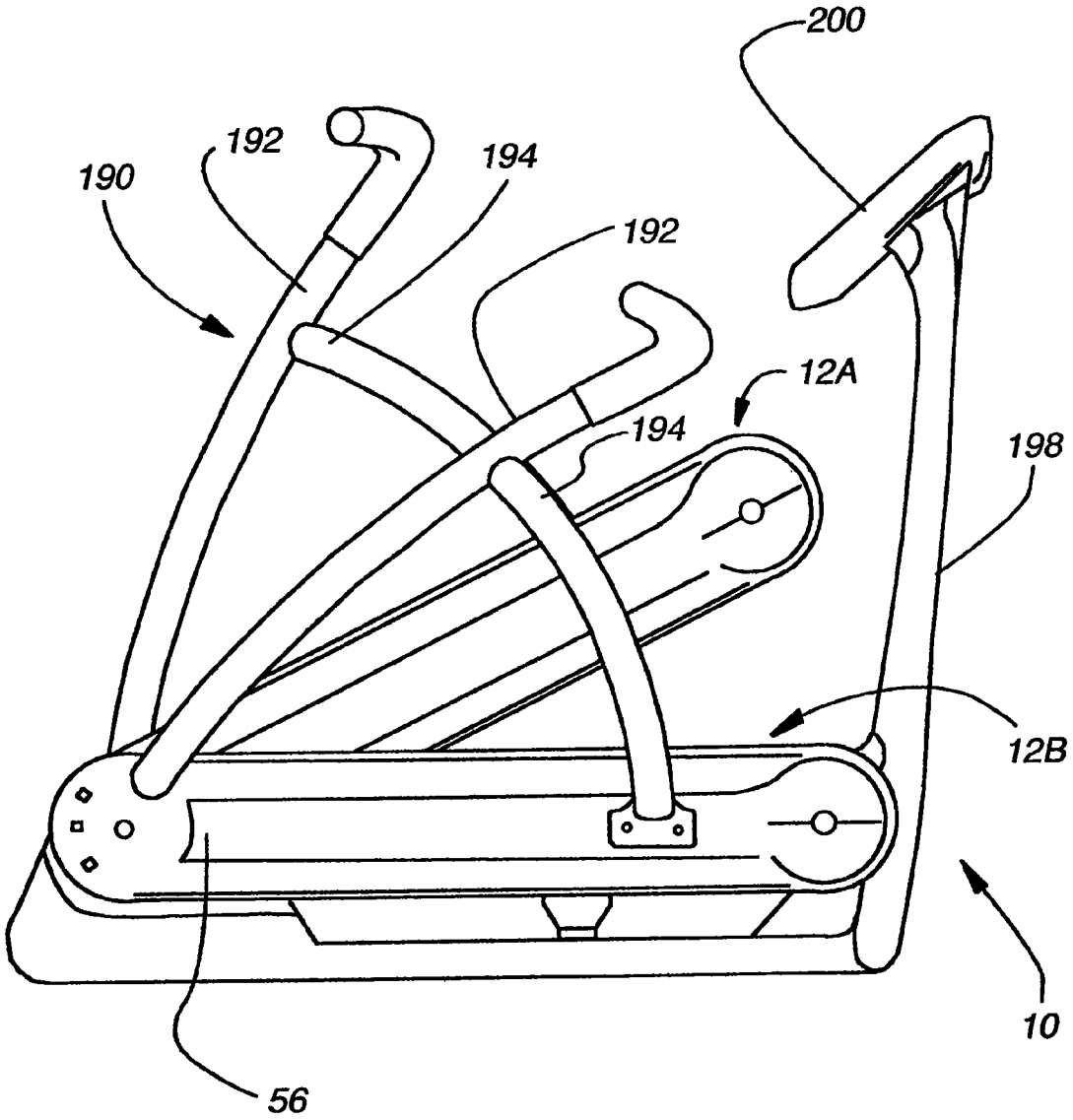
FIG. 25 is a side view of a second embodiment of an exercise device employing an upper body exercise assembly.

FIG. 24 depicts a first embodiment of a dual-deck exercise device 10 employing an upper body exercise structure 190. In this embodiment, handlebars 192 are affixed to each treadle (12A, 12B) by first and second uprights (194, 196). The uprights may be of varying lengths and configurations. Further, one, three, or more uprights may be used to secure each handlebar to respective treadles. The uprights are coupled with the left treadle frame member 54 (left treadle) and the right treadle frame member 56 (right treadle). The handlebar is slightly curved. The handlebar may be any shape. In the FIG. 24 embodiment, the uprights (40,42) and the handlebars 44 and console 50 of FIGS. 1-20 are not present. It is possible to provide a console extending from the front of the device. The console, in one example, is located atop a pillar extending upwardly from the front region of the frame and forward the treadles, such as shown in FIG. 25. The joinder between uprights and treadle is fixed, rather than pivotal. In FIG. 24, the left treadle 12A is an upper pivotal orientation, and the right treadle 12B is in a lower pivotal orientation. Each handlebar oscillates with the pivotal motion of the associated treadle. When the treadle is pivoted upwardly, the handle 192 is also pivoted upwardly. By grasping the handle 192 and pressing down to push the treadle down or pulling up to pull the treadle up, the user may achieve upper body exercise to accompany lower body and cardiovascular benefits. When pulling or pushing on the handles, the user is acting against one or all of the forces from the treadle interconnection, treadle movement, treadle resistance structure, etc.

FIG. 25 depicts a second embodiment of a dual-deck exercise device 10 employing an upper body exercise structure 190. The embodiment of FIG. 25 is similar in function to the embodiment of FIG. 24. In this example, handles 192 extends upwardly and forwardly from the outside rear of each treadle. Each handle may include one or more uprights 194 attaching the handle to the treadle at a second point. Like the embodiment of FIG. 24, as the treadles move up and down, so do the handles. As such, the user may grasp the handles and push or pull on the handles to impart a downward force on the treadles or an upward force on the treadles. The exercise device of FIG. 25 includes an upright or pillar 198 extending upward from the front of the frame. The pillar supports the console 20.

Figure 26:
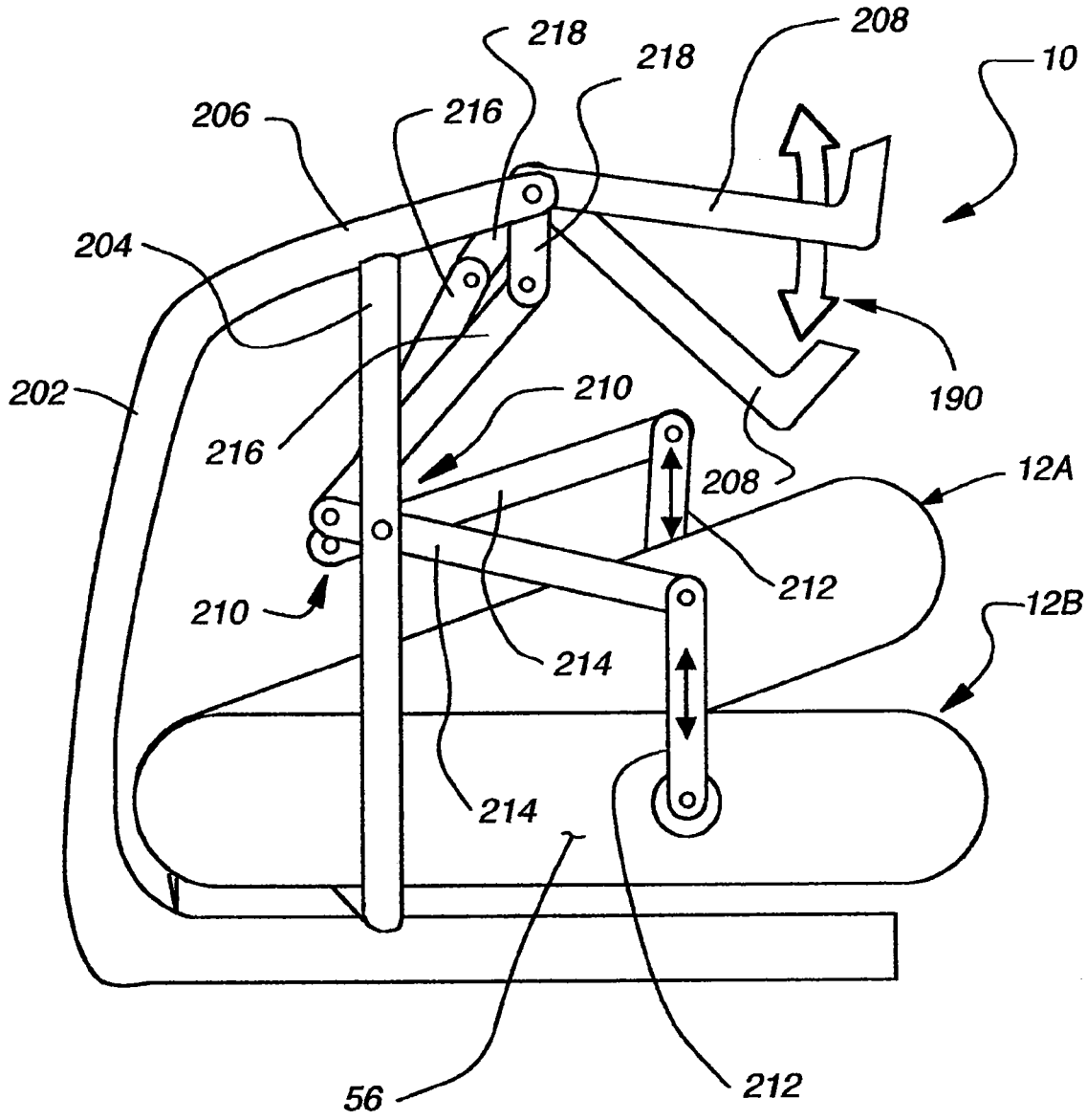
FIG. 26 is a side view of a third embodiment of an exercise device employing an upper body exercise assembly.

FIG. 26 depicts a third embodiment of a dual-deck exercise device 10 employing an upper body exercise structure 190. In this embodiment, uprights (202, 204) extend upwardly adjacent the rear outside of each treadle. A cross member 206 extends between the top of each upright. A handle 208 is pivotally coupled with the front region of the cross member. The handle extends forwardly from the cross member generally above and parallel with the outside edge of the associated treadle. As such, during use, the handles are generally positioned to either side of the user.

The handlebars 208 are hingedly attached to the treadles (12A, 12B) by a variety of hinge joints and fixed-length members 210. In this arrangement, the upward pivotal movement of a treadle is associated with a downward pivoting of the associated handle. Further, the downward movement of a treadle is associated with the upward pivoting of the associated handle. As such, when a user presses downward on the handle it acts to pull upward, via the linkage assemblies 210, on the associated treadle. Further, when a user pulls upward on a handle it acts to push downward, via the linkage assemblies, on the associated treadle.

Each hinge assembly 210 includes a first member 212 coupled with the outside member (56, 54) of each treadle assembly. The first member extends upward and generally perpendicular the treadle assembly. A second member 214 is pivotally coupled with the first member. The second member extends generally rearward the first member. Finally, a third member 216 is pivotally coupled with the second member, distal the pivotal connection with the first member. The third member is also pivotally coupled with the handle 208. The handle includes a downwardly extending section 218 below the handle's pivotal connection with the cross member 206. The third member is pivotally coupled with the downwardly extending section. The members extend or contract around the hinge joints as a treadle raises and/or a handlebar lowers in order to maintain the operative connection between the two elements. Further, the members and hinge joints may be configured to permit the handlebar to move either towards or away from the treadle as the treadle moves upwardly or downwardly. Downward force on the handle 208 acts to rotate the downwardly extending section 218 rearward. The rearward movement of the downward section of the handle pushes both the third 216 and second 214 members rearwardly, which imparts an upward and rearward force on the first members 212. The forces on the first members 212 act to impart an upward force on the respective treadle. Conversely, the upward or downward forces on the treadle, acts to impart a downward or upward force, respectively, on the handles.

Figure 27:
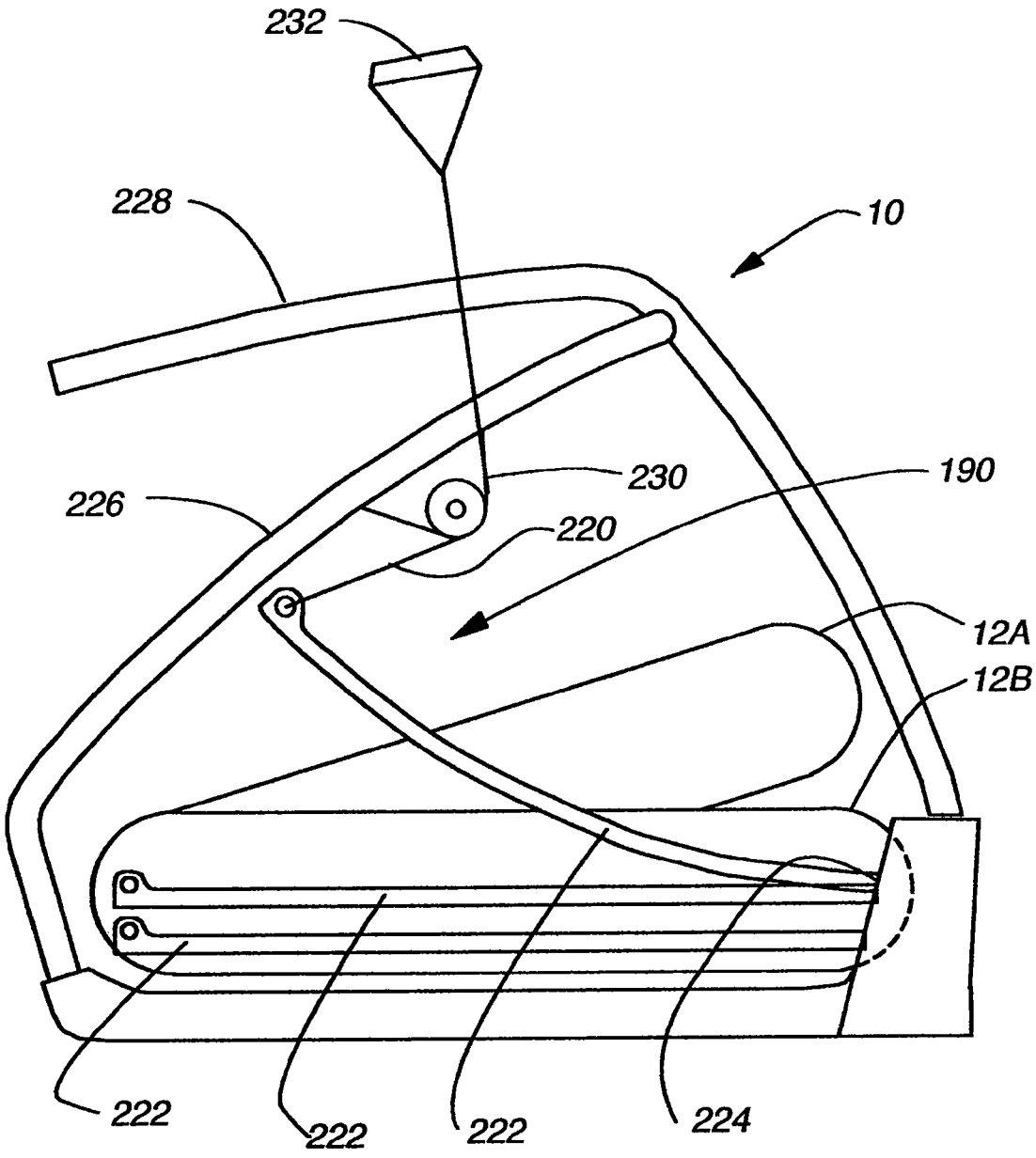
FIG. 27 is a side view of a fourth embodiment of an exercise device employing an upper body exercise assembly.

FIG. 27 depicts a fourth embodiment of a dual-deck exercise device 10 employing an upper body exercise structure 190. The upper body exercise structure includes a cable 220 coupled with a flexible resilient resistance member 222 or members. Pulling on the cable causes the resistance member to bend. One type of flexible resilient member that may be employed is the Bowflex Power Rod®. Resistance members, such as a Power Rod®, are similar to the resistance rods disclosed in U.S. Pat. No. 4,620,704, titled "Universal Exercising Machine," filed on Apr. 27, 1984, and U.S. Pat. No. 4,725,057, titled "Universal Exercising Machine," filed on Nov. 3, 1986, both of which are hereby incorporated by reference herein.

Embodiments conforming to aspects of the invention may employ one or more resistance members 222 to either side of the user. In the example shown in FIG. 37, the resistance members extend rearwardly from a frame section 224 at the front of the exercise device. The rods are arranged to the outer sides of each treadle, and are generally parallel with the side of the treadle. It is possible to orient the resistance members in other ways, such as vertically or laterally (like wings), etc., in order to provide a different upper body type exercise. For example, in an embodiment with the power rods oriented vertically to the front of the user, such as in FIG. 28, the user would exercise different muscles than with the power rods located below the user. Three resistance members are shown to each side of the respective treadles; however, any number of resistance members may be employed. The resistance members can have varying diameters and lengths. A user can connect a desired number of resistance rods with a hook connected with an end of the cable. Sufficient force applied to the resistance cable (resistance member) will cause the resistance rods connected thereto to bend, which imparts resistance against the cable force. Because the rods are resilient, when the force is lessened or removed from the resistance cable, the connected resistance rods will tend to be biased to return to a substantially straight orientation.

In the example exercise device of FIG. 27, handle structures 226 extend in a generally arcuate configuration between the front of the device and the rear of the device, at each side of the user. Additionally, a bar 228 extends rearward from an area near the upper apex area of the arcs formed by the handles. A pulley 230 is coupled to the handle structure. The pulley may be connected to any stable surface of the exercise device. Additionally, other structures may be added to the exercise device to support the pulley in different orientations, or to support multiple pulleys the cable is routed through the pulley, with one end of the cable including the hook or other fastening means to connect to the underlying resistance members 222 and the other end of the cable including a handle 232.

In use, the user grasps one or both of the handles, and pulls to actuate and bend the resistance member 222. Depending on the configuration of a resistance member, and number of resistance members hooked, differing amounts of force will be required to bend the member or members.

Figure 28:
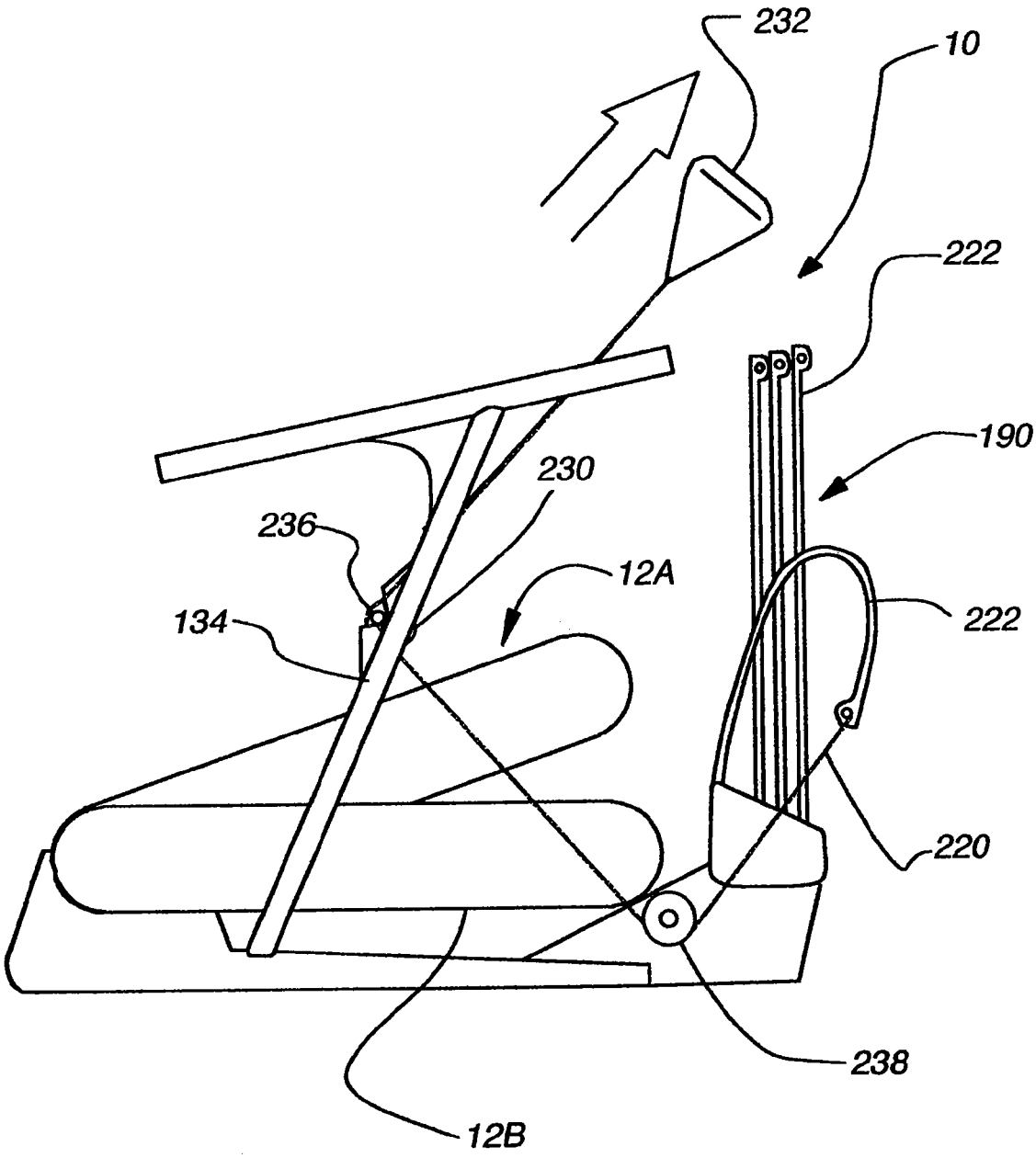
FIG. 28 is a side view of a fifth embodiment of an exercise device employing an upper body exercise assembly.

FIG. 28 depicts an embodiment of a dual deck exercise device including an upper body exercise component 190 similar to that shown in FIG. 27, but with the flexible resilient resistance members 222 located vertically and to the front of the exercise device 10 and with a differently arranged handle structure. A cable 220 and pulley arrangement to the outside of each treadle is employed. With reference to the right side of the exercise device, a pulley 230 is supported on an upright 234 that extends upwardly from the frame and to the outside of the right treadle 128. The upright pulley may include a second pulley 236 that captures the cable so that the cable may be pulled in a variety of directions employing an upper body exercise assembly without disengaging from the pulleys. Further, a second pulley 238 is supported on the frame below and slightly forward of the front of the right treadle.

A set of resistance members 222, in this case a set of resilient flexible members, such as a Power Rod®, extend upward from the frame in front of the treadles. There is a set of resistance members for each cable and pulley arrangement. The cable 220 is routed through the pulleys (230, 238), with one end having a hook to connect with one or more resistance members, and the other end having a handle 232. When the user grasps the handle and pulls, force is transferred by way of the cable to bend the one or ore resistance members. When the force is lessened or removed, the resistance member straightens into its original shape. Again, the number of pulleys and the positioning of the pulley(s) may be arranged to provide any number of different upper body exercises. Further, the pulley (230, 236) may be movably connected with the upright 234 or frame to allow for adjustment of the upper body exercise.

Figure 29:
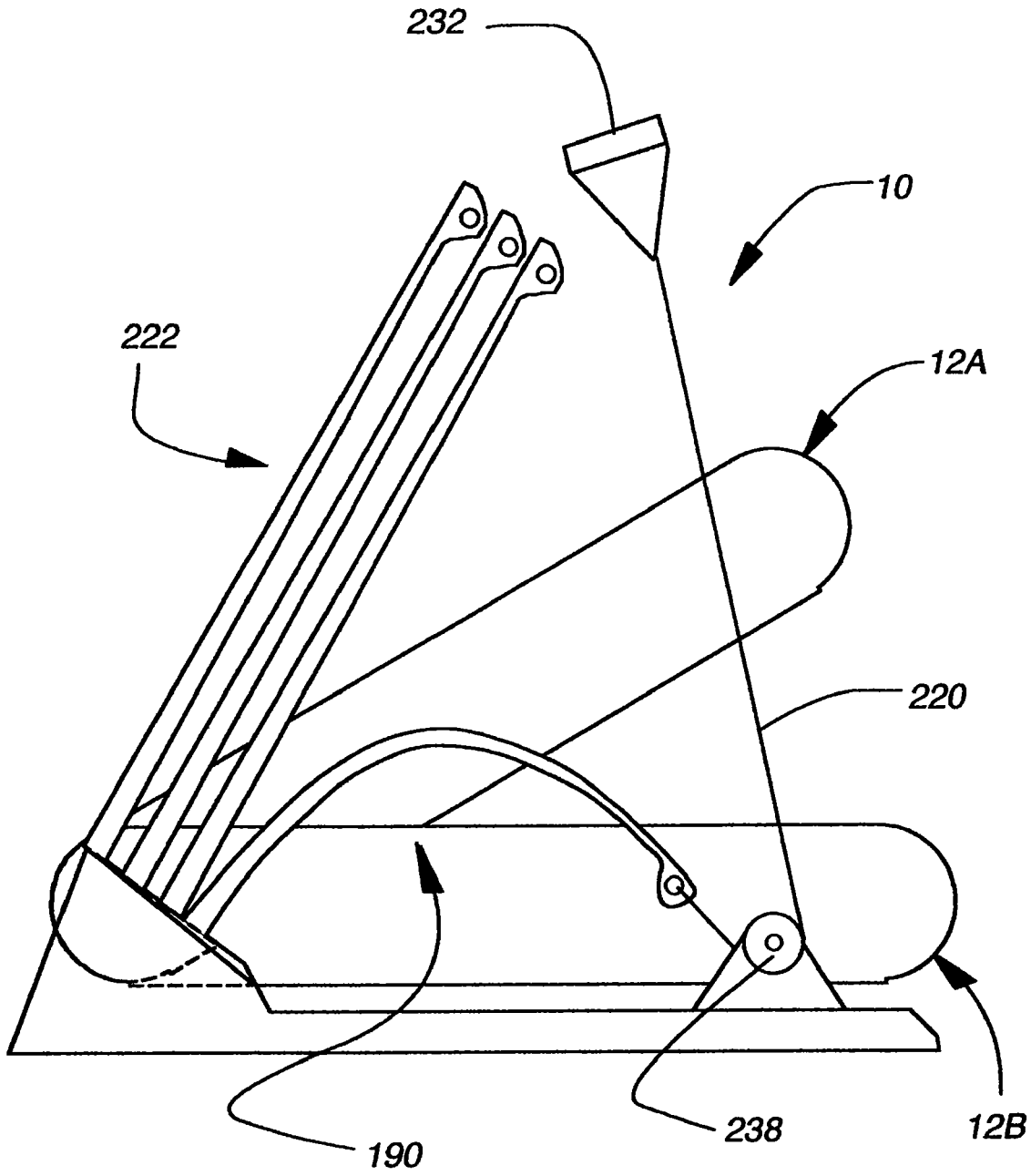
FIG. 29 is a side view of a sixth embodiment of an exercise device employing an upper body exercise assembly.

FIG. 29 depicts an embodiment of a dual deck exercise device 10 similar to that shown in FIGS. 27 and 28, but with the flexible resilient resistance structures 222 arranged generally vertically and to the rear of the exercise device. There is a separate set of resistance members located to the outside rear of each treadle (12A, 12B). In this example, like others, PowerRod® technology may be used for the resistance structures. Further, there is pulley cable arrangement to the outside of each treadle and adapted for coupling with the respective resistance members. Referring to the right side of the device, a pulley 238 is attached to the frame near the front lower side of the right treadle. A cable 220 is routed around the pulley. The cable includes a hook or other fastening device for attaching to the resistance members. The opposite end of the cable includes a handle 232. The user grasps the handle pulls to impart a force on the resistance member(s). As such, the user may obtain an upper body exercise.

Figure 30:
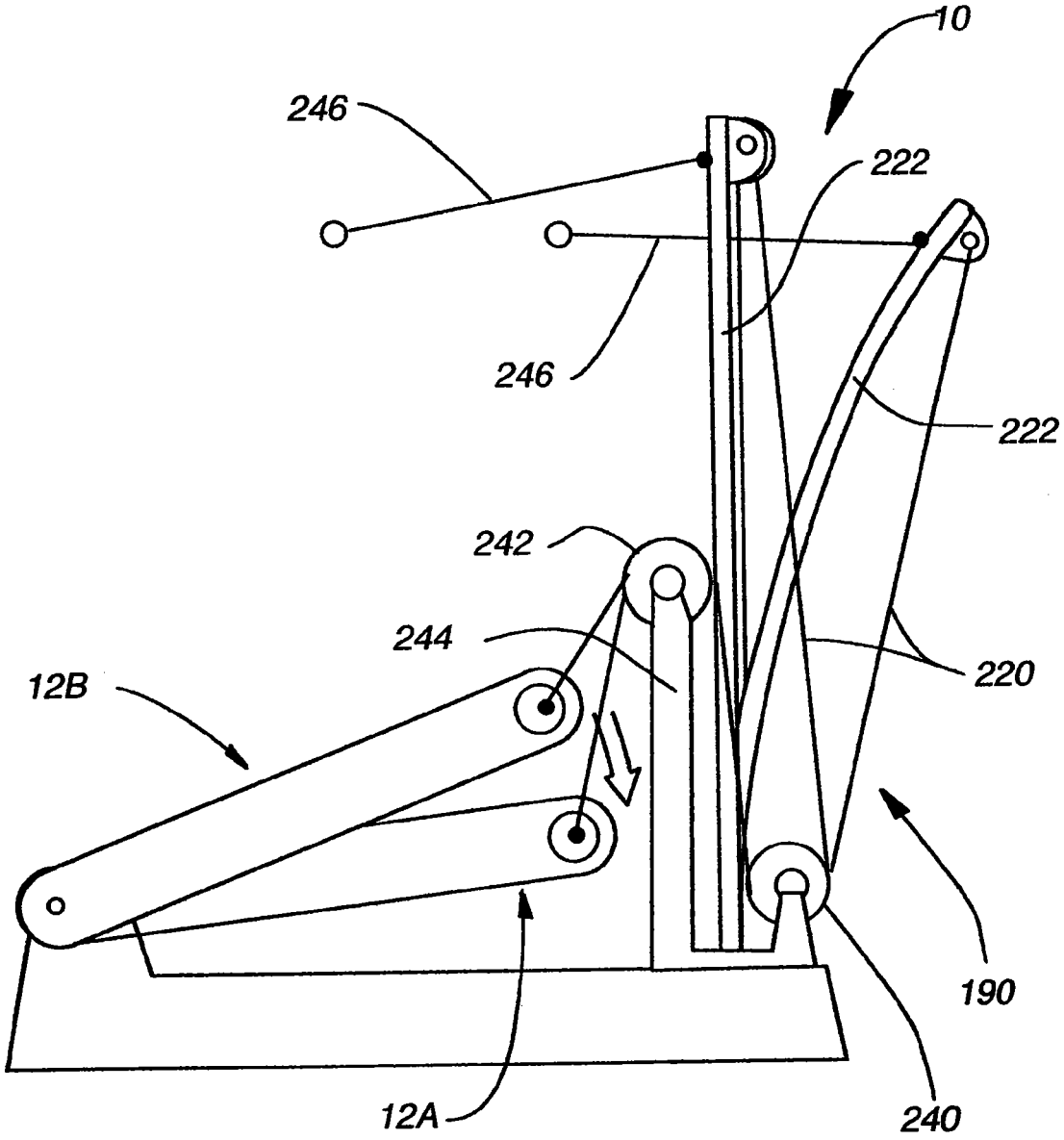
FIG. 30 is a side view of a seventh embodiment of an exercise device employing an upper body exercise assembly.

FIG. 30 depicts another embodiment of a dual-deck device 10 employing an upper body exercise assembly 190 including resistive elements and a pulley system. This embodiment couples the resistive elements 222 (e.g. PowerRod®) to the treadles, rather than handlebars. As such, the resistive member may be characterized as a "resistance element" as that term is defined above. The resistance members 222 are vertically oriented and coupled with the frame to the front of the treadles. With respect to the right side, a first pulley 240 is coupled to the frame slightly forward and below the right set of resistance members. A second pulley 242 is arranged on a pedestal 244 rearward the resistance members, and forward the right treadle. A cable 220 is routed from the top of the resistance member(s) through the pulleys and to the front or side of the respective treadle. Each treadle is coupled in the same way to same basic arrangement of a pulley, cable, and resistance element configuration. Downward movement or force of the treadles acts to bend the respective resistance members, and as such is resisted. Moreover, because the rods are resilient, when the force is lessened or removed from the resistance cable, the connected resistance rods will tend to be biased to return to a substantially straight orientation. As such, upward movement of the treadles is assisted by the resistance members. Thus, the resistance members perform both a treadle pivot resistance function as well as a treadle return function. The resistive element exerts force against a downward treadle motion, forcing the user to work harder to lower the treadle and enhancing a lower-body workout. Again, multiple resistive elements (each providing a different resistance level) may be employed.

Additionally, handles 246 may be pivotally coupled with the resistance members so that the user may pull back on the resistance members 222 or resist the forward pull on the resistance members. In such an embodiment, adequate clearance between the pedestal pulleys and respective resistance members would be required.

Figure 31:
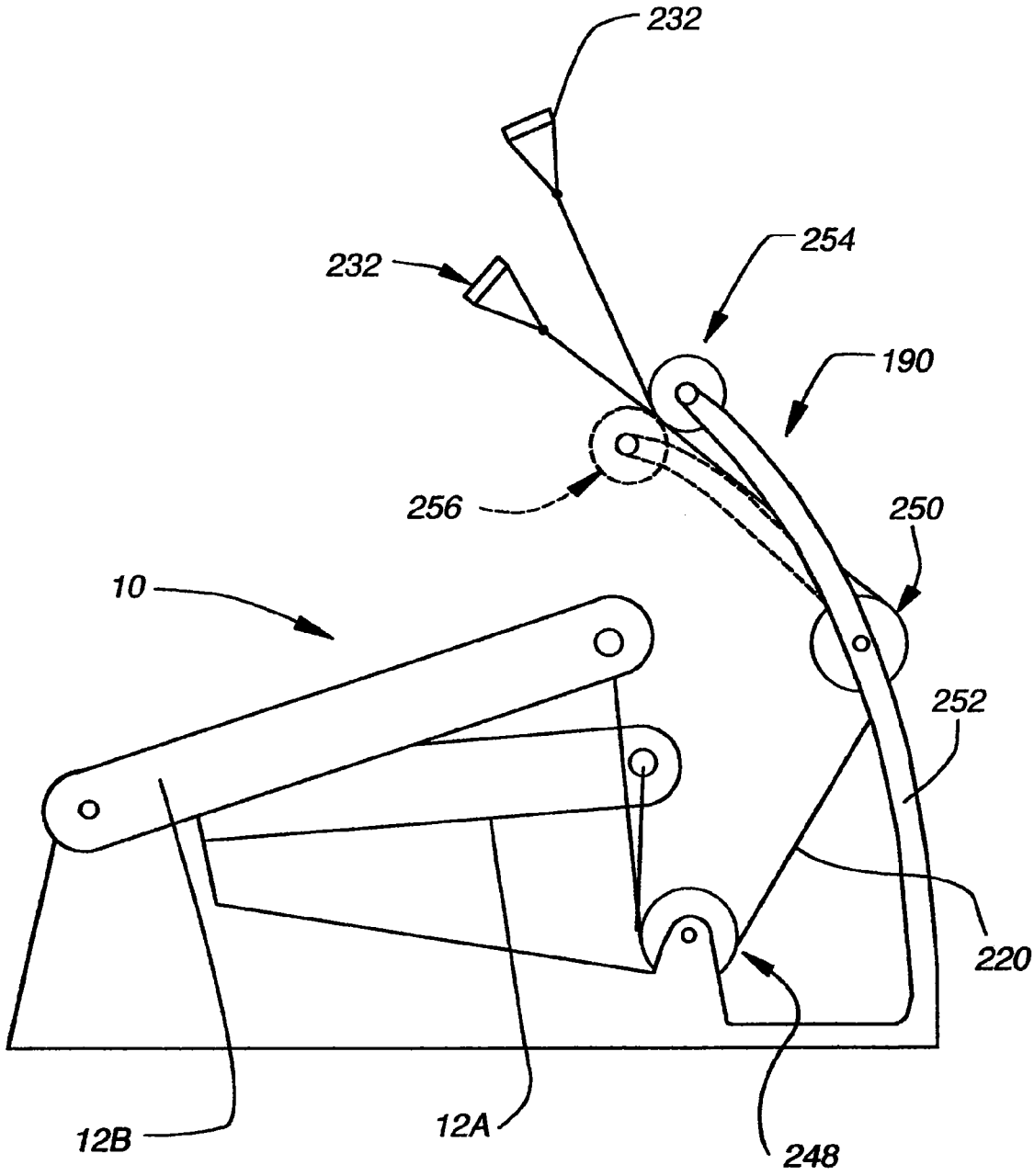
FIG. 31 is a side view of a eighth embodiment of an exercise device employing an upper body exercise assembly.

FIG. 31 depicts another embodiment of a dual-deck exercise device 10 employing an upper body exercise structure 190. In this example, the upper body exercise structure includes cables 220 routed through pulley arrangements and connected with each treadle. Each cable is fitted with a handle 232 at an end opposite the connection with the treadle. A pulling force on the cable acts to pivot the treadles downwardly. Further, upward pivotal movement of the treadles causes a pulling motion on the cable. In this example, a first pair of pulleys 248 is located below the front of each treadle, with one pulley below the left treadle and one below the right treadle. A second pair of pulleys 250, each pulley aligned with the respective lower pulleys, are coupled with an upstanding frame member 252 located to the front of the treadles. Finally, a third set of pulleys 254, each pulley being aligned with the lower respective pulleys 254, is located at the top of the upstanding member. The sets of pulleys guide a corresponding set of cables 220 between the bottom or each treadle to a location in front of a user on the device. The third set of pulleys may include a set of cable retaining pulleys 256 (shown in dash) immediately below the upper third pulleys. Arranged in this manner, a cable is coupled with the lower framework of each treadle. The cables are routed through a corresponding set of pulleys.

Handles are coupled to ends of the pulleys extending from the third set of pulleys.

For upper body exercise, the user may grasp the handles and pull on the cables, which will impart a downward force on the associated treadles. Alternatively or additionally, the user may grasp the handle and resist the pull on the cable caused by the downward movement of the treadles.

Figure 32:
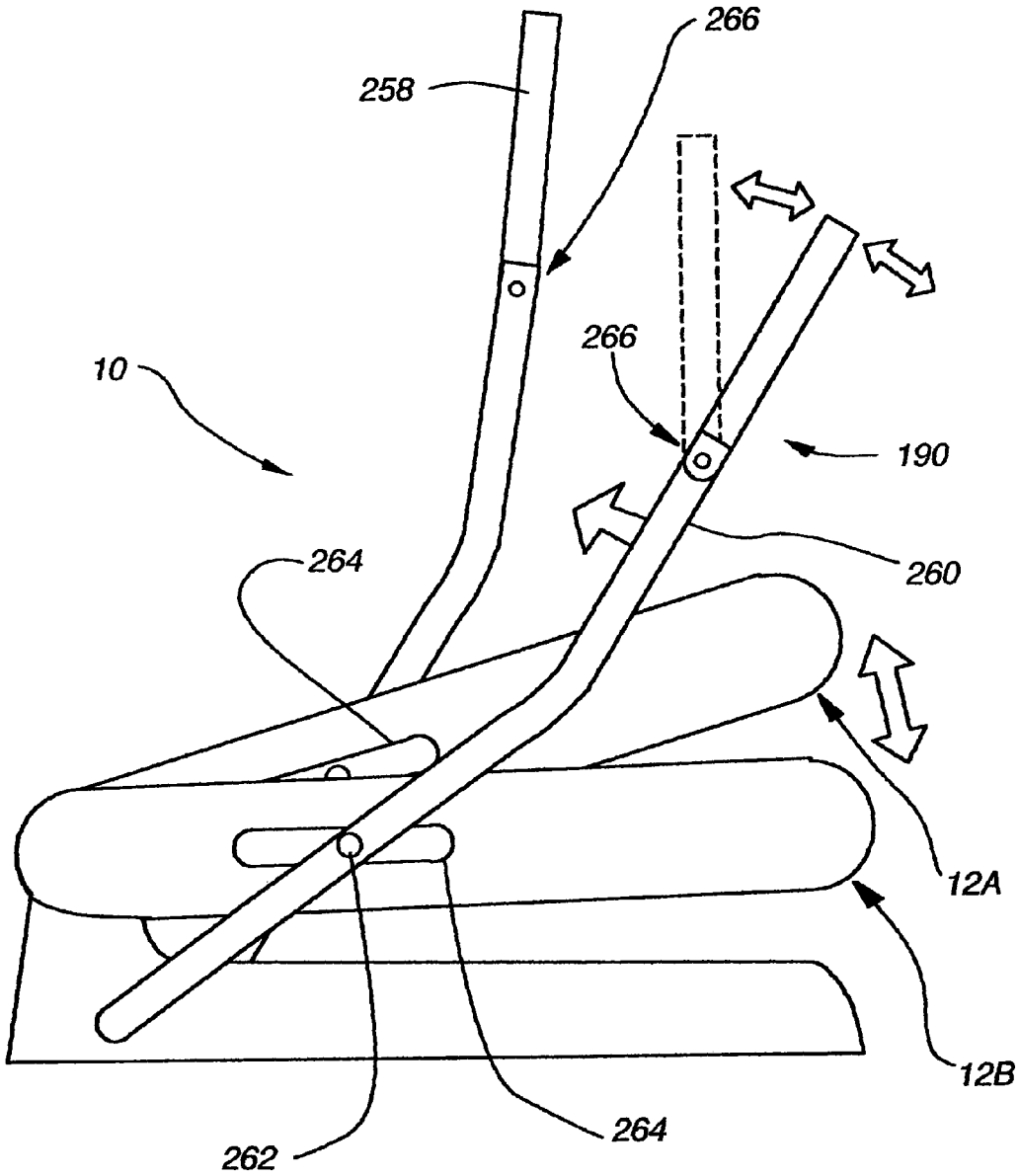
FIG. 32 is a side view of a ninth embodiment of an exercise device employing an upper body exercise assembly.

FIG. 32 depicts yet another embodiment of a dual-deck exercise device 10 employing an upper body exercise structure 190. In this example, the upper body exercise structure includes a first 258 and second 260 handle pivotally coupled with the frame below the rear of each respective treadle. The handles extend upwardly and forwardly to the outside of the respective treadle. Each handle may be attached to a treadle by a pin 262 extending through the handle and resting in a slot 264 defined in a side member of each treadle. As a handle moves forwardly or rearwardly, the pin slides along and within the slot, in a back-and-forth motion. The handles are pivotally supported at one location. Thus, each handle moves through an arcuate path with both a vertical and horizontal component. The vertical component acts on the slot or is acted on by the slot.

The handles (258, 260) may include a lock pivot 266 located between the free end of the handle and the pin-and-slot arrangement. The lock pivot permits the upper portion of the handle to occupy a variety of positions. For example, the upper portion of the handle may be pivoted through approximately a ninety degree angle, in one example, with respect to the portion of the handle extending downwardly from the lock pivot. The upper handle portion may be frozen at any angle within this range of motion, although alternate embodiments may only permit the upper handle portion to occupy discrete positions within the range.

During use, the user grasps the handle (258, 260) and presses or pulls to impart a back-and-forth movement to the handles. As the handles are coupled with the treadles in the slots 264, a force is exerted between the treadles (12A, 12B) and the handles. By grasping the handles, a user may resist the force or add to the force, as the case may be, and depending on the direction of force being applied at the handles by the user and between the treadles and the handles. The exercise resistance at the handles can also be a function of the type of resistance element coupled with the treadles. Various resistance elements or structures configured to impart a resistance force on the pivotal movement of the treadles are discussed herein and in the various applications incorporated by reference herein.

Figure 33:
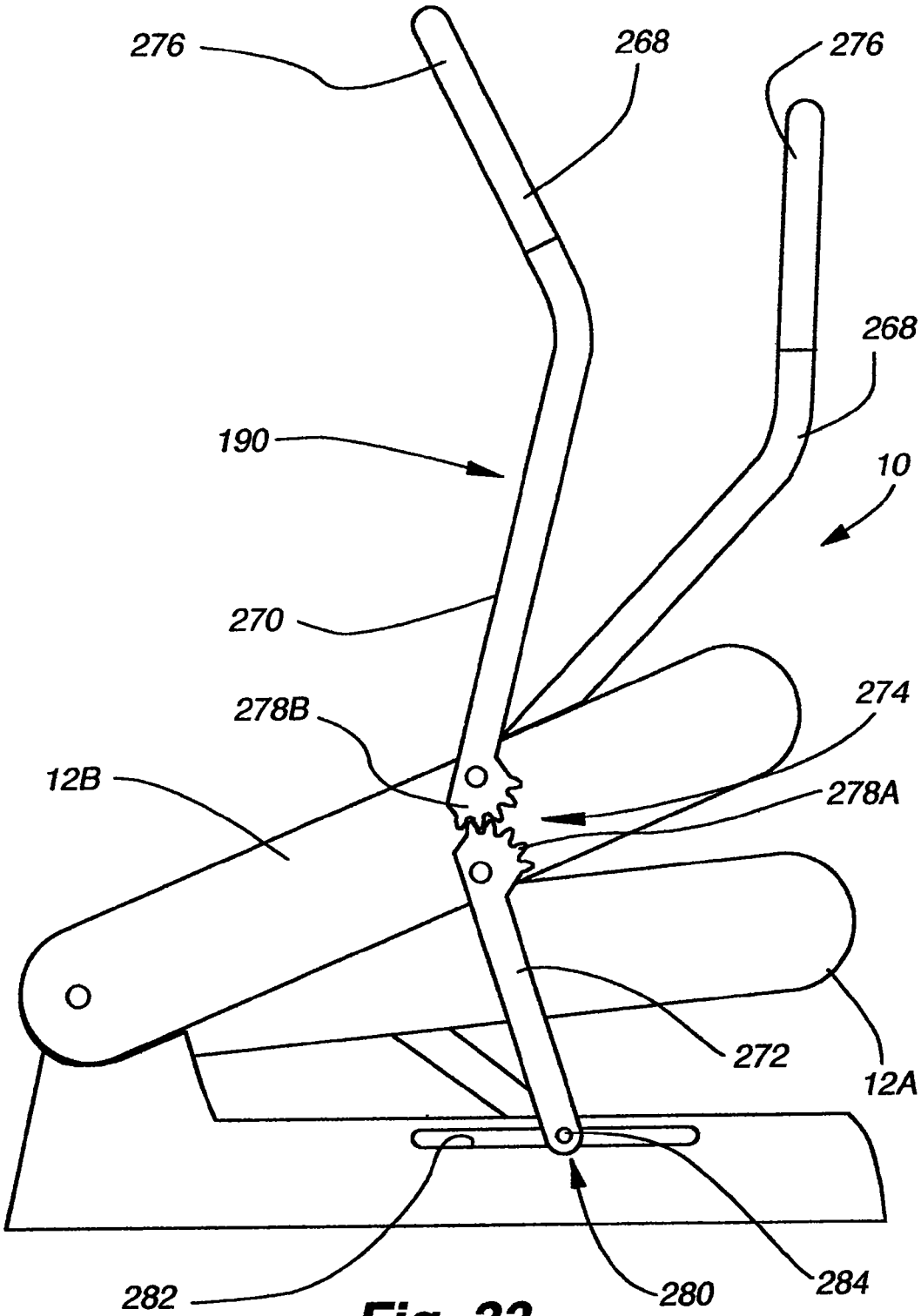
FIG. 33 is a side view of a tenth embodiment of an exercise device employing an upper body exercise assembly.

FIG. 33 depicts a tenth embodiment of a dual-deck exercise device 10 having an upper body exercise structure 190. The upper body exercise structure includes handles 268 that the user may grasp and either push or pull for upper body exercise. The handles include an upper 270 and lower segment 272 joined by toothed gears 274. The upper segment is pivotally coupled with the outside frame of each respective treadle. The upper end of the upper segment includes a gripping region 276. The lower end of the upper segment, below the pivot, defines an arcuate toothed surface 278 (i.e., a gear).

The lower segment 272 may include a pin-and-slot arrangement 280 similar to that described above with respect to FIG. 32. Here, however, the slot 282 is defined in a sidewall of the device frame. The lower end of the lower segment of the handle includes an axle 284 arranged in the slot. The lower end of the lower segment moves back-and-forth in the slot. The upper end of the lower segment is pivotally coupled with the treadle below the pivot for the upper segment. Further, the upper end of the lower segment, above the pivot, defines an arcuate toothed surface 278A arranged to engage the corresponding gear of the upper segment.

During pivotal motion the treadles, the lower segments 272 move back-and-forth in the slot 280. The back-and-forth motion of the lower end of the lower segment is accompanied by a rotational movement of the gear 278A above the pivot. Rotational movement of the lower segment gear imparts a corresponding rotational movement of the upper segment gear 278B. Further, the rotational movement of the lower gear pivots the handles 268 back and forth. As such, the user may perform upper body exercise by grasping the handles and pushing or pulling to resist or impart a force on the treadles.

Figure 34:
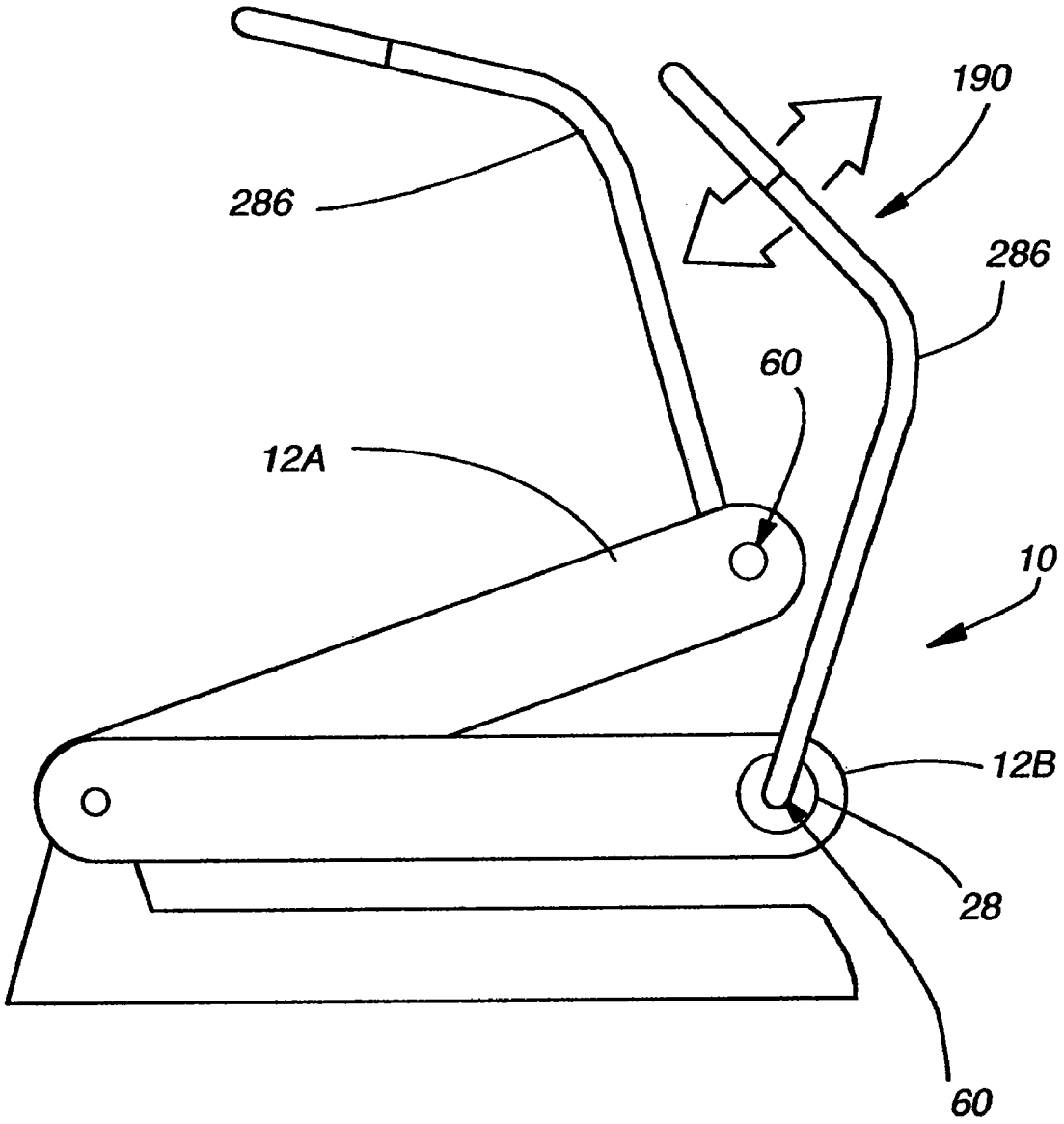
FIG. 34 is a side view of an eleventh embodiment of an exercise device employing an upper body exercise assembly.

FIG. 34 depicts another embodiment of a dual-deck exercise device 10 employing an upper body exercise feature 190. In this example, the upper body structure includes handles 286 coupled with the outside front of each treadle (12A, 12B). The handles may be fixed or pivotally coupled with the treadles. In a pivotally coupling, the pivotal movement may be restricted to a discrete back-and-forth range. Further, the pivotal arrangement may include a resistance member, such as a torsion spring, a shock pivotally coupled between the handle and frame, etc. In yet another alternative, the handles may be coupled with the front rollers 28 by way of a one-way bearing or ratchet-and-pawl assembly. As such, the handles may be employed to power or assist treadle belt motion (or vice versa).

Figure 35:
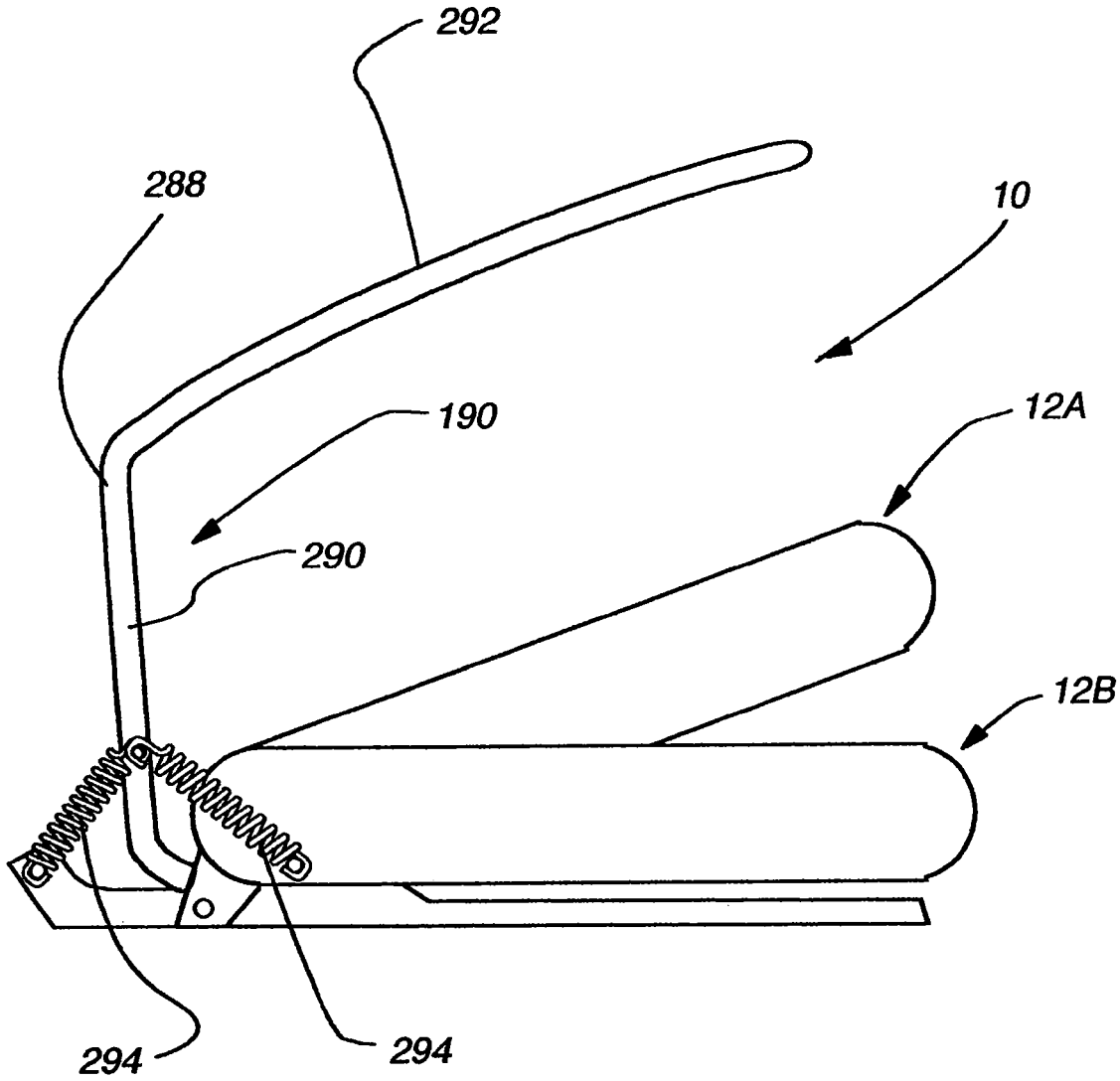
FIG. 35 is a side view of a twelfth embodiment of an exercise device employing an upper body exercise assembly.

FIG. 35 depicts yet another embodiment of a dual deck exercise device 10 employing an upper body exercise structure 190. In this example, a generally L-shaped handle member 288 is pivotally coupled to the rear of the exercise device. The handle includes a generally vertically oriented section 290, which is pivotally coupled with the frame. A generally horizontally oriented section 292 extends forwardly from the upper end of the vertically oriented section. The horizontally oriented sections of each handle are positioned above and to the outside of the respective treadle. Springs, shocks, or other resistance type members 294 may be attached to the vertical section of each handle. The resistance structures resist pivotal movement, either forward, backward, or both, of the vertical section of the respective handles. For upper body exercise, the user presses downward or pulls upward on the horizontal section of the handle. The upward or downward force on the horizontal sections translate to pivotal movement of the vertical sections 290, which is resisted by the resistance structures 294.

Figure 36:
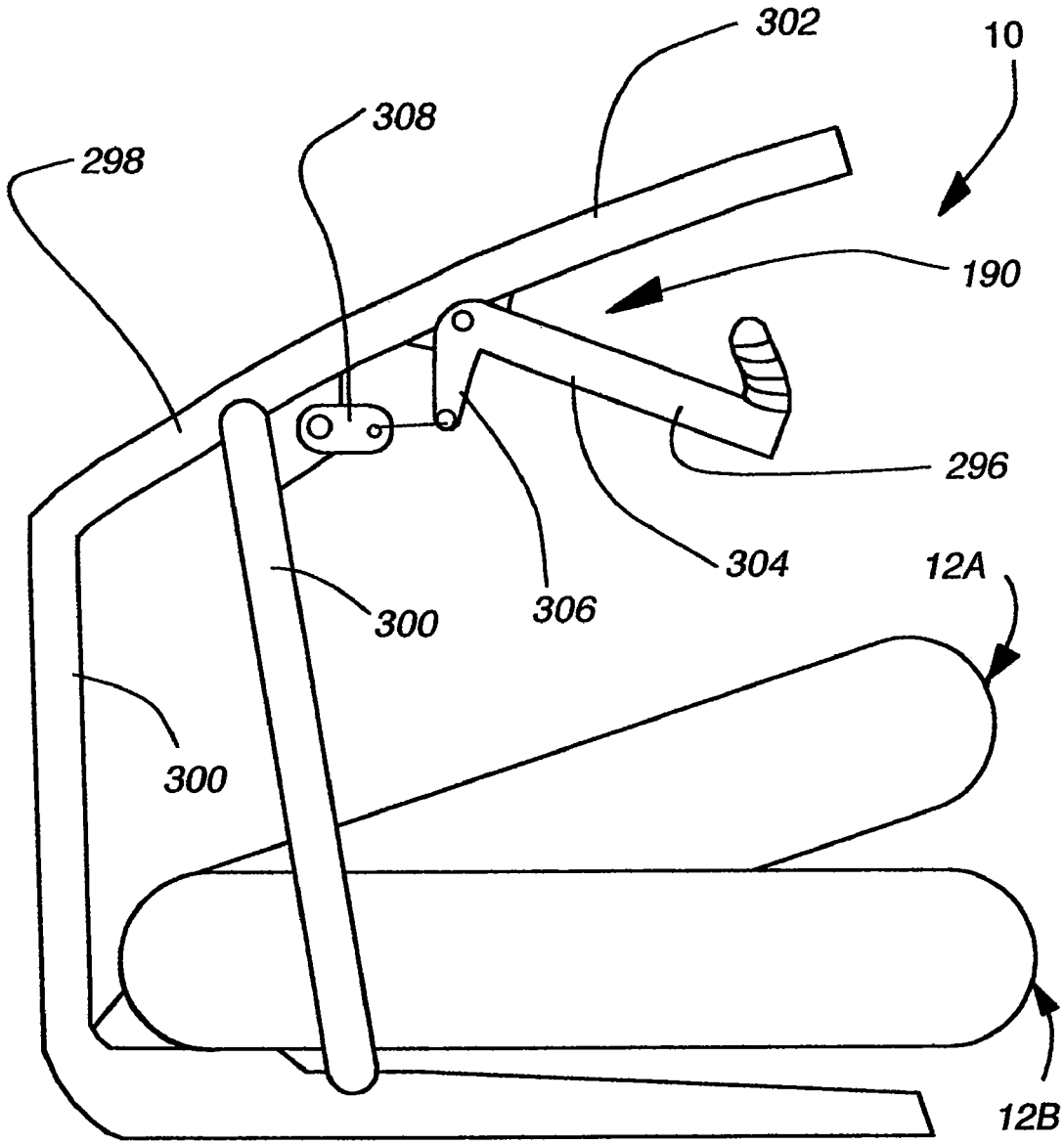
FIG. 36 is a side view of a thirteenth embodiment of an exercise device employing an upper body exercise assembly.

FIG. 36 depicts yet another dual-deck exercise device 10 embodiment employing an upper body exercise structure 190. The upper body exercise structure includes exercise handle structures 296 pivotally coupled with a fixed handle structure 298 to either side of the treadles (12A, 12B). With respect to the right fixed handle structure, it includes two vertical members 300 coupled with the rear portion of the frame. A generally horizontally beam 302 extends between the vertical members and forwardly therefrom. The beam angles upwardly from the rear, and is positioned above and to the outside of the respective treadle. The exercise handle 296 is generally L-shaped, and is pivotally coupled with the beam at the intersection of the two lengths of the L. The longer length 304 extends forward form the pivot. The shorter length 306 extends downward from the pivot. A shock 308 is coupled between the short length and the fixed handle structure. As such, the user performs upper body exercise by pushing downward or pulling upward on the long length of the exercise handle, which is resisted by the shock.

Figure 37:
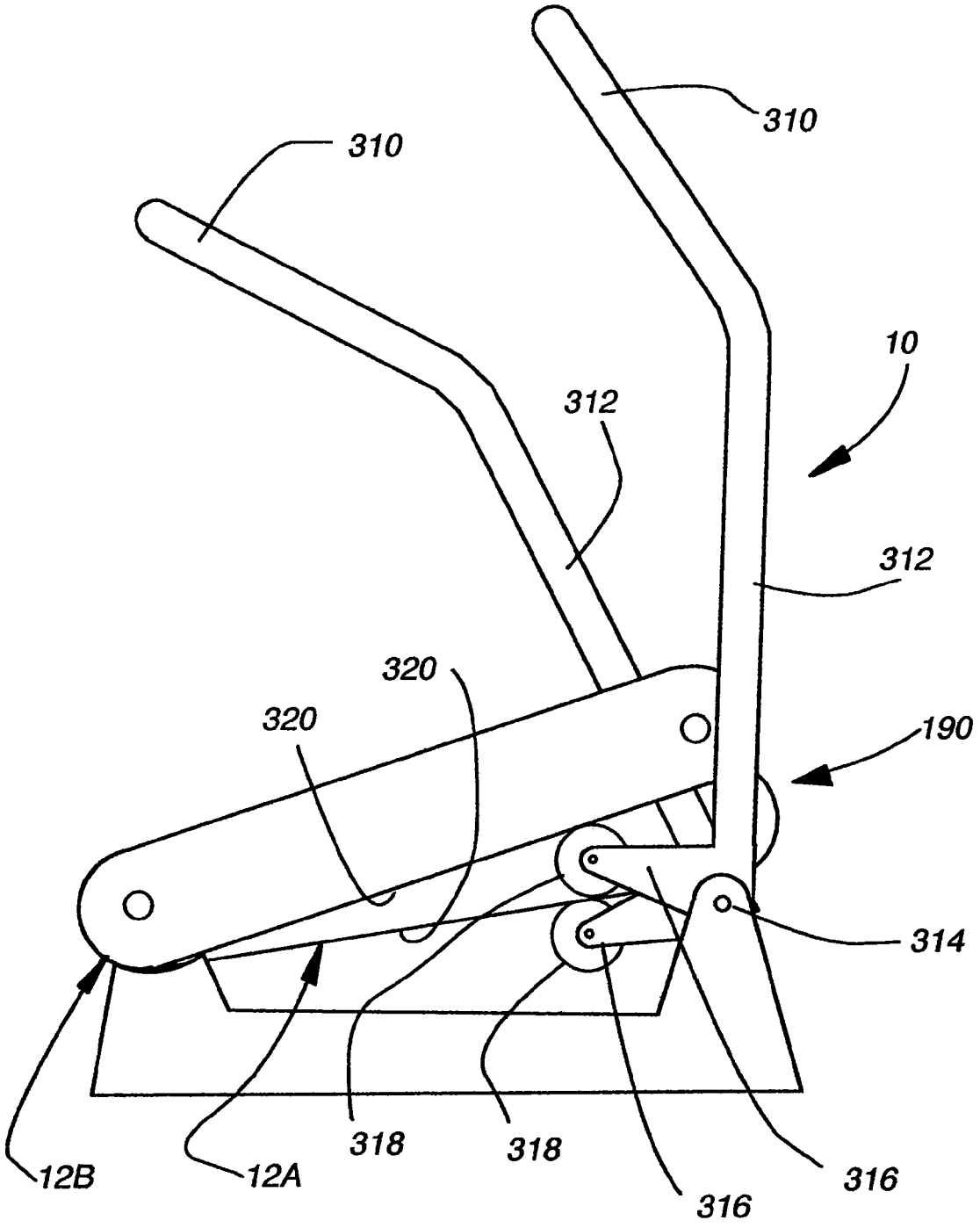
FIG. 37 is a side view of a fourteenth embodiment of an exercise device employing an upper body exercise assembly.

FIG. 37 depicts an alternative dual-deck exercise device 10 providing an upper body exercise 190, again using handles 310. In this embodiment, each handle is generally L-shaped, with an elongate length 312 extending upward from a pivotal connection 314 to the frame. The pivotal connection for each handle is forward the front of each respective treadle (12A, 12B). The shorter length 316 of the handle extends rearwardly from the pivotal connection.

A wheel 318 protrudes from the rearwardly extending sections 316. Each wheel is arranged below a respective treadle. The wheel is adapted to engage the underside of the treadles, and roll back and forth thereon. To support the rolling engagement of the wheels, the bottom of the treadles may be fitted with an appropriate plate 320 or channel. Downward movement of the treadle causes the wheel 318 to roll backward, which causes the vertical handle section 312 to move rearwardly. Further, forward force on the handle imparts an upward force on the treadle, by way of the wheel. If the wheel is captured in a channel or other structure on the bottom of the treadle, then downward movement of the treadle causes the wheel to roll backward and upward movement causes the wheel to roll forward, which imparts rearward and forward movement, respectively, on the vertical handle section. Further, if the wheel is captured in a channel or other structure on the bottom of the treadle, forward force on the handle imparts an upward force on the treadle, by way of the wheel 318, and rearward force on the handle 310 imparts a downward force on the treadle (12A, 12B), also by way of the wheel. As such, the user may perform upper body exercise by pulling and/or pushing on the vertical portion 312 of the handle.

FIGS. 38-45 illustrate various embodiments of an exercise device employing one or more flywheels to impart rotational momentum to the tread belts. These embodiments may be used with a motor or without a motor. As such, the flywheel may add or enhance movement of the tread belts.

Figure 38:
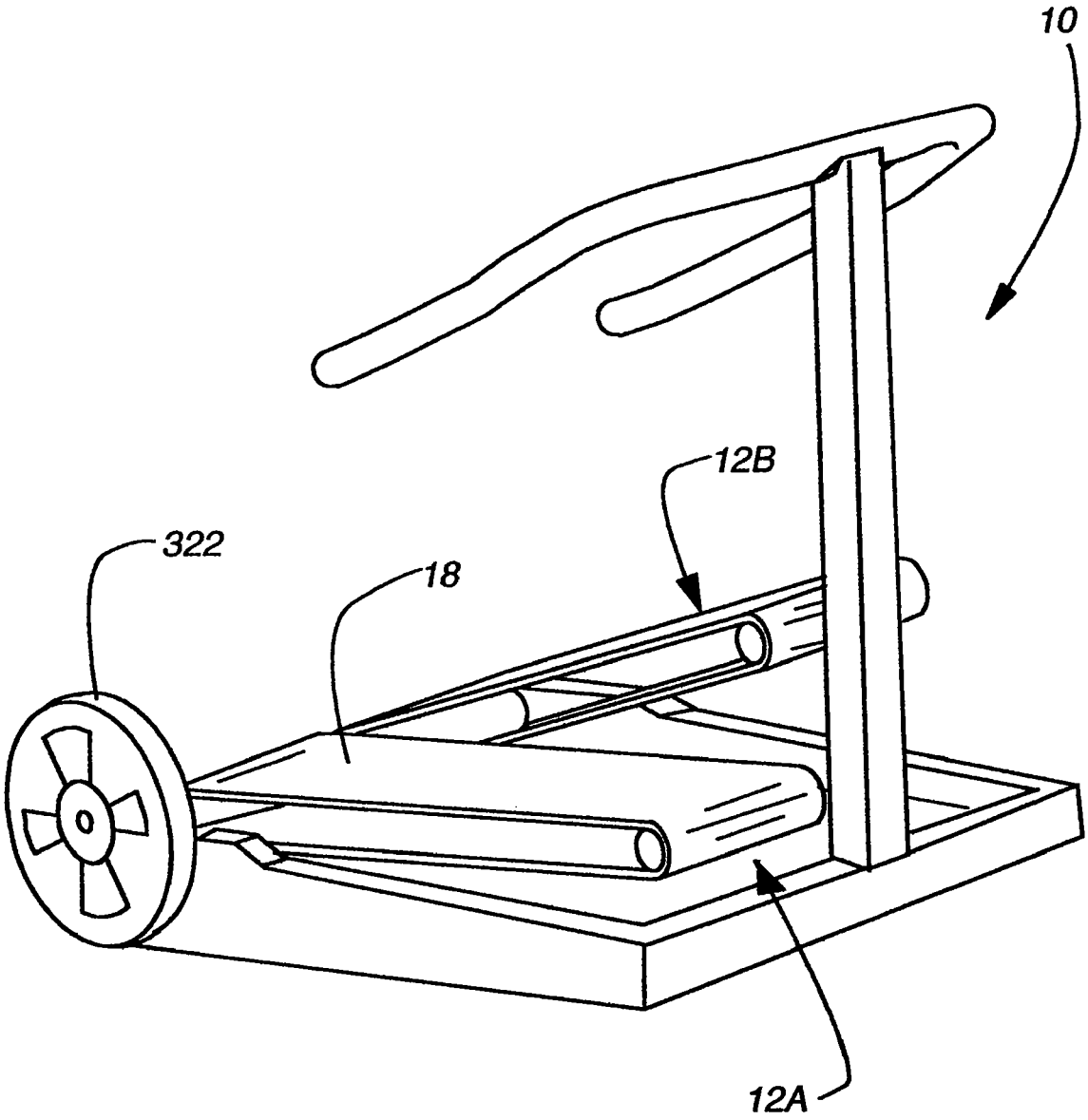
FIG. 38 is a side view of a first embodiment of an exercise device employing a flywheel operably coupled with tread belts supported on each treadle assembly.
Figure 39:
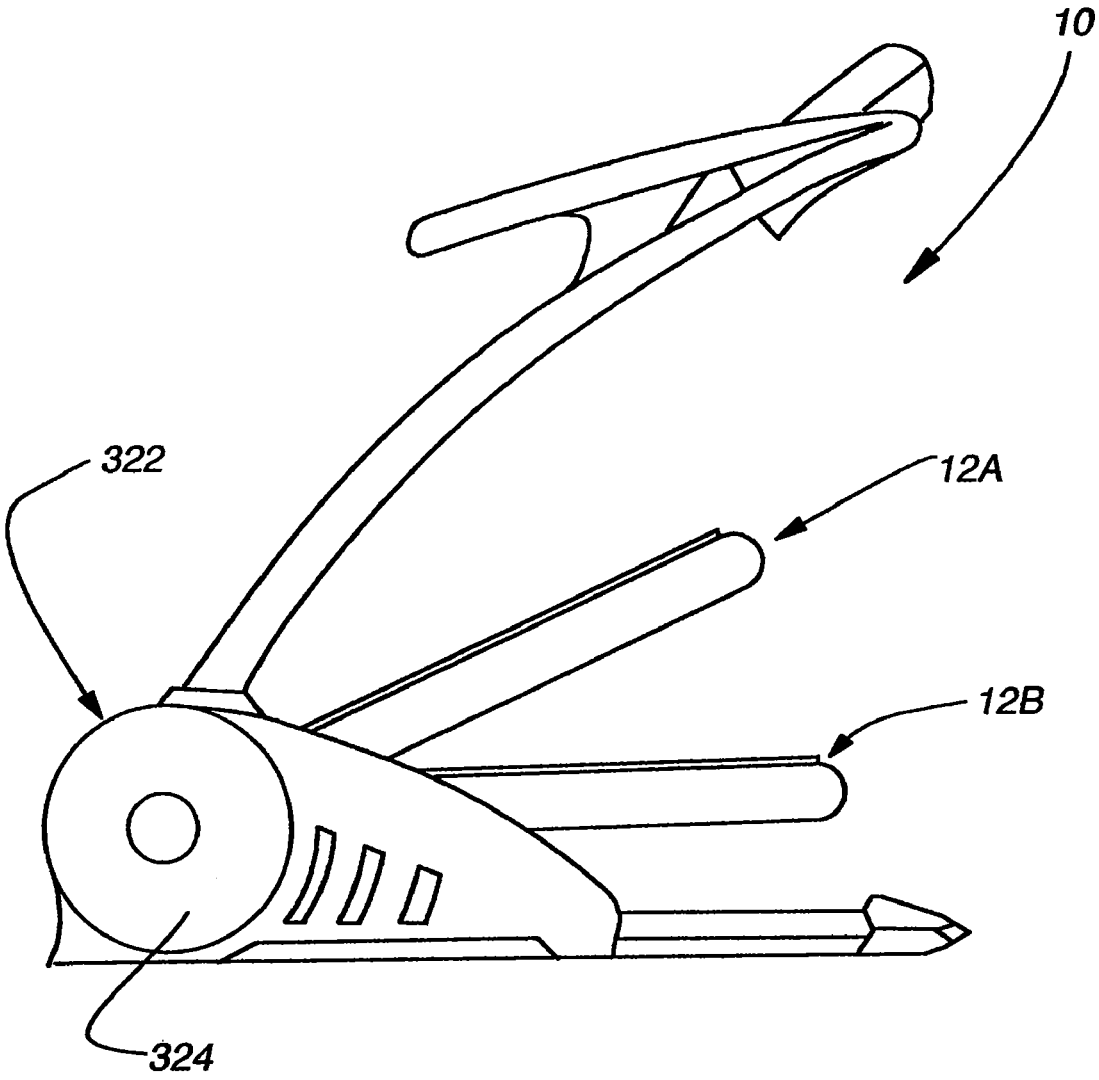
FIG. 39 is a side view of a second embodiment of an exercise device employing a flywheel operably coupled with tread belts supported on each treadle assembly.
Figure 40:
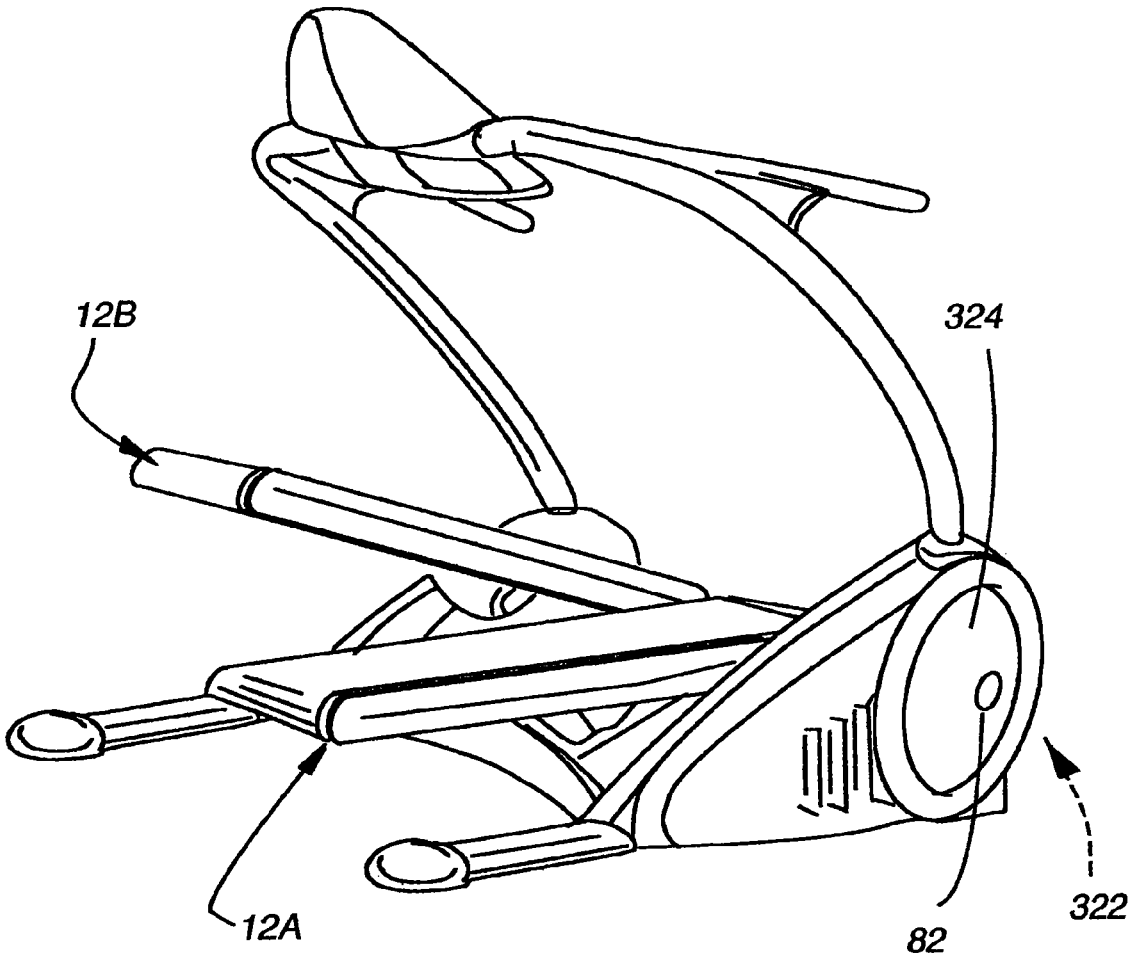
FIG. 40 is a side view of a third embodiment of an exercise device employing a flywheel operably coupled with tread belts supported on each treadle assembly.

FIG. 38 is an isometric view of a dual deck exercise device 10 having a flywheel 322 coupled with the rear axle 82. In this example, the rear axle extends outwardly from either the left or right roller 30, and also beyond the respective drive bracket 84A or 84C. The flywheel is coupled with the outwardly extending section of axle. When the user first begins walking on the belts 18, the belts will impart a rotational movement to the rollers, which in turn rotates the rear axle. Initially, the user will have overcome the rotational resistance from the flywheel. However, as the flywheel begins to rotate, its angular momentum will rotate the roller and thus cause the tread belts to move. FIGS. 39 and 40 illustrate an alternative dual deck exercise device having a flywheel 322 coupled with the rear axle 82 to impart a drive force on the tread belts. The FIGS. 39 and 40 embodiment functions in the same manner as FIG. 38. In this example, the flywheel is covered in a shroud 324 that shields the user from inadvertently contacting the flywheel while it is rotating.

Figure 41:
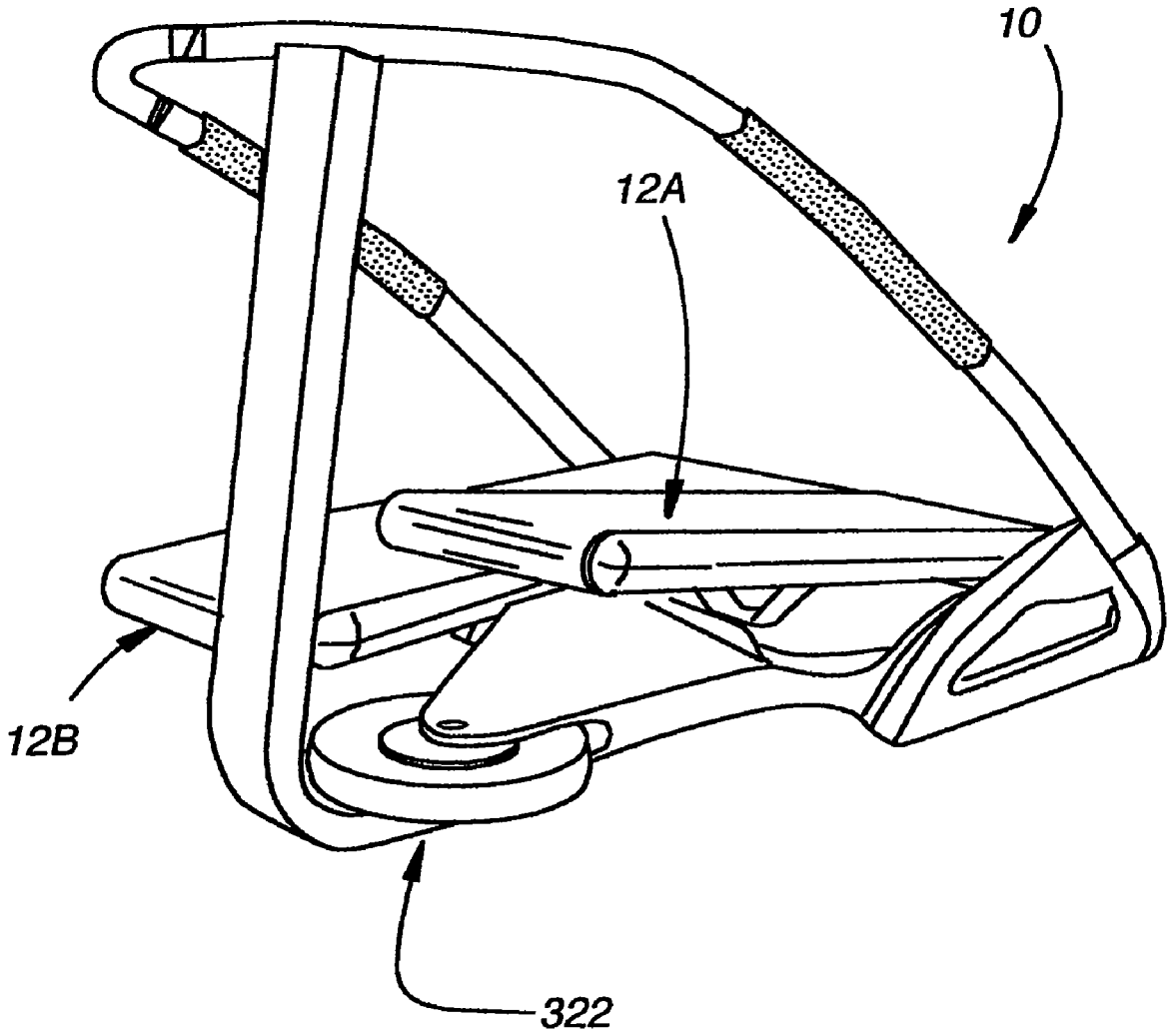
FIG. 41 is a side view of a fourth embodiment of an exercise device employing a flywheel operably coupled with tread belts supported on each treadle assembly.
Figure 41A:
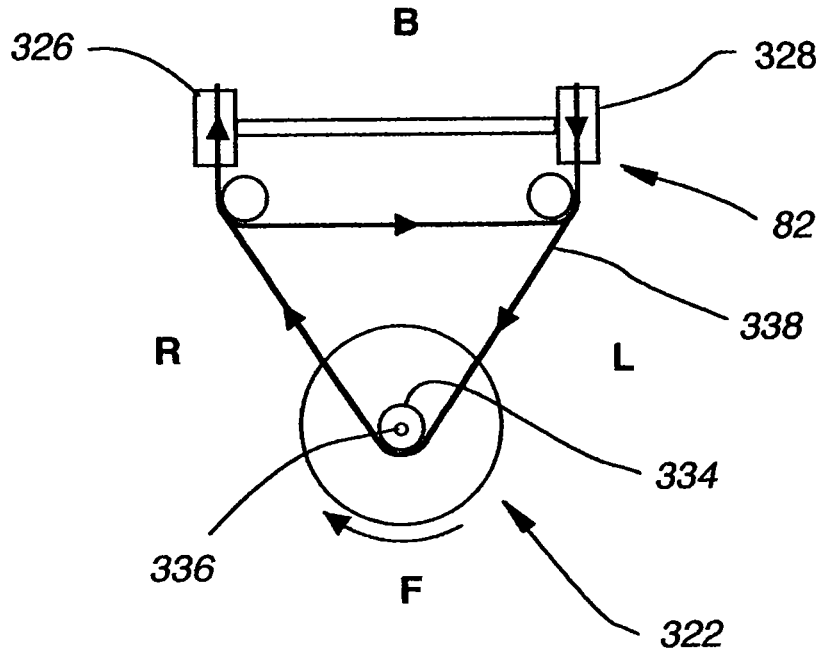
FIGS. 41A, 41B, and 41C are a top view, right side view, and left side view, respectively, of a pulley arrangement for coupling the flywheel of FIG. 41 with the tread belts.
Figure 41B:
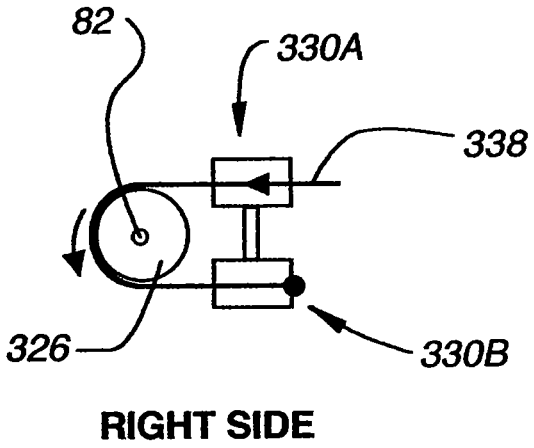
Figure 41C:
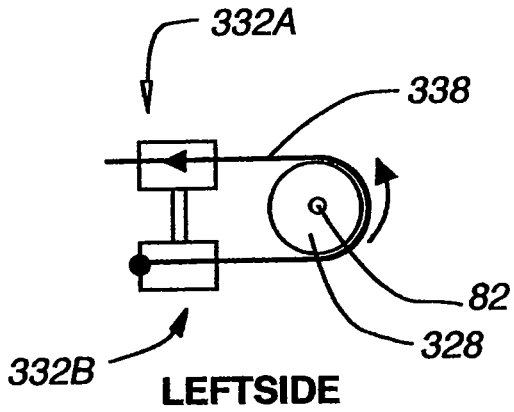

FIG. 41 is an isometric view of a dual deck exercise device 10 having a flywheel 322 rotationally supported on the frame below the treadles. The flywheel is oriented to rotate in a generally horizontal plane. FIGS. 41A, 41B, and 41C illustrate one example of a pulley arrangement for coupling the flywheel 322 to the rear axle 82 and thereby imparting angular momentum to the tread belts during use. FIG. 41A is a top view of the pulley arrangement, FIG. 41B is a right side view of the right side pulleys, and FIG. 41C is a left side view of the left side pulleys. Axle pulleys (326, 328) are coupled at the outside end regions of the rear axle. The pulleys may be coupled to the axle in generally same manner as the drive pulley 86. A pair of cable routing pulleys (330, 332) are located forwardly of each axle pulley. The cable routing pulleys are positioned in a plane perpendicular to the plane of the axle pulleys. Finally, a pulley 334 is also located at the top of the flywheel 322 and is coupled with a flywheel axle 336.

The cable (or belt) 338 is routed in a serpentine manner around all of the pulleys so that it couples the rotation of the flywheel 322 with rotation of the rear axle 82, and hence rotation of the treads 18. The cable extends rearwardly from the flywheel pulley 334 to the top right routing pulley 330A. From the top right routing pulley, the cable extends over and around the right axle pulley 326. The cable extends from the bottom of the right axle pulley to and around the lower right rotating pulley 330B. From the lower right routing pulley the cable extends to the bottom left routing pulley 332B. From there, the cable is routed under the left axle pulley 328, around and to the top left routing pulley 332A. From the top left routing pulley the cable extends back to the flywheel axle pulley 334. With this routing, when a user begins to walk forward on the tread belts, force is imparted to the rear rollers and rear drive axle 82. Through the cable and pulley arrangement, the flywheel 322 begins to rotate in a clockwise direction. Once sufficient angular momentum is established, tread belt rotation will be driven to some extent by the flywheel, subject to user input, and whether or not a motor is also coupled with the axle.

Figure 42:
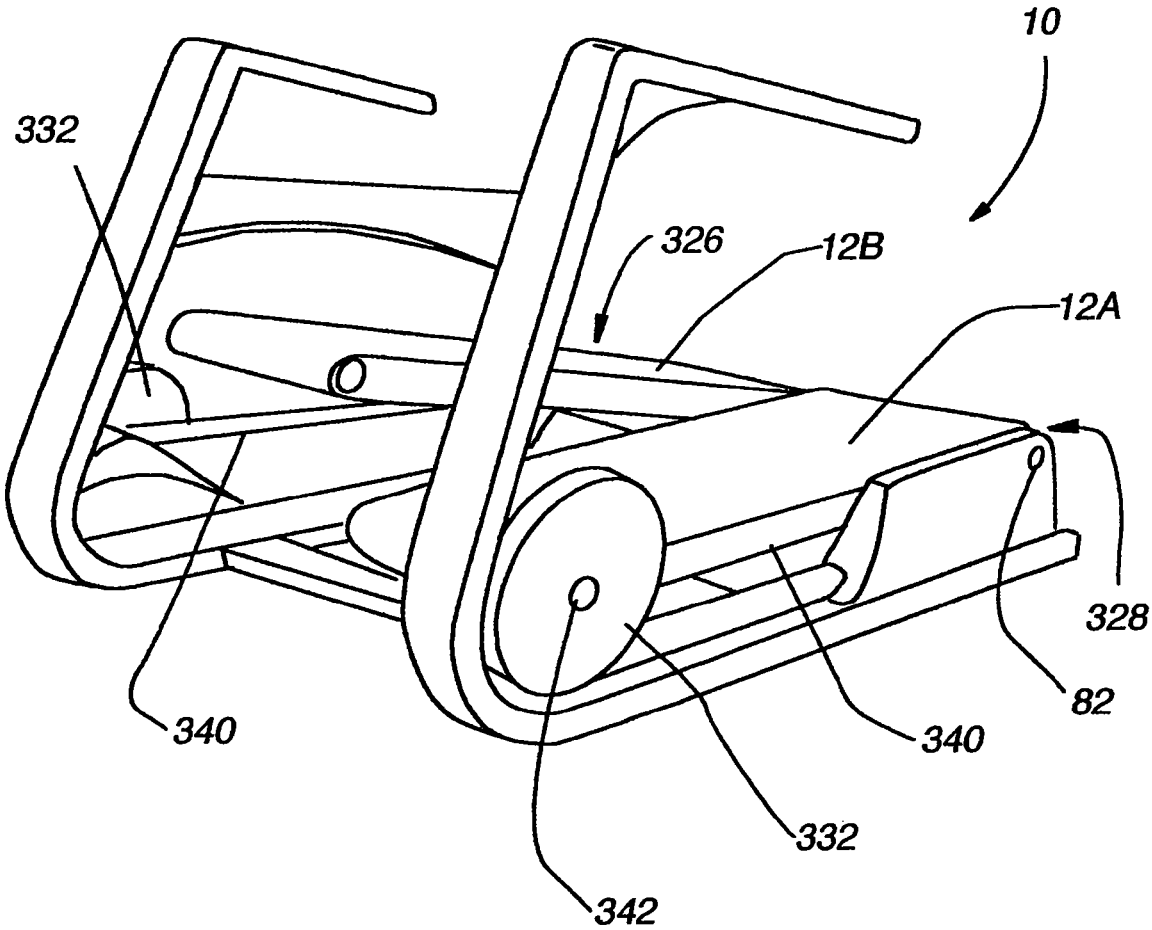
FIG. 42 is a side view of a fifth embodiment of an exercise device employing one or more flywheels operably coupled with tread belts supported on each treadle assembly.
Figure 43:
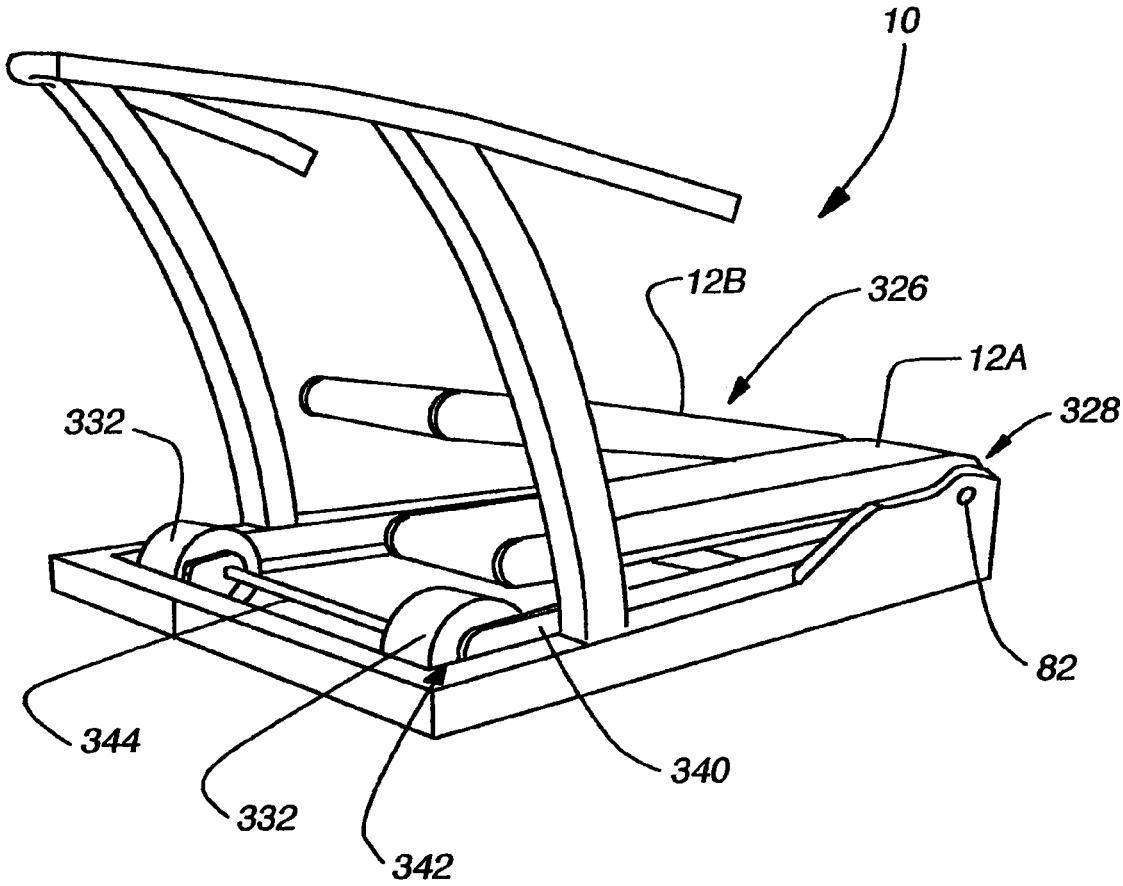
FIG. 43 is a side view of a sixth embodiment of an exercise device employing one or more flywheels operably coupled with tread belts supported on each treadle assembly.

FIGS. 42 and 43 depict further embodiments of a dual deck exercise device employing a flywheel 332 to assist in tread rotation. In both embodiments, flywheels are rotationally supported at the front of the exercise device to either side of the treadles. Each flywheel rotates in a vertical plane. Axle pulleys (326, 328), like those shown in FIG. 42A, are coupled with both outer ends of the drive axle 82. A belt 340 is secured between the left axle pulley 328 and a left flywheel pulley 342. The belt may be directly coupled, or may be routed under a third pulley (not shown) rearward of the flywheel 332. The third pulley is arranged to drop the belt into a lower profile orientation. The right side cable is routed in the same manner as the left. The flywheels of FIG. 43 have smaller diameter than the flywheels of FIG. 42, but have a greater thickness than the flywheel of FIG. 42. Further, the flywheels of FIG. 43 are supported on a common axle 344; thus, it would be possible to rotate both flywheels with only one axle pulley 328 and a cable 340 connecting the axle pulley to one of the flywheel pulleys 342.

As with other flywheel embodiments discussed above, the flywheels of FIGS. 42 and 43 are operably coupled with the tread belts of each treadle. When the user begins walking on the belts 18 (assuming the flywheels are not rotating), the rear roller or rollers begin to rotate, which causes the flywheels 322 to begin rotating by way of the cable/pulley arrangement coupling the rear axle 82 to the flywheels. When the angular momentum generated by the rotating flywheels 372 is coupled back to the treads in the same way, to cause the treads to rotate.

Figure 44:
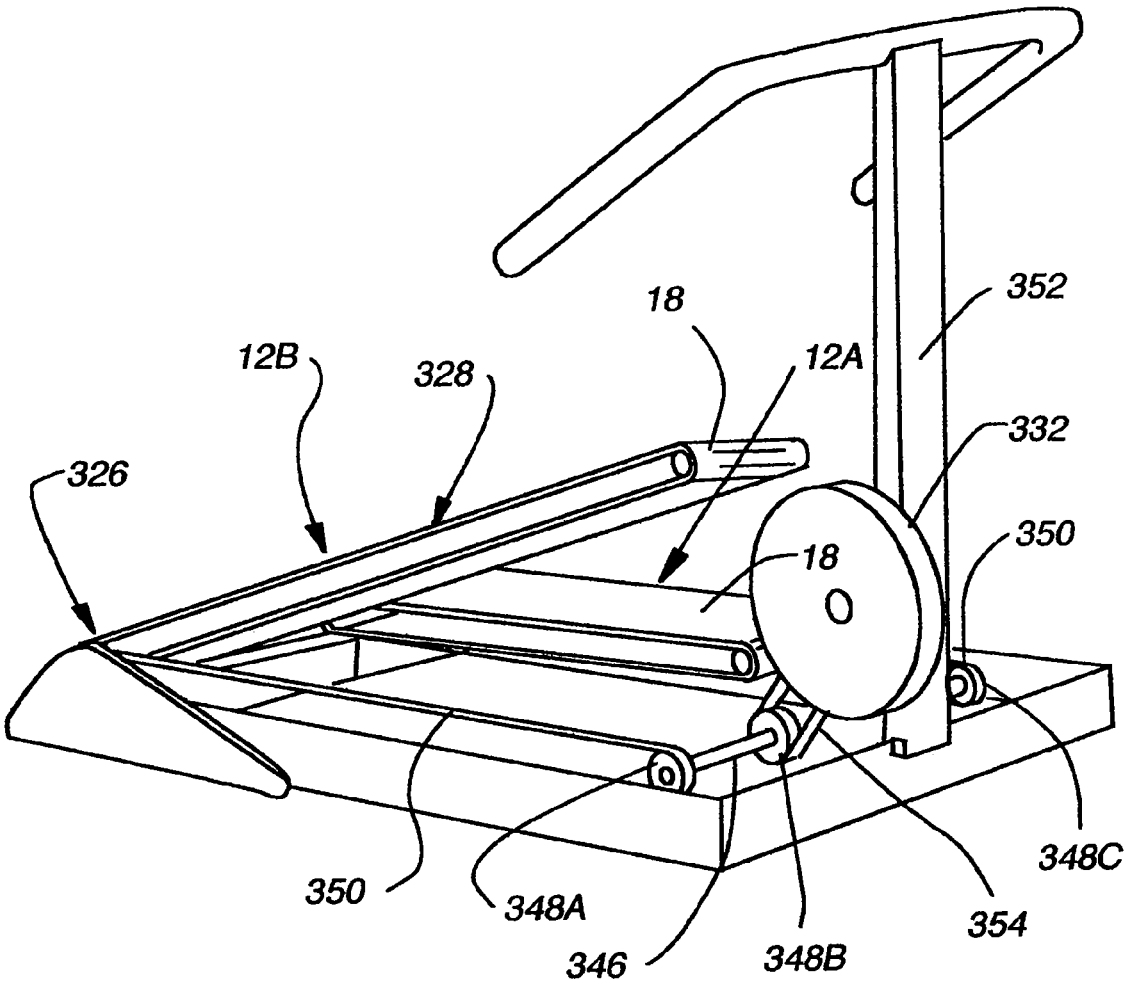
FIG. 44 is a side view of a seventh embodiment of an exercise device employing a flywheel operably coupled with tread belts supported on each treadle assembly.

FIG. 44 illustrates another alternative arrangement for coupling a flywheel 332 to the treads 18. In this example, axle pulleys (326, 328) are again coupled to each end of the rear axle 82. An intermediate axle 346 is arranged at the front of the frame, below the treads (12A, 12B). Flywheel pulleys (348A, B, C) are coupled to each end of the intermediate axle 346, and at a mid region of the intermediate axle. Belts 350 are secured between each axle pulley and the respective flywheel pulley. The flywheel 322 is rotationally supported in a vertical orientation at a front post 352. The flywheel pulley 348B at the mid region of the intermediate axle is coupled with the flywheel by way of a third belt 354.

Figure 45:
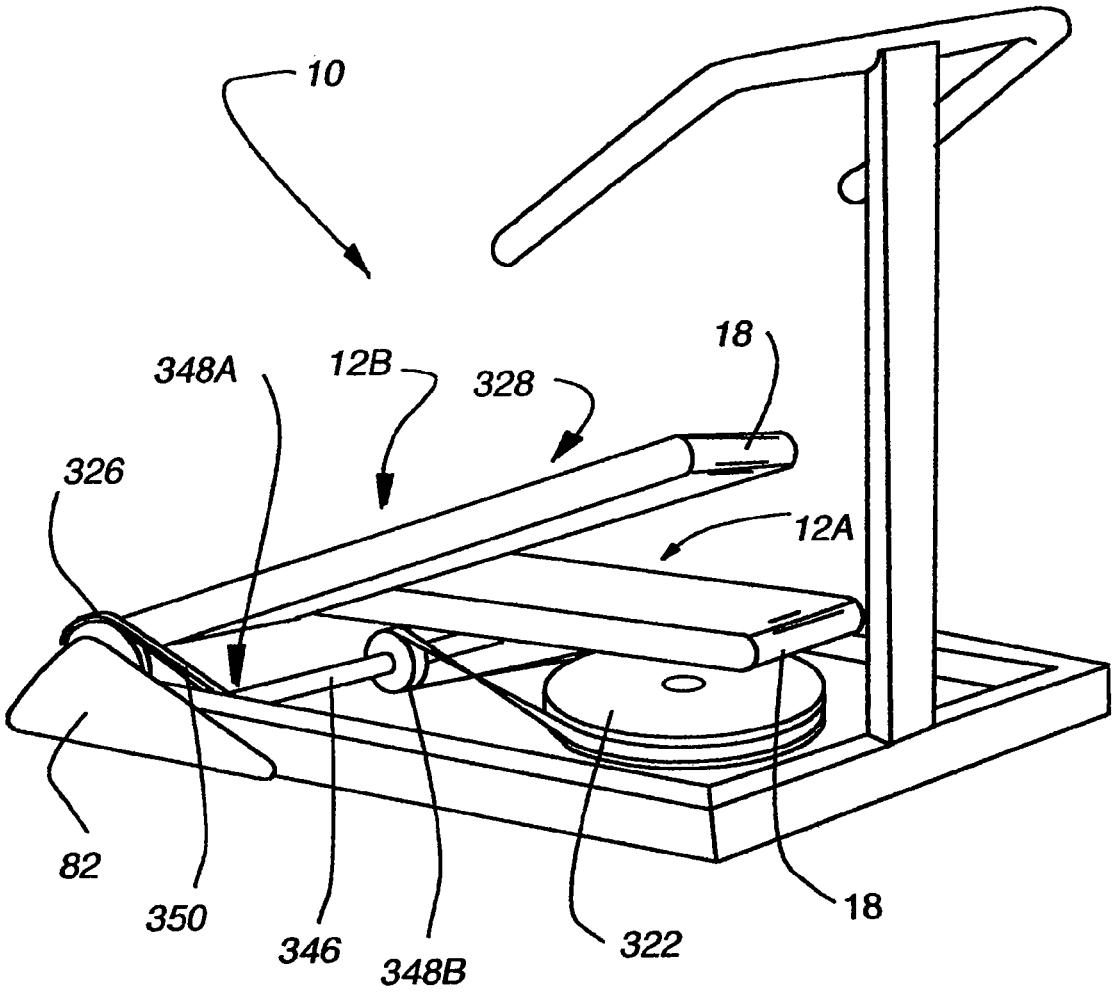
FIG. 45 is a side view of an eighth embodiment of an exercise device employing a flywheel operably coupled with tread belts supported on each treadle assembly.

FIG. 45 illustrates another alternative arrangement for coupling a flywheel 322 to the treads 18. Like the embodiment of FIG. 41, the flywheel is rotationally supported in horizontal plane below the treadles. Further, like other embodiments discussed above, axle pulleys (326, 328) are coupled at each end of the rear axle 82. Somewhat similarly to the embodiment of FIG. 44, an intermediate axle 346 is provided between the outer frame members, just forward the rear axle. Flywheel pulleys (348A, B, C) are provided at either end of the intermediate axle, and at a mid region of the axle. The outer flywheel pulleys may be either inside or outside the frame member to align with the axle pulleys. Belts 350 couple the axle pulleys with the flywheel pulleys. Further, a belt 354, which may be partially twisted, couples the middle flywheel pulley 348B with the flywheel 322. In the configuration illustrated, rearward belt movement, which accompanies forward striding, causes the flywheel to rotate clockwise. If the belt between the middle pulley and the flywheel pulley is twisted in the opposite manner, then the flywheel will rotate counterclockwise. As with other embodiments, the angular momentum from the flywheel can impart driving force to the tread belts.

Figure 46:
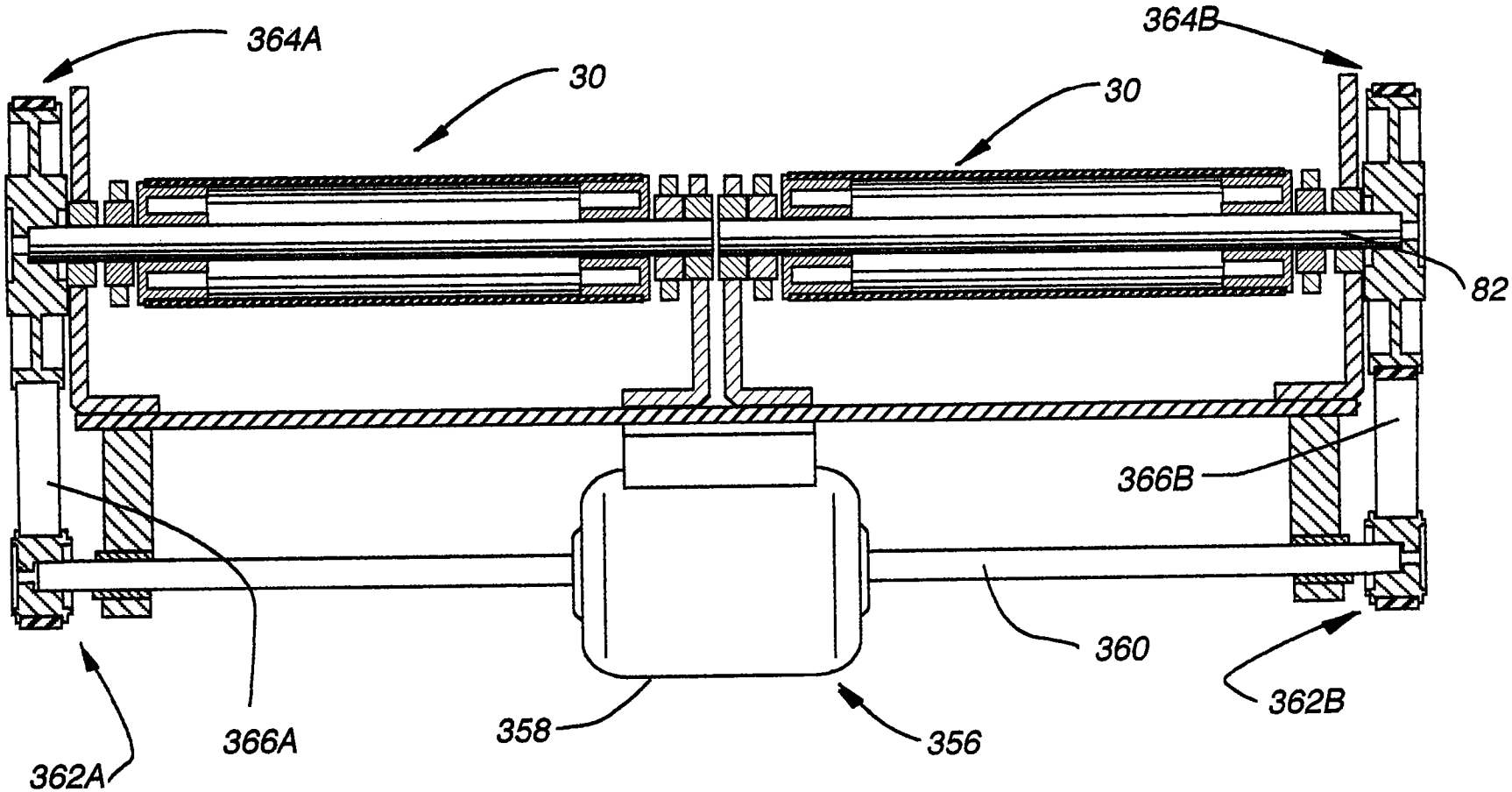
FIG. 46 is a section view of a motor assembly coupled with rear rollers.

Some embodiments of the exercise device 10 with treadle assemblies having a separate rear roller utilize two motors to turn the rear rollers. Using two motors to turn the rear rollers requires the motors be synchronized to some degree. FIG. 46 is a schematic of a roller drive system 356 for use on a dual-treadle exercise device using a single motor 358 to turn the rear rollers. The use of a single motor to turn two rear rollers eliminates the need to synchronize two motors and lowers the associated manufacturing costs and complexity. In this implementation, each treadle assembly (12A, 12B) includes a separate rear roller rotatably supported on the frame. A motor shaft 360 runs through the motor and has a drive pulley (362A, 362B) connected with opposing end portions. Each drive pulley (362A, 362B) is coupled to a respective slave pulley (364A, 364B) through belts (366A, 366B). Each slave pulley is connected with or operably associated with a rear roller on each treadle. As such, the slave pulley can be connected directly with the rear roller inside the frame structure, or to the axle 82 end extending outside the frame structure, or in some other manner. As the motor turns the shaft, the drive pulleys actuate the belt, which in turn rotates the slave pulleys to rotate the two separate rear rollers. The rear rollers in turn then drive the continuous belt on each treadle.

We claim:

1. An exercise device comprising:

a frame structure;

a first treadle assembly including a first endless belt in rotatable engagement with a first roller;

a second treadle assembly including a second endless belt in rotatable engagement with a second roller;

a flywheel operably coupled with the first endless belt and the second endless belt;

a third roller rotatably supported by the frame structure;

the third roller in rotatable engagement with at least one of the first endless belt or the second endless belt;

a first axle coupled with the frame structure, the first axle rotatably supporting the flywheel;

a first pulley coupled with a second axle;

a second pulley coupled with the second axle;

a belt coupling the first pulley and the second pulley with the flywheel; and the flywheel coupled with the frame in a generally horizontal plane; whereby a user can tread upon said endless belts.

2. The exercise device of claim 1, wherein the flywheel is operably coupled with the third roller.

3. The exercise device of claim 1, further comprising:

a fourth roller in rotatable engagement with at least one of the first endless belt or the second endless belt; and the third and fourth rollers are rotatably supported by the second axle.

4. The exercise device of claim 3, wherein the flywheel is operably connected with the second axle.

5. An exercise device comprising:

a frame structure;

a first treadle assembly including a first endless belt in rotatable engagement with a first roller;

a second treadle assembly including a second endless belt in rotatable engagement with a second roller; and a flywheel operably coupled with the first endless belt and the second endless belt and rotatably supported in a generally horizontal plane; whereby a user can tread upon said endless belts.

6. The exercise device of claim 5, further comprising a third roller in rotatable engagement with at least one of the first or the second endless belt.

7. The exercise device of claim 6, further comprising the third roller rotatably supported by an axle.

8. The exercise device of claim 7, further comprising a first pulley operably coupled to the axle.

9. The exercise device of claim 8, further comprising a flexible member operably coupled to the first pulley and to the flywheel.

10. The exercise device of claim 9, wherein the flexible member comprises at least one of a cable or a belt.

11. The exercise device of claim 9, further comprising a second pulley operably coupled to the axle and to the flexible member.

12. The exercise device of claim 11, further comprising a third pulley operably coupled to the flexible member.

13. The exercise device of claim 12, further comprising a second axle operably coupled to the third pulley and rotatably supporting the flywheel.

14. The exercise device of claim 12, further comprising a fourth pulley operably coupled to the flexible member, and a fifth pulley operably coupled to the flexible member.

15. The exercise device of claim 14, further comprising a second axle coupled to the fourth pulley and to the fifth pulley.

16. The exercise device of claim 15, further comprising a third axle coupled to a sixth pulley and to a seventh pulley, and the flexible member operably coupled to the sixth pulley and to the seventh pulley.

17. The exercise device of claim 5, further comprising a first pulley operably coupled to the at least one of the first endless belt or the second endless belt, and a flexible member operably coupled to the first pulley and to the flywheel.

18. The exercise device of claim 17, wherein the flexible member comprises at least one of a cable or a belt.

19. The exercise device of claim 17, further comprising a second pulley operably coupled to the flexible member and at least one of the first endless belt and the second endless belt.

20. The exercise device of claim 19, further comprising a third pulley operably coupled to the flexible member.

21. The exercise device of claim 20, further comprising an axle operably coupled to the third pulley and rotatably supporting the flywheel.

22. The exercise device of claim 20, further comprising a fourth pulley operably coupled to the flexible member, and a fifth pulley operably coupled to the flexible member.

23. The exercise device of claim 22, further comprising an axle coupled to the fourth pulley and to the fifth pulley.

24. The exercise device of claim 23, further comprising a second axle coupled to a sixth pulley and to a seventh pulley, and the flexible member operably coupled to the sixth pulley and to the seventh pulley.

* * * * *